US010975655B2

(12) United States Patent
Rochen et al.

(10) Patent No.: US 10,975,655 B2
(45) Date of Patent: Apr. 13, 2021

(54) SELF-REMOVING PLUG FOR PRESSURE ISOLATION IN TUBING OF WELL

(71) Applicant: Weatherford Technology Holdings, LLC, Houston, TX (US)

(72) Inventors: James A. Rochen, Waller, TX (US); Nauman H. Mhaskar, Houston, TX (US); John R. Setterberg, Jr., Houston, TX (US); Matthew A. Crump, Tomball, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 62 days.

(21) Appl. No.: 16/199,545

(22) Filed: Nov. 26, 2018

(65) Prior Publication Data

US 2019/0093448 A1 Mar. 28, 2019

Related U.S. Application Data

(62) Division of application No. 15/191,297, filed on Jun. 23, 2016, now abandoned.

(Continued)

(51) Int. Cl.
*E21B 33/128* (2006.01)
*E21B 33/129* (2006.01)

(Continued)

(52) U.S. Cl.
CPC ..... *E21B 33/1212* (2013.01); *E21B 23/06* (2013.01); *E21B 29/02* (2013.01);

(Continued)

(58) Field of Classification Search
CPC ..... E21B 33/1208; E21B 33/12; E21B 23/01; E21B 33/128; E21B 33/129; E21B 23/00
See application file for complete search history.

(56) References Cited

U.S. PATENT DOCUMENTS 4,367,468 A 1/1983 Curry
5,398,763 A 3/1995 Watson et al.

(Continued)

FOREIGN PATENT DOCUMENTS

WO 93/15306 A1 8/1993
WO 2014/062200 A1 4/2014

OTHER PUBLICATIONS

GB Search Report received in copending GB Divisional Application No. 1902221.9 dated Apr. 11, 2019, 4 pages.

(Continued)

*Primary Examiner* — Kipp C Wallace
(74) *Attorney, Agent, or Firm* — Blank Rome LLP

(57) ABSTRACT

A downhole apparatus for use in a tubular include a mandrel, a first slip, a cone, and a seal element. The mandrel, which can be permanent or temporary, has a first end shoulder. The first slip is disposed on the mandrel adjacent the first end shoulder, and the cone is disposed on the mandrel adjacent the first slip. The cone is movable relative to the first end shoulder to engage the first slip toward the tubular. The seal element is disposed on the mandrel adjacent the cone. At least a portion of the seal element is composed of a dissolvable metallic material and is expandable outward from the mandrel. The expanded portion of the seal element forms a metal seal against the tubular and seals off fluid communication in the annular space between the seal element and the tubular.

21 Claims, 41 Drawing Sheets

Related U.S. Application Data

(60) Provisional application No. 62/303,121, filed on Mar. 3, 2016, provisional application No. 62/252,945, filed on Nov. 9, 2015, provisional application No. 62/183,551, filed on Jun. 23, 2015.

(51) Int. Cl.

| | |
|---|---|
| ***E21B 33/12*** | (2006.01) |
| ***E21B 34/06*** | (2006.01) |
| ***E21B 23/06*** | (2006.01) |
| ***E21B 29/02*** | (2006.01) |
| ***E21B 33/134*** | (2006.01) |
| ***E21B 43/116*** | (2006.01) |
| ***E21B 43/14*** | (2006.01) |
| ***E21B 43/26*** | (2006.01) |

(52) U.S. Cl.

CPC ..... *E21B 33/128* (2013.01); *E21B 33/129* (2013.01); *E21B 33/134* (2013.01); *E21B 34/063* (2013.01); *E21B 43/116* (2013.01); *E21B 43/14* (2013.01); *E21B 43/261* (2013.01); *E21B 2200/04* (2020.05)

(56) References Cited

U.S. PATENT DOCUMENTS

| | | | | |
|---|---|---|---|---|
| 5,941,313 | A | 8/1999 | Arizmendi | |
| 6,142,231 | A | 11/2000 | Myers, Jr. et al. | |
| 6,394,184 | B2 | 5/2002 | Tolman et al. | |
| 7,044,230 | B2 | 5/2006 | Starr et al. | |
| 7,168,494 | B2 | 1/2007 | Starr et al. | |
| 7,350,582 | B2 | 4/2008 | McKeachnie et al. | |
| 8,267,177 | B1 | 9/2012 | Vogel et al. | |
| 9,033,041 | B2 | 5/2015 | Baihly et al. | |
| 2002/0070503 | A1* | 6/2002 | Zimmerman | E21B 33/1216 277/337 |
| 2005/0205264 | A1 | 9/2005 | Starr et al. | |
| 2005/0205265 | A1 | 9/2005 | Todd et al. | |
| 2007/0131413 | A1 | 6/2007 | Millet et al. | |
| 2007/0277979 | A1 | 12/2007 | Todd et al. | |
| 2008/0271898 | A1 | 11/2008 | Turley et al. | |
| 2010/0101803 | A1 | 4/2010 | Clayton et al. | |
| 2010/0101807 | A1 | 4/2010 | Greenlee et al. | |
| 2011/0048743 | A1 | 3/2011 | Stafford et al. | |
| 2012/0285676 | A1* | 11/2012 | Shaw | E21B 33/03 166/88.1 |
| 2013/0240200 | A1 | 9/2013 | Frazier | |
| 2013/0299192 | A1 | 11/2013 | Xu et al. | |
| 2014/0014339 | A1 | 1/2014 | O'Malley et al. | |
| 2014/0014371 | A1 | 1/2014 | Jacob et al. | |
| 2014/0190685 | A1 | 7/2014 | Frazier et al. | |
| 2014/0202708 | A1 | 7/2014 | Jacob et al. | |
| 2015/0129215 | A1 | 5/2015 | Xu et al. | |
| 2015/0129239 | A1 | 5/2015 | Richard | |
| 2015/0285026 | A1* | 10/2015 | Frazier | E21B 33/1291 166/120 |
| 2016/0305215 | A1 | 10/2016 | Harris et al. | |

OTHER PUBLICATIONS

PCT Search Report and Written Opinion in co-pending PCT Application No. PCT/US2016/039063, dated Sep. 13, 2016, 12-pgs.

* cited by examiner

SELF-REMOVING PLUG FOR PRESSURE ISOLATION IN TUBING OF WELL

CROSS-REFERENCE TO RELATED APPLICATIONS

This is a divisional of U.S. application Ser. No. 15/191,297, filed 27 Jun. 2016, which claims the benefit of U.S. Prov. Appl. Nos. 62/183,551, filed 23 Jun. 2015; 62/252,945, filed 9 Nov. 2015; and 62/303,121, filed 3 Mar. 2016, each of which is incorporated herein by reference in its entirety.

BACKGROUND OF THE DISCLOSURE

In wellbore construction and completion operations, a wellbore is formed to access hydrocarbon-bearing formations (e.g., crude oil and/or natural gas) by drilling a wellbore. Drilling is accomplished by utilizing a drill bit that is mounted on the end of a drill string. To drill the wellbore to a predetermined depth, the drill string is often rotated by a top drive or rotary table on a surface platform or rig, and/or by a downhole motor mounted towards the lower end of the drill string.

After drilling to the predetermined depth, the drill string and drill bit are removed and a section of casing is lowered into the wellbore. An annulus is thus formed between the string of casing and the formation, as the casing string is hung from the wellhead. A cementing operation is then conducted to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Once the casing has been cemented, the casing may be perforated to gain access to the surrounding formation. For example, the casing and surrounding cement are perforated with holes or perforations to communicate the casing with the surrounding formation. Using such perforations, operators can perform any number of operations, such as hydraulic fracturing or dispensing acid or other chemicals into the producing formation. Additionally, the perforations can be used for production flow into a producing string disposed in the casing during producing operations.

Several techniques are currently used to produce perforations in casing and create a flow path. Most of the techniques require a workover rig or a coiled tubing (CT) unit to be used. "Plug-and-perf" is a common technique used to perforate and treat wells with cemented casing. In this technique, an isolation plug is run on wireline along with a setting tool and perforating gun(s) into the cemented casing. The plug is set in the casing with the setting tool, and the perforating gun(s) are used perforate the casing. The running tool and perforating gun(s) are then removed, a ball is deployed to the set plug, and fracture treatment is pumped downhole to the newly created perforations. When treatment of this stage is finished, plug and perforation tools are installed for the next zone to be plugged, perforated, and then treated. Details of such a system are disclosed in U.S. Pat. No. 6,142,231, for example.

The isolation plugs may be retrievable, and retrieval operations can remove the retrievable plugs so production and the like can commence. Alternatively, the isolation plugs may be expendable and composed of a composite material. Once treatment operations are completed, the various plugs left inside the casing can be milled out in a milling operation.

As will be appreciated, retrieving the plugs and milling out the plugs can both take a considerable amount of time and can increase operation costs.

For these reasons, operators have developed isolation plugs that are dissolvable. For example, Magnum Oil Tools offers a Magnum Vanishing Plug' (MVP') composite frac plug that is engineered to dissolve in the common temperature and pressure ratings downhole so that flowback in the tubing can be established without the need for milling.

Schlumberger offers the Infinity Dissolvable Plug-and-Perf System that uses degradable fracturing balls and seats to isolate zones during stimulation. In this system, receptacles are initially run downhole on the casing and cemented with the casing in the wellbore. To perform plug and perf operations, a seat is run downhole on a perforating gun. When positioned near the location on the casing for the seat to be set, a setting tool activates the seat so that it will engage in the receptacle when moved further downhole. The seat is left in the receptacle as the perforating gun is raised and used to make perforations in the casing. After the gun is removed, a dissolvable ball is then deployed to the seat, and treatment fluid is pumped into the formation through the perforations. Operations on additional stages can also be performed. Eventually, the balls and seats remaining in the casing will dissolve. Examples of such a system are disclosed in U.S. Pat. No. 9,033,041, US 2014/0014371, and US 2014/0202708.

The subject matter of the present disclosure is directed to overcoming, or at least reducing the effects of, one or more of the problems set forth above.

SUMMARY OF THE DISCLOSURE

According to the present disclosure, a downhole apparatus for use in a tubular comprises a mandrel, a first slip, a cone, and a seal element. The mandrel, which can be permanent or temporary, has a first end shoulder. The first slip is disposed on the mandrel adjacent the first end shoulder, and the cone is disposed on the mandrel adjacent the first slip. The cone is movable relative to the first end shoulder to engage the first slip toward the tubular.

The seal element is disposed on the mandrel adjacent the cone. At least a portion of the seal element is composed of a dissolvable metallic material and is expandable outward from the mandrel. The expanded portion of the seal element forms a metal seal against the tubular and seals off fluid communication in the annular space between the seal element and the tubular.

In an arrangement where the mandrel is temporary, the first end shoulder is disposed on the mandrel and is removable therefrom in response to a predetermined load. In this way, the mandrel freed of the first end shoulder is removable from the slip, the cone, and the seal element. With the mandrel removed, the seal element can define a seating area engageable by a plug deployed down the tubular to the apparatus. Alternatively, the cone can define a seating area engageable by such a plug.

In an arrangement where the mandrel is permanent, the first end shoulder is disposed toward a first (e.g., downhole) end of the mandrel, and the mandrel has a second end shoulder disposed at a second (e.g., uphole) end adjacent the seal element. The mandrel defines a through-bore from the first end to the second end, and the second end defines a seating area about the through-bore for engaging a deployed plug.

In a first arrangement for the seal, the seal element includes first and second rings disposed on the mandrel and movable longitudinally thereon. An expansion ring is disposed on the mandrel between the first and second rings and expands radially outward with the longitudinal movement of the first and second rings toward one another. This expansion ring can be composed of the dissolvable metallic material and can form the metal seal against the tubular. To enhance the metal seal, the expansion ring can define an external surface disposed circumferentially thereabout and engageable toward the tubular. This external surface can have a plurality of fins extending therefrom.

In a second arrangement for the seal, the seal element can include the first and second rings and the expansion ring and can further include a sheath disposed circumferentially about at least the expansion ring. The sheath deforms outward toward the tubular with the radial expansion of the expansion ring. This sheath can be composed of the dissolvable metallic material and can form the metal seal against the tubular. In fact, the first and second rings, the expansion ring, and the sheath can each be composed of a reactive metal. If desired, a sealing ring can be bonded circumferentially about the sheath and can be engageable against the tubular.

For this form of the second seal, the first ring can be integrally part of the cone. The sheath can have one or more lips extending at least between the first ring and the cone, at least between the second ring and a push ring disposed on the mandrel, or between the first ring and the cone as well as the second ring and the push ring.

The features of the first and second rings and the expansion ring in the first and second seals can have a number of variations. In one example, the first ring defines a first inclined face, and the second ring defines a second inclined face opposing the first inclined face. The expansion ring has first and second inclined sides disposed respectively against the first and second inclined faces. The expansion ring can include first and second split rings interlocked together and each having one of the first and second inclined sides. Moreover, an elastomeric material can be disposed about, on, or between one or more of the first and second rings, the expansion ring, and the split rings to enhance sealing.

For instance, a first elastomeric element can be disposed adjacent the first inclined face of the first ring and can be engageable with the first side of the expansion ring. Alternatively or in addition, a second elastomeric element can be disposed adjacent the second inclined face of the second ring and can be engageable with the second side. Furthermore, the first elastomeric element can have a lip disposed in an edge of the first ring and at least partially engaging the mandrel. Also, the second inclined face of the second ring can define a cutaway accommodating the second elastomeric element. These and other enhancements can be made for sealing off fluid communication.

On the mandrel, a second slip can be disposed adjacent the second ring of the seal element. A second end shoulder, such as a push ring, body lock ring, or the like, can be disposed on the mandrel adjacent the second slip and can moved toward the first end shoulder to engage the second slip toward the tubular.

In a third arrangement of the seal, the seal element includes a push ring, an expansion rings, and a sheath. The push ring is disposed on the mandrel and is movable longitudinally thereon. The expansion ring is disposed on the mandrel between the push ring and an inclined face of the cone. The expansion ring expands radially outward with the longitudinal movement of the push ring and the cone toward one another. The sheath is disposed circumferentially about at least the expansion ring and has a lip extending at least toward the push ring. The sheath, which is composed of the dissolvable metallic material, deforms outward toward the tubular with the radial expansion of the expansion ring to form the metal seal of the apparatus.

In a fourth arrangement of the seal, the seal element is disposed about the cone and disposed against an end of the first slip. The seal element is expandable along an incline of the cone when force longitudinally thereon. In one example, the first slip is disposed against a first incline of the cone, and the seal element is disposed about a second incline of the cone opposed to the second incline so that the seal element is expandable along the second incline of the cone. (FIG. 5A, 7A, 8A).

In one configuration, the mandrel defines a first incline, and the seal element is expandable along the first incline of the mandrel. The cone defines a second incline opposing the first incline. A setting element disposed between the first slip and the seal element concurrently expands the first slip and the seal element along the respective incline and is frangible in response to a predetermined load thereagainst.

The seal element in this fourth seal can include a swage seal having a ring body and having inner and outer seal members. The ring body is composed of the dissolvable metallic material. The inner and outer seal members are disposed respectively about the inner and outer circumferences of the ring body and can be composed of a degradable elastomer or the like.

In a fifth arrangement of the seal, the seal element includes first and second rings and a push ring. The first ring is disposed on the mandrel adjacent the cone, and the second ring is disposed on the mandrel adjacent the first ring. The first ring has first petals flexible outward therefrom, and the first ring has a lip disposed at least partially between the cone and the mandrel. The second ring also has second petals flexible outward therefrom.

The push cone is disposed on the mandrel adjacent the second ring and is moveable longitudinally on the mandrel toward the first end shoulder. The first and second petals of the first and second rings are offset from one another and expand radially outward to seal against the tubular. To enhance sealing, at least one or more of the first ring, second ring, and push cone can have a coating of elastomeric material.

In another arrangement where the mandrel is permanent, the mandrel is an expandable sleeve. The first slip and the seal element are disposed on an outer surface of the expandable sleeve. The cone is disposed in the expandable sleeve, and the cone is movable toward the first end shoulder to expand the expandable sleeve and engage the first slip and the seal element toward the tubular.

For this arrangement, the first end shoulder of the mandrel can be an at least partially closed end of the expandable sleeve, and the cone can have a portion sealably engaging the at least partially closed end. Alternatively, the cone can be removable from the expandable sleeve, and the first end shoulder is a closed end of the expandable sleeve.

According to the present disclosure, the downhole apparatus for use in the tubular can include one or more of a perforating gun and a running tool. The running tool can move mandrel and components of cone, first slip, and seal element relative to one another to set in the tubular. The running tool may release from the mandrel when permanent or may withdraw the mandrel when temporary from the set components. The perforating gun can be run into the tubular and can operable to perforate the tubular. The running tool can be run separately from the perforating gun, or they can be run together. For example, the running tool can extend from the perforating gun and can be temporarily affixable to the apparatus.

According to the present disclosure, the dissolvable metallic material can be a reactive metal; a magnesium alloy; or calcium, magnesium, and aluminum including alloying elements of calcium, magnesium, aluminum, lithium, gallium, indium, zinc, and bismuth. One or more components of the apparatus other than the seal element can be composed of one or more of a reactive metal, a degradable composite polymer, a self-removing material, and an elastomeric material.

The foregoing summary is not intended to summarize each potential embodiment or every aspect of the present disclosure.

BRIEF DESCRIPTION OF THE DRAWINGS

FIGS. 1F-1, 1F-2, and 1F-3 illustrate details of the expansion element or rings for the disclosed plug.

FIGS. 10A-1, 10A-2, and 10B illustrate cross-sectional views of a tenth self-removing plug according to the present disclosure during stages of setting in tubing.

FIGS. 26A, 26B, 26C, 26D-1, 26D-2, and 26D-3 illustrate the molding process of the additional sealing for the expansion rings.

DETAILED DESCRIPTION OF THE DISCLOSURE

Figure 1A:
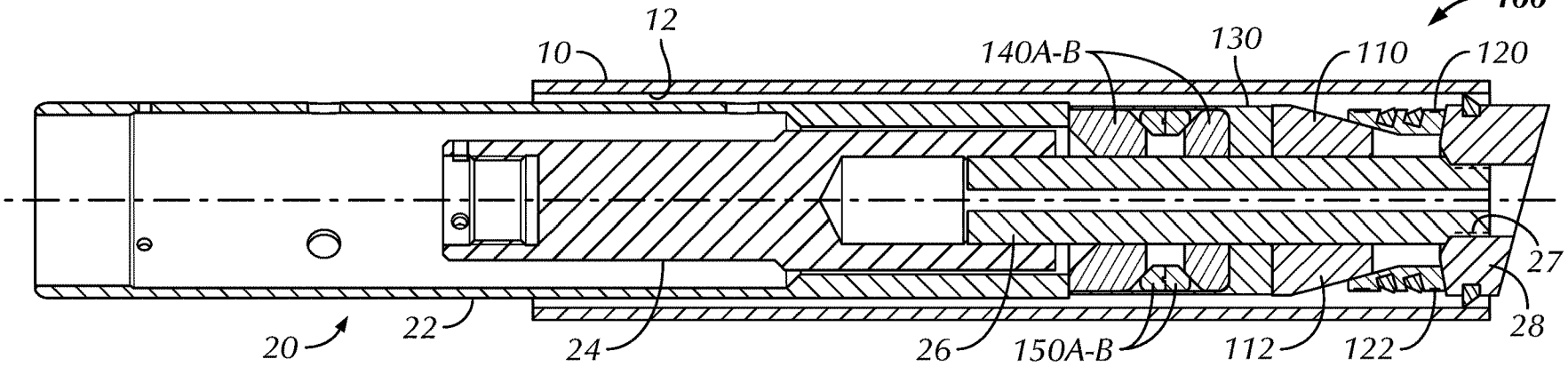
FIGS. 1A-1C illustrate cross-sectional views of a first self-removing plug according to the present disclosure during stages of setting in tubing.
Figure 1B:
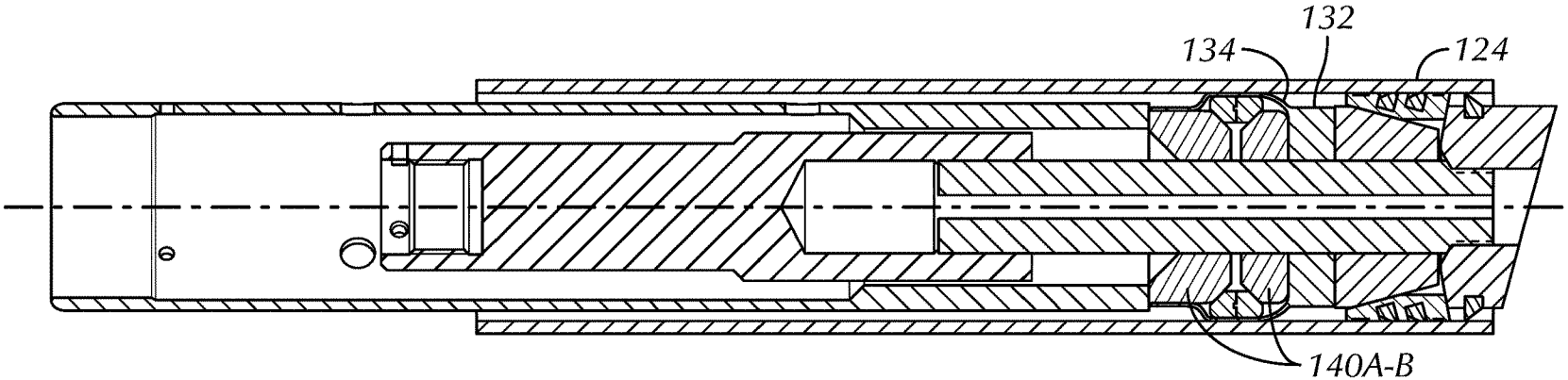
Figure 1C:
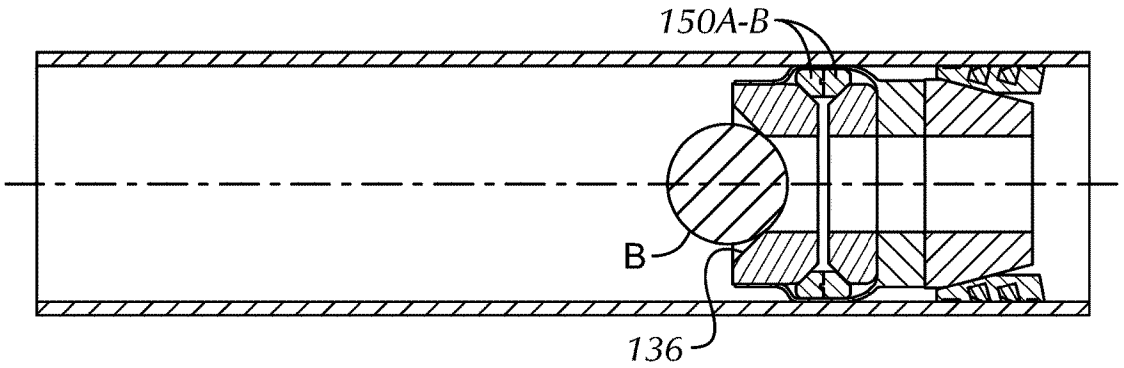
Figure 1D:
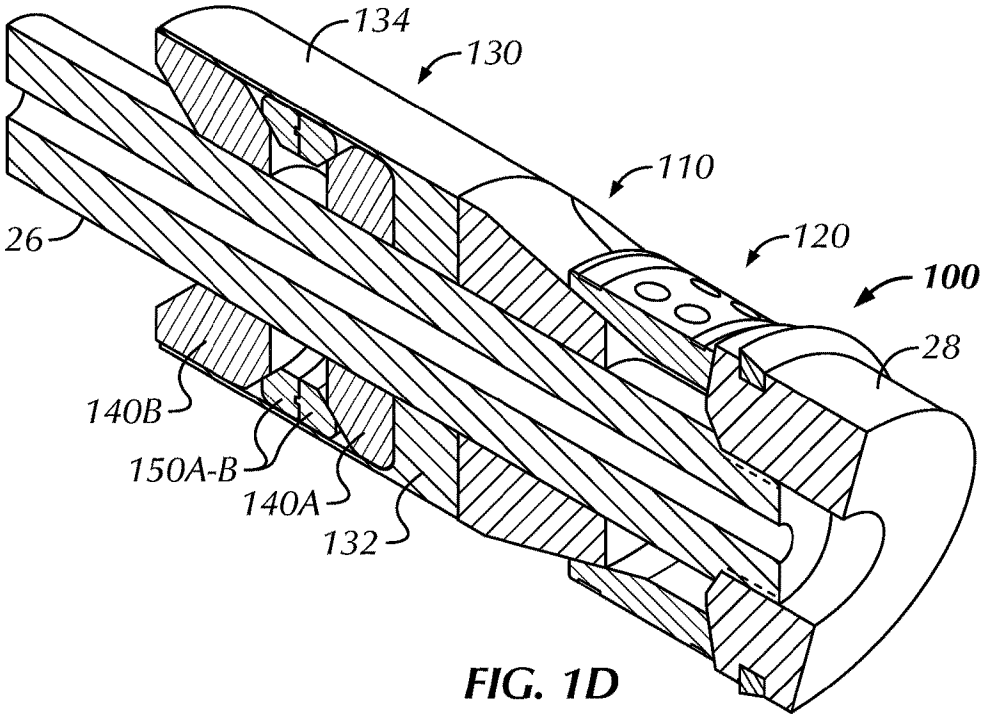
FIG. 1D illustrates a perspective view of the first self-removing plug in cross-section.

FIGS. 1A-1C illustrate cross-sectional views of a first self-removing plug 100 according to the present disclosure during stages of setting in tubing, such as cemented casing 10. FIG. 1D illustrates a perspective view of the first self-removing plug 100 in cross-section. The plug 100 includes a cone 110, a slip 120, and a seal element (having a sealing sleeve or sheath 130, body rings 140A-B, and expansion element or rings 150A-B).

This plug 100 (as well as the other plugs disclosed herein) is self-removing. For example, the various components of this plug 100 and the others disclosed herein can be composed of a dissolvable material. In one embodiment, such a dissolvable material can include a reactive metal, such as a magnesium alloy. One particular magnesium alloy is Solu-Mag™ available from Magnesium Elektron Alloys. Other reactive metals, such as calcium, magnesium, aluminum, can be used and can include alloying elements of calcium, magnesium, aluminum, lithium, gallium, indium, zinc, or bismuth. For example, the cone 110, slip 120, sealing sleeve 130, body rings 140A-B, and expansion rings 150A-B can be composed of such reactive metals. If used on the disclosed plug 100, slip inserts 124 can be composed of ductile iron, while any seals, pump-down rings, etc. can be composed of elastomer. In one configuration, the slip 120, the sealing sleeve 130, and the expansion rings 150A-B are manufactured from a ductile/high elongation dissolvable material. The material's elongation properties can be in the range of 18-28%, but can be slightly more or less. Other components can be similarly configured.

In addition to using dissolvable material for the disclosed plugs 100, other self-removing materials can be used. For example, the material for the various components can be composed of a degradable composite polymer, such as available from Bubbletight, LLC. Still other materials can be used that are dissolvable, degradable, corrodible, biodegradable, combustible, erodible, etc. so that the disclosed plugs 100 can be self-removing. Some examples of such materials include polyglycolic acid (PGA), a pyrotechnic composition, natural stone (e.g., limestone), a water-reactive agent, a hydrocarbon soluble material, etc.

All of the components can be composed of a similar material, or different combinations of the various materials can be used. In terms of the present disclosure, reference to removing of a self-removing material (e.g., dissolving of dissolvable material and the like) can refer to a number of activities for various materials, including corroding, disintegrating, melting, degrading, biodegrading, eroding, combusting, etc. of material under existing well conditions, after a period of time, and/or in response to an introduced medium or trigger (e.g., acid, temperature, chemical substance, solvent, enzyme, pressure, water, hydrocarbon, etc.).

For run in as shown in FIG. 1A, a running tool 20 has an outer setting sleeve 22 disposed about an inner setting tool 24. (This running tool 20 can be run alone on wireline or other conveyance or can be run with a perforating gun assembly on wireline or the like.) The components 110, 120, 130, 140A-B, and 150A-B of the disclosed plug 100 fit on a run-in mandrel 26, which may be composed of steel and is connected to the inner tool 24. (Thus, during run-in, the mandrel 26 acts as part of the plug 100, but the mandrel 26 is removable once the plug 100 is set as discussed below.) A mule shoe 28 is affixed on the end of the run-in mandrel 26 to hold the plug 100 in place. A temporary connection, such as a shearable thread 27, holds the mule shoe 28 on the run-in mandrel 26 until setting procedures are complete, as discussed later. Other temporary connections could be used to hold the mule shoe 28 on the mandrel 26.

The cone 110 of the plug 100 has an incline 112 against which the slip 120 can wedge. The other end of the slip 120 abuts against the mule shoe 28, which is used to push the slip 120 on the incline 112 during setting.

The sealing sleeve 130 has a lip 132 of increased thickness and width that fits around the run-in mandrel 26 like a ring and abuts against the cone 110. A thin sheath 134 of the dissolvable material of the sealing sleeve 130 extends from this lip 132 so that the lip 132 acts as an anchor for the thin sheath 134 as it runs along the outside of the plug 100. Disposed within this sheath 134 around the run-in mandrel 26, the plug 100 has its body rings 140A-B and expansion rings 150A-B. The body rings 140A-B sandwich the expansion rings 150A-B, and each abutting corner of these rings 140, 150 can have angled edges.

Figures 1, 1E, 2:
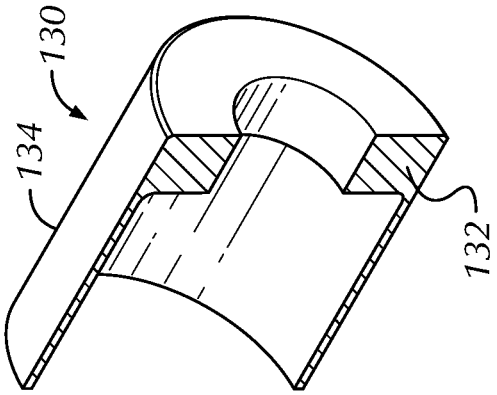
FIGS. 1E-1 and 1E-2 illustrate details of the setting sleeve, body rings, and expansion element or rings for the disclosed plug.
Figures 1, 1E:
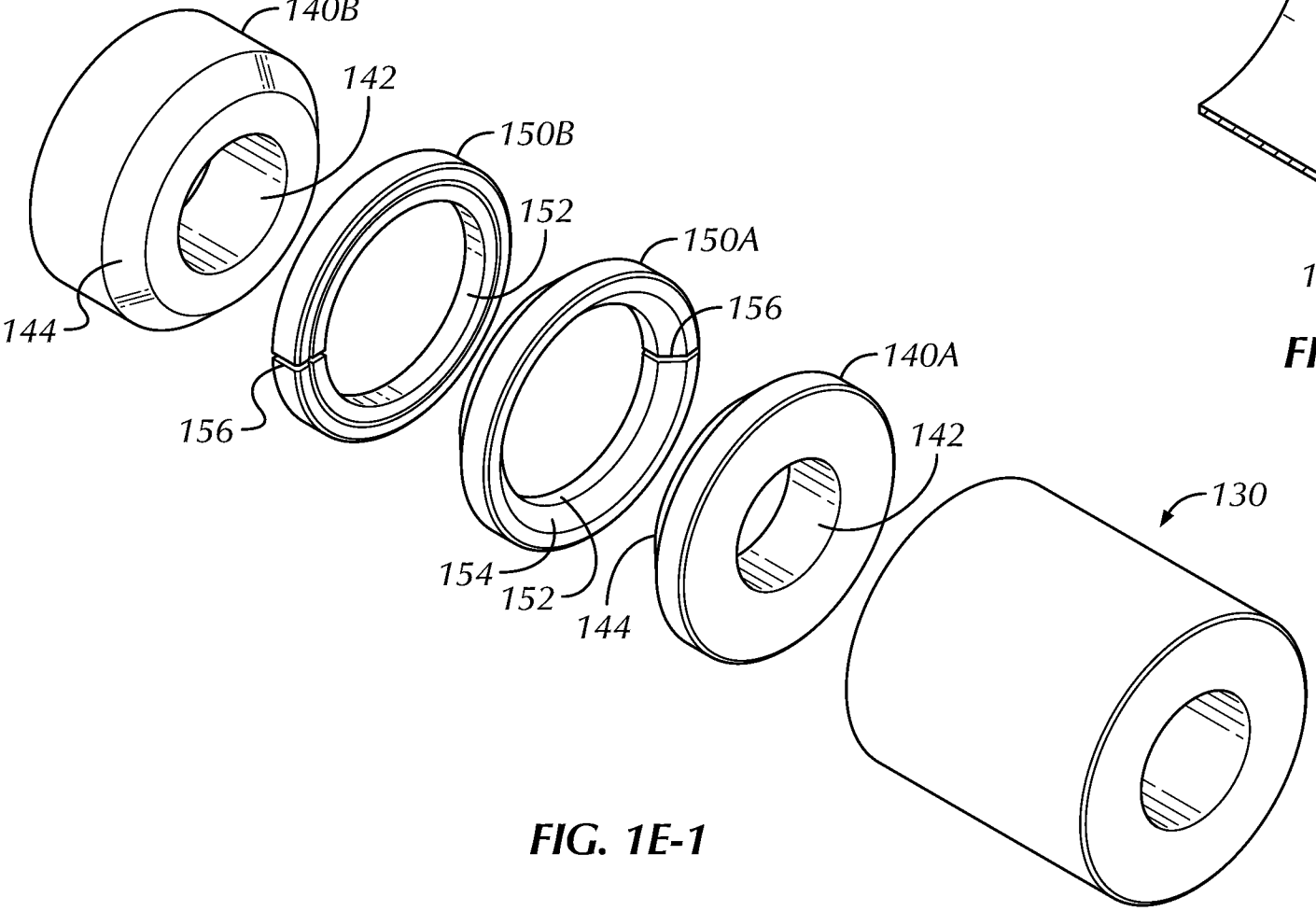
Figures 1, 1F, 2:
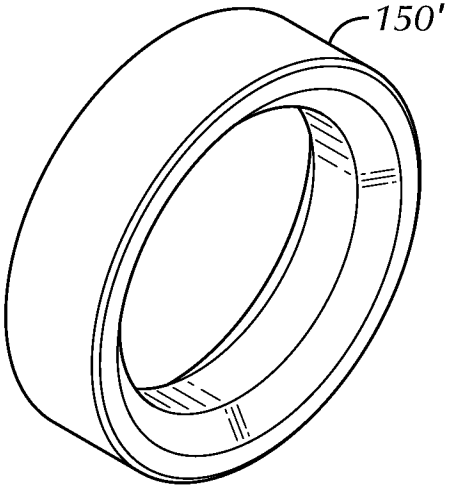

FIGS. 1E-1 and 1E-2 illustrate details of the sealing sleeve 130, the body rings 140A-B, and the expansion element or rings 150A-B for the disclosed plug 100. The sleeve 130 and rings 140A-B, 150A-B each have central passages 142, 152, 131 for fitting on a mandrel (not shown). The rings 140A-B, 150A-B have angled edges 144, 154. As shown, the expansion rings 150A-B preferably includes two adjacent split C-rings that can slide relative to one another as they expand outward. The splits 156 in these rings 150A-C are misaligned so that the two split rings 150A-B together form a complete ring.

Figures 1, 1F, 2, 3:
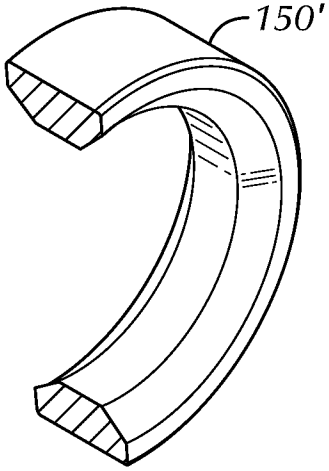
Figures 1, 1F:
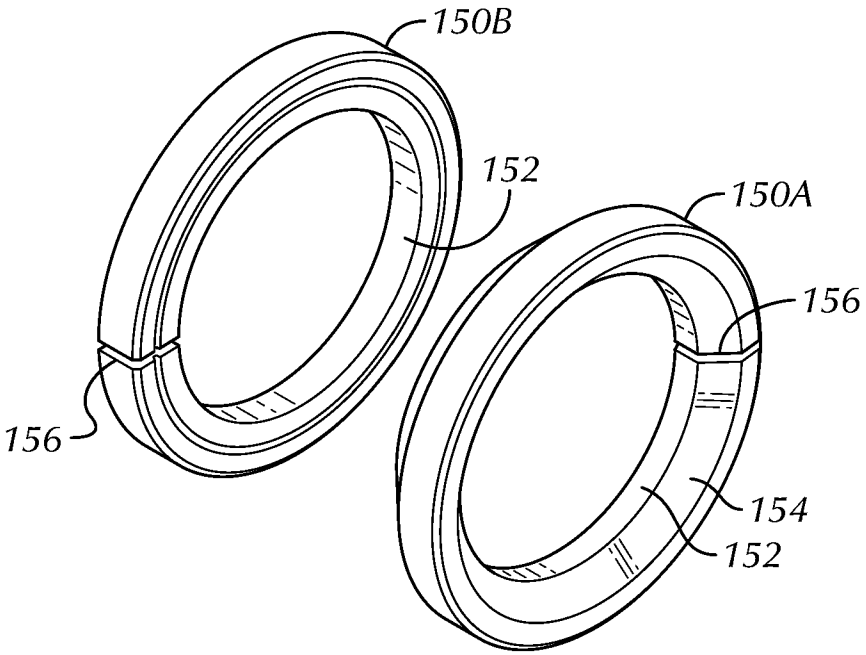

FIGS. 1F-1, 1F-2, and 1F-3 illustrate alternative details of the expansion element or rings for the disclosed plug. Instead of the split rings 150A-C discussed above and shown in FIG. 1F-1, the expansion element can be a ring 150' of elastomer or other deformable material, as illustrated in FIGS. 1F-2 and 1F-3.

During run-in as shown in FIG. 1A, the plug 100 is held on the run-in mandrel 26 uncompressed. The running tool 20 is coupled to an actuator (not shown) used for activating the setting tool 20 and setting the plug 100. During activation, the setting sleeve 22 pushes against the body ring 140B, while the inner setting tool 24 pulls the run-in mandrel 26 in the opposite direction. As a result, the mule shoe 28 concurrently pushes against the slip 120, and the components of the plug 100 are compressed.

As shown in FIG. 1B, the slip 120 is pushed up the incline 112 and wedged against the inside wall 12 of the casing 10. The slip 120 can be a continuous cylindrical shape with separable splits, cuts, or the like formed therein, can be independent segments, or can have some other known configuration. At the same time, the body rings 140A-B are brought together, and the expansion rings 150A-B are forced outward toward the surrounding casing 10. The sheath 134 bulges outward by being deformed by the expansion ring 150A-B and forms a metal-to-metal seal with the inner casing wall 12.

Eventually, the setting force shears the mule shoe 28 free from the run-in mandrel 26 so that the setting tool 20 is released from the plug 100, which is now set in the casing 10. The mule shoe 28 can fall downhole where it can dissolve, and the setting tool 20 can be retracted from the casing 20. The plug 100 is now ready for use.

As shown in FIG. 1C, the plug 100 remains set with the seal element expanded. As noted, the components of the seal element, e.g., the sealing sleeve 130, the expansion rings 150A-B, and the like, are composed of a dissolvable metallic material, which can be ductile and have elongation properties and which can remain expanded after setting.

As then shown in FIG. 1C, a ball B or other plugging element can be deployed to the plug 100 to seat against the seating surface 146 of the body ring 140B. Pressure for a fracture treatment can be applied against the plug 100 with the seated ball B, which prevents the treatment from passing to zones further downhole. (Although a ball B is shown and referenced throughout this disclosure, other types of plugging elements B can be used, including darts, cones, etc., known and used in the art. Therefore, reference to a ball B as used herein refers equally to any other acceptable plugging element.) The pressure against the seated ball B on the set plug 100 can further act to seal the plug's seal element against the casing with the slip 120 helping anchor the plug 100 in place.

Figure 2A:
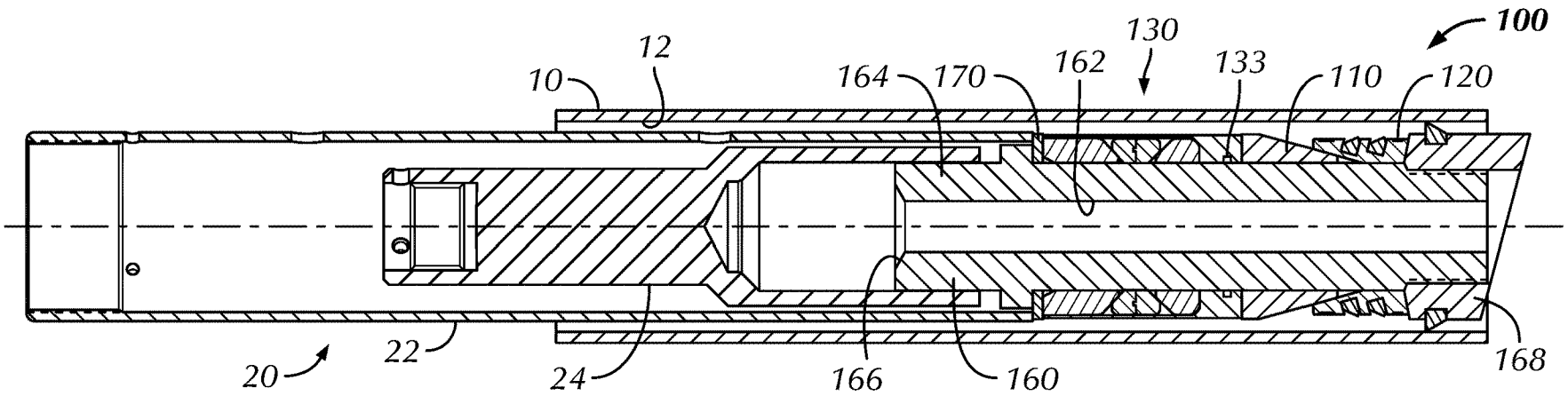
FIGS. 2A-2C illustrate cross-sectional views of a second self-removing plug with a mandrel according to the present disclosure during stages of setting in tubing.
Figure 2B:
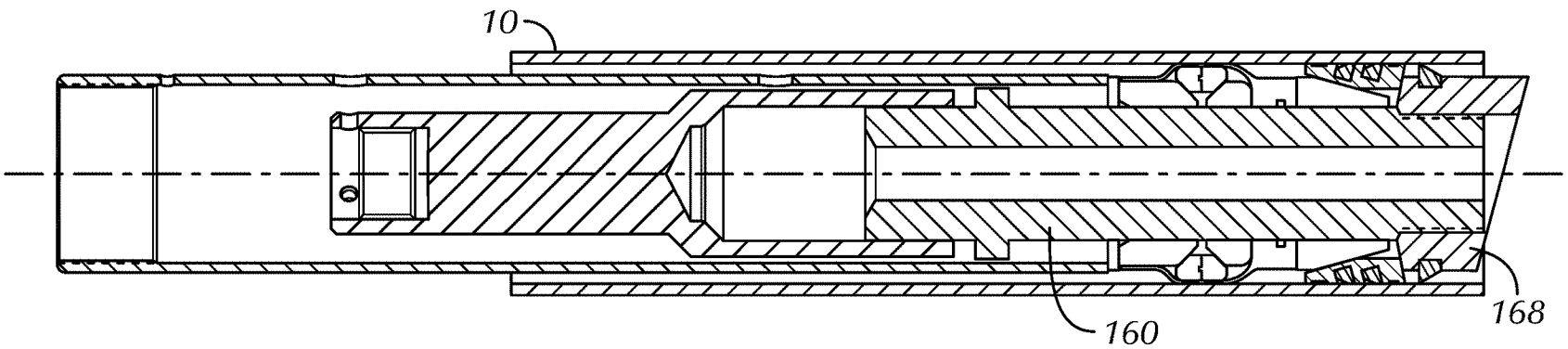
Figure 2C:
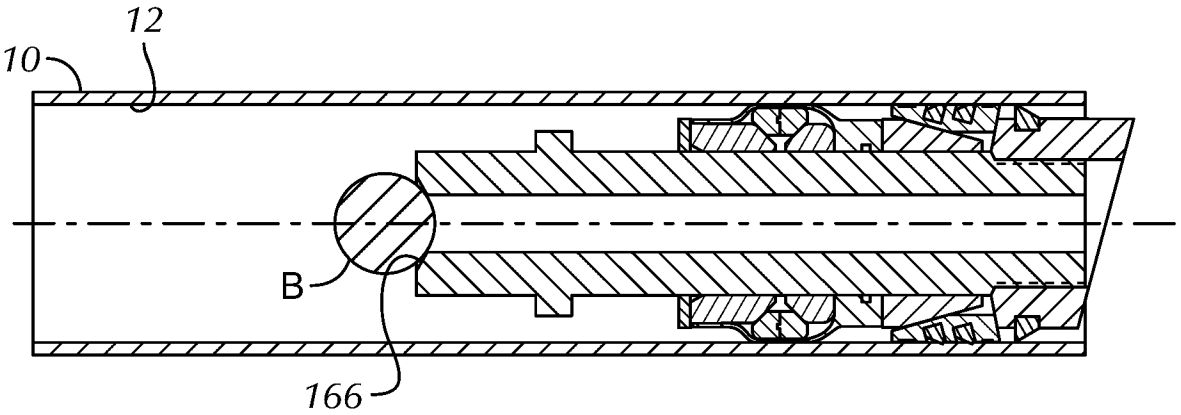
Figure 2D:
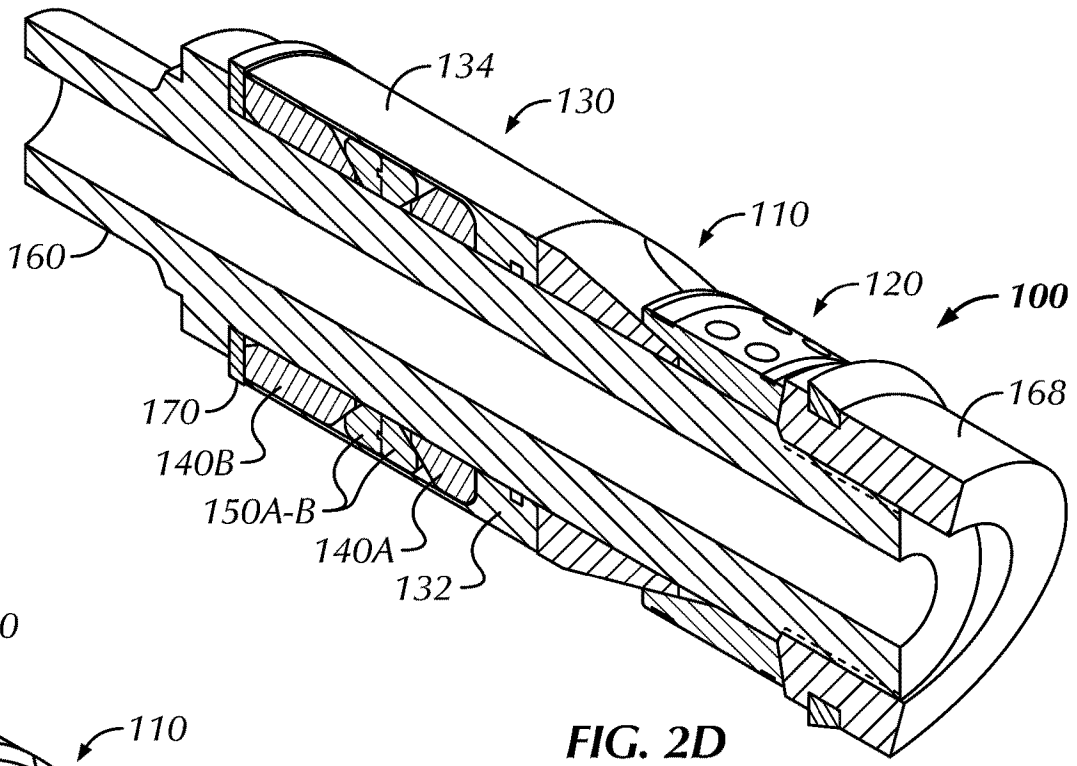
FIG. 2D-2E illustrate perspective views of the second self-removing plug in cross-section and in full.
Figure 2E:
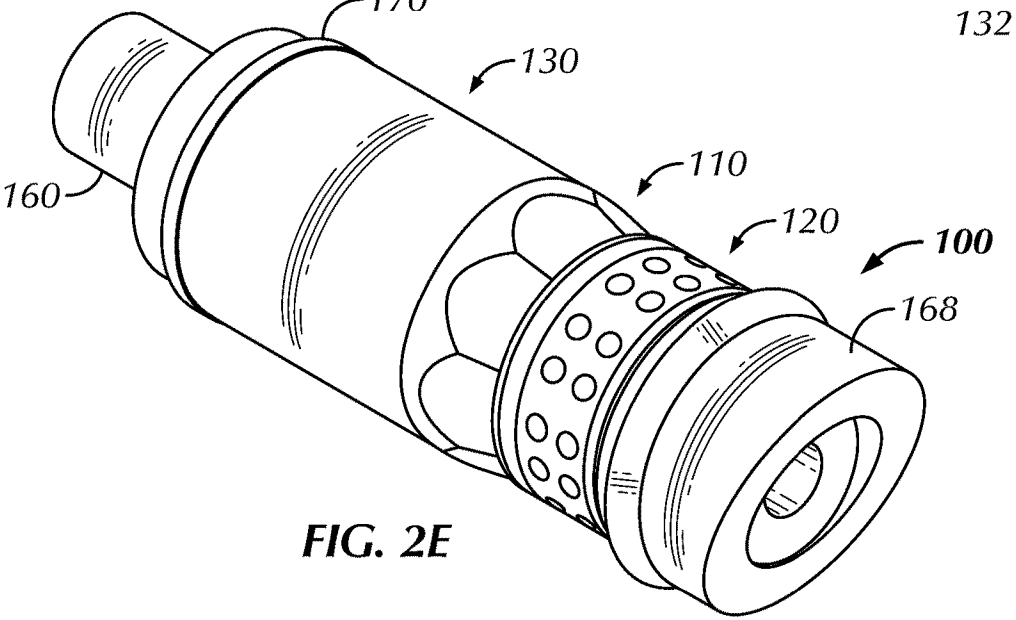

FIGS. 2A-2C illustrate cross-sectional views of a second self-removing plug 100 according to the present disclosure during stages of setting in tubing 10, and FIG. 2D-2E illustrate perspective views of the second self-removing plug 100 in cross-section and in full. This plug 100 is similar to that disclosed above with reference to FIGS. 1A-1D so that like reference numerals are used for similar components. In contrast to the previous embodiment, this plug 100 includes a mandrel 160 that remains with the plug 100 after setting.

On this plug 100, the permanent mandrel 160 is attached to the inner setting tool 24 of the running tool 20 with a temporary connection, such as a shearable or releasable thread 164. With the setting forces applied, the running tool 20 can eventually shear free of the permanent mandrel 160 which remains as part of the plug 100.

In other differences, the plug 100 includes one or more seals on the ring components and the mandrel 160 to prevent fluid bypass. For example, the lip 132 of the sealing sleeve 130 can have an O-ring seal 133 on its inner diameter to seal against the mandrel 160. As another difference, a contact ring 170 can be disposed on the mandrel 160 against which the setting sleeve 22 presses during setting procedures.

Figure 3A:
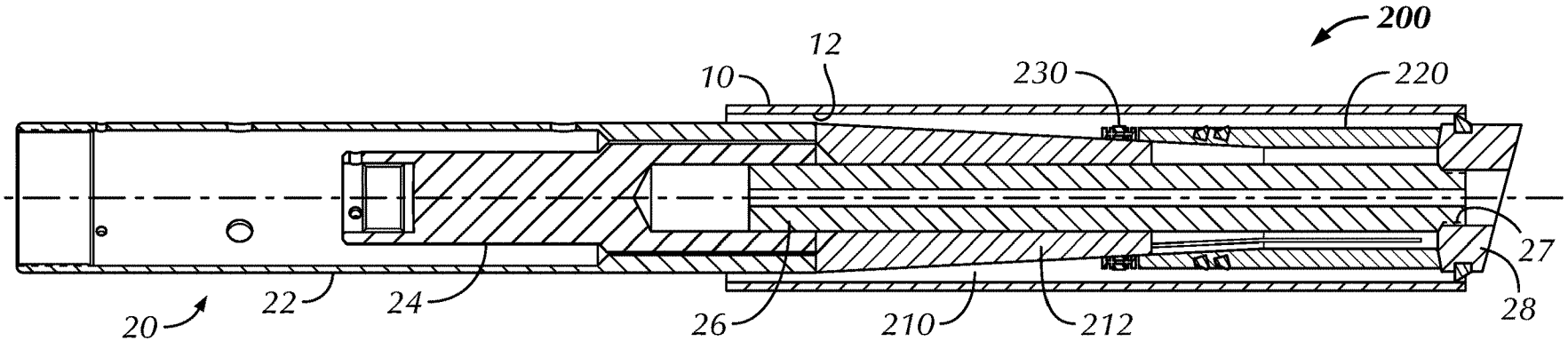
FIGS. 3A-3C illustrate cross-sectional views of a third self-removing plug according to the present disclosure during stages of setting in tubing.
Figure 3B:
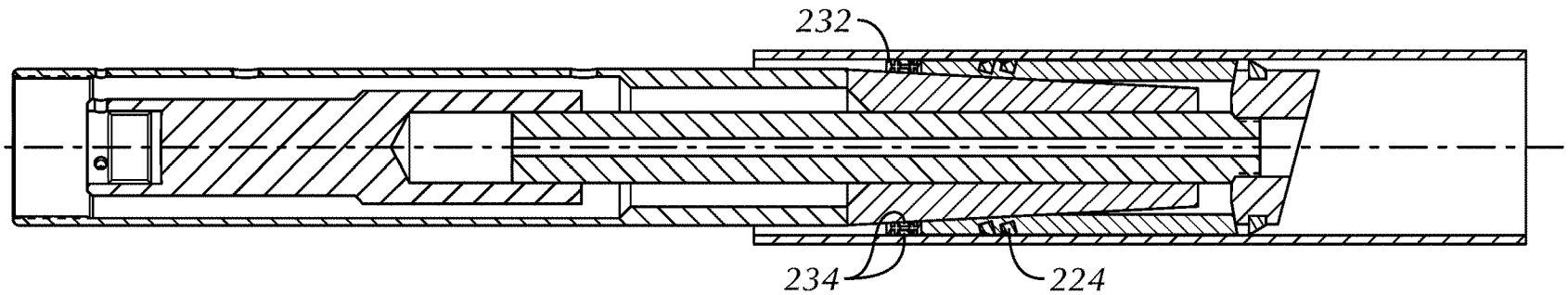
Figure 3C:
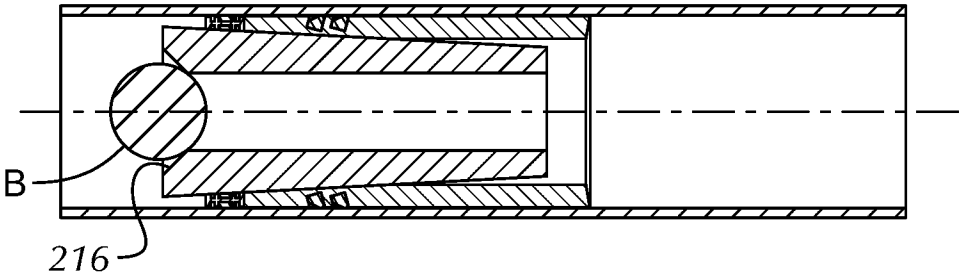
Figure 3D:
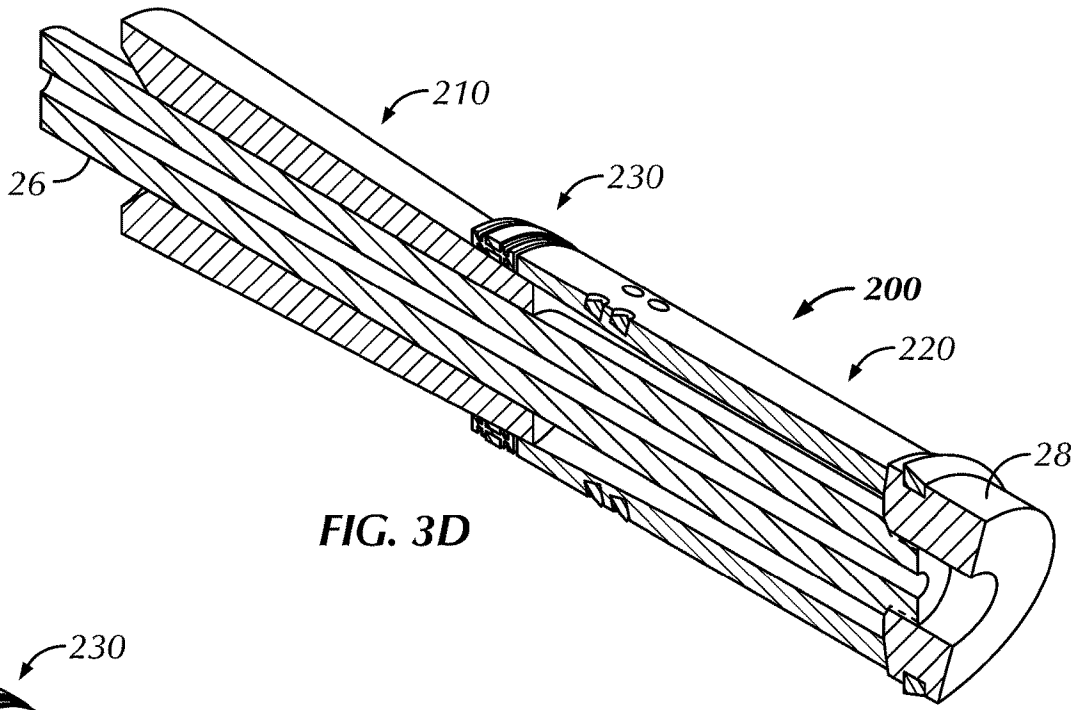
FIGS. 3D-3E illustrate perspective views of the third self-removing plug in cross-section and in full.
Figure 3E:
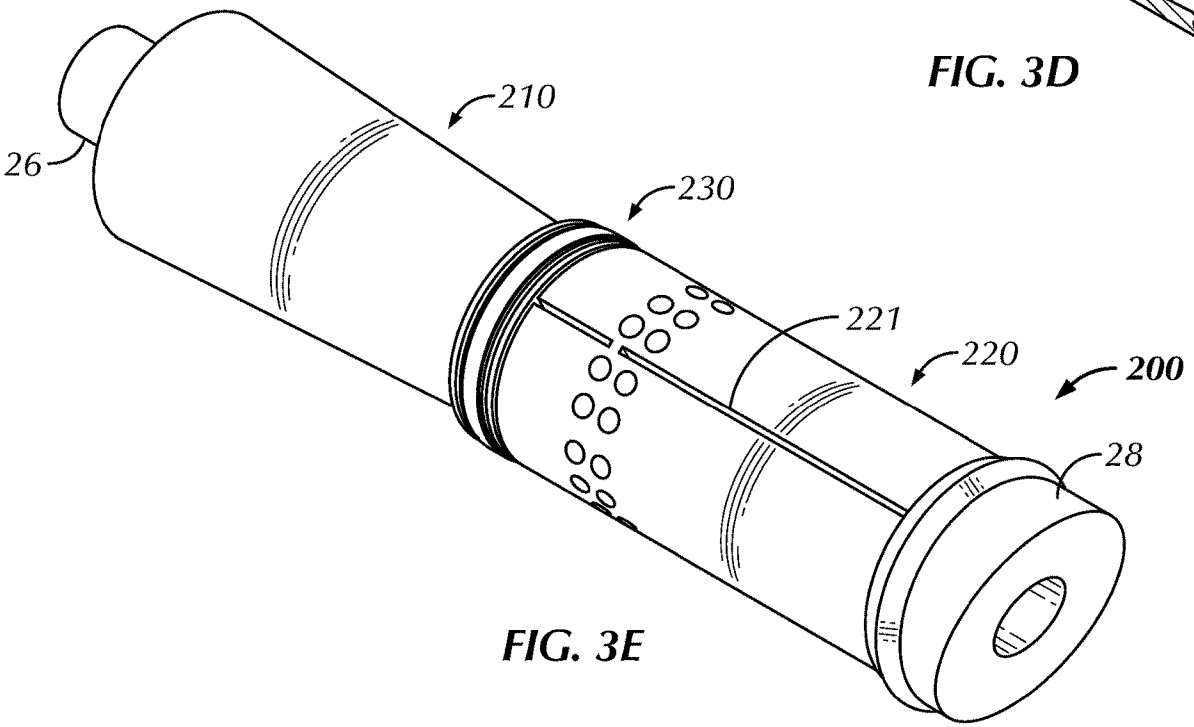

FIGS. 3A-3C illustrate cross-sectional views of a third self-removing plug 200 according to the present disclosure during stages of setting in tubing, and FIGS. 3D-3E illustrate perspective views of the third self-removing plug 200 in cross-section and in full. The plug 200 includes a wedge body or cone 210, a slip body or slip 220, and a seal element or swage seal 230. Each of these components can be composed primarily of a dissolvable material, such as a reactive metal as disclosed herein.

For run-in as shown in FIG. 3A, a running tool 20 has an outer setting sleeve 22 disposed about an inner setting tool 24. The components 210, 220, and 230 of the plug 200 fit on a run-in mandrel 26, which can be composed of steel and is connected to the inner tool 24. (Again, this run-in mandrel 26 is not permanent and can be removed once the plug 200 is set as discussed below.) A mule shoe 28 composed of a dissolvable material is affixed on the end of the run-in mandrel 26 to hold the plug 200 in place. A temporary connection, such as a shearable thread 27, hold the mule shoe 28 on the run-in mandrel 26 until setting procedures are complete, as discussed later.

The wedge body 210 of the plug 200 has the form of a cone having an incline 212 against which the slip body 220 can wedge. The other end of the slip body 220 abuts against the mule shoe 28, which is used to push the slip body 220 on the incline 212 during setting.

The swage seal 230 is disposed on the incline 212 of the wedge body 210. In general, the swage seal 230 is a seal element having a ring body 232, which can be composed of dissolvable metal. Internal and external seal members 234 can be disposed about the inner and outer dimensions of the ring body 232. These seal members 234 can be elastomer, soft metal, polymer, etc.

During run-in as shown in FIG. 3A, the plug 200 is held on the run-in mandrel 26 uncompressed. The running tool 20 is coupled to an actuator (not shown) used for activating the setting tool 20 and setting the plug 200. During activation, the setting sleeve 22 pushes against the wedge body 210, while the inner setting tool 24 pulls the run-in mandrel 26 in the opposite direction. As a result, the mule shoe 28 concurrently pushes against the slip body 220, and the components of the plug 200 are compressed.

As shown in FIG. 3B, the slip body 220 is pushed up the incline 212 and wedged against the inside wall 12 of the casing 10. At the same time, the inserts 224 in the slip body 220 bite into the casing wall 12, and the swage seal 230 is expanded outward toward the surrounding casing 10. As shown in FIG. 3E, the slip body 220 can have one or more slits 221 (i.e., divisions, cuts, or the like) that make the body 220 separable or expandable into one or more segments. For example, the slip body 220 can have one slit 221 so that the body 220 can expand outward as a partial cylinder when wedged by the wedged body 210. Alternatively, the slip body 220 can have more slits 221 so it can separate into various segments.

Eventually, the setting force shears the mule shoe 28 free from the run-in mandrel 26 so that the setting tool 20 is released from the plug 200, which is now set in the casing 10. The mule shoe 28 can fall downhole where it can dissolve, and the setting tool 20 can be retracted from the casing 20. The plug 200 is now ready for use. As shown in FIG. 3C, a ball B or the like can be deployed to the plug 200 to seat against the seating surface 216 of the wedge body 210. Pressure for a fracture treatment can be applied against the plug 200 with the seated ball B, which prevents the treatment from passing to zones further downhole. Pressure against the seated ball B can tend to further wedge the plug 200. This may be true not only for this plug 200, but the other plugs disclosed herein.

Figure 4A:
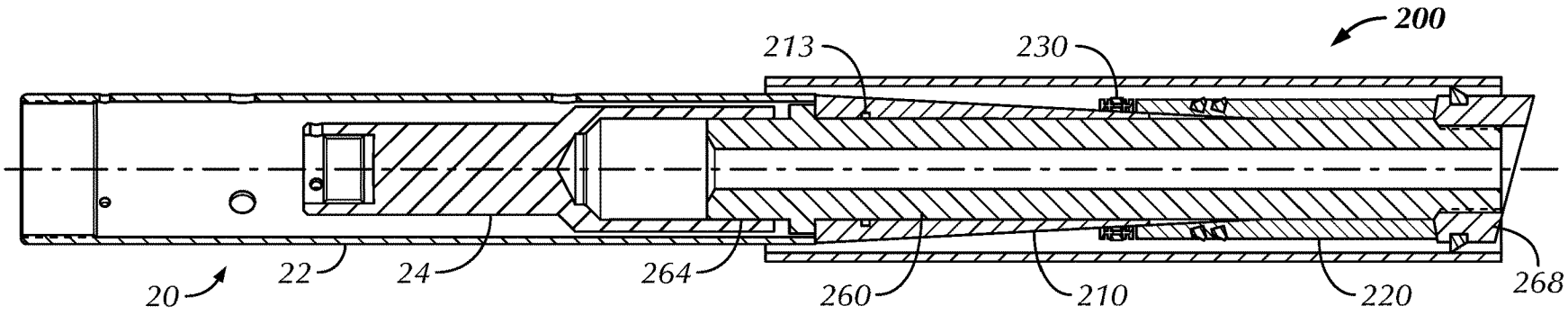
FIGS. 4A-4C illustrate cross-sectional views of a fourth self-removing plug with a mandrel according to the present disclosure during stages of setting in tubing.
Figure 4B:
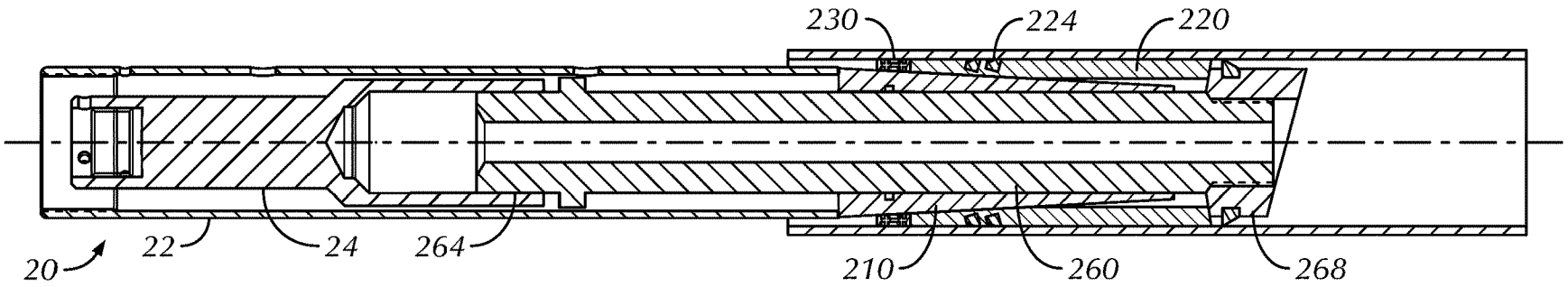
Figure 4C:
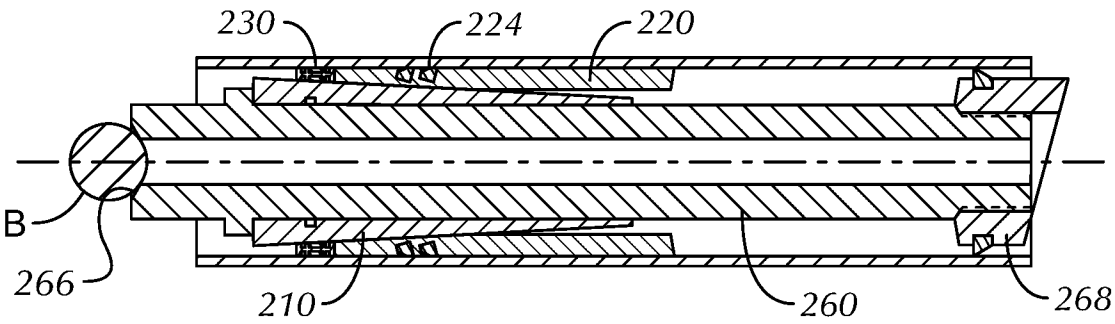
Figure 4D:
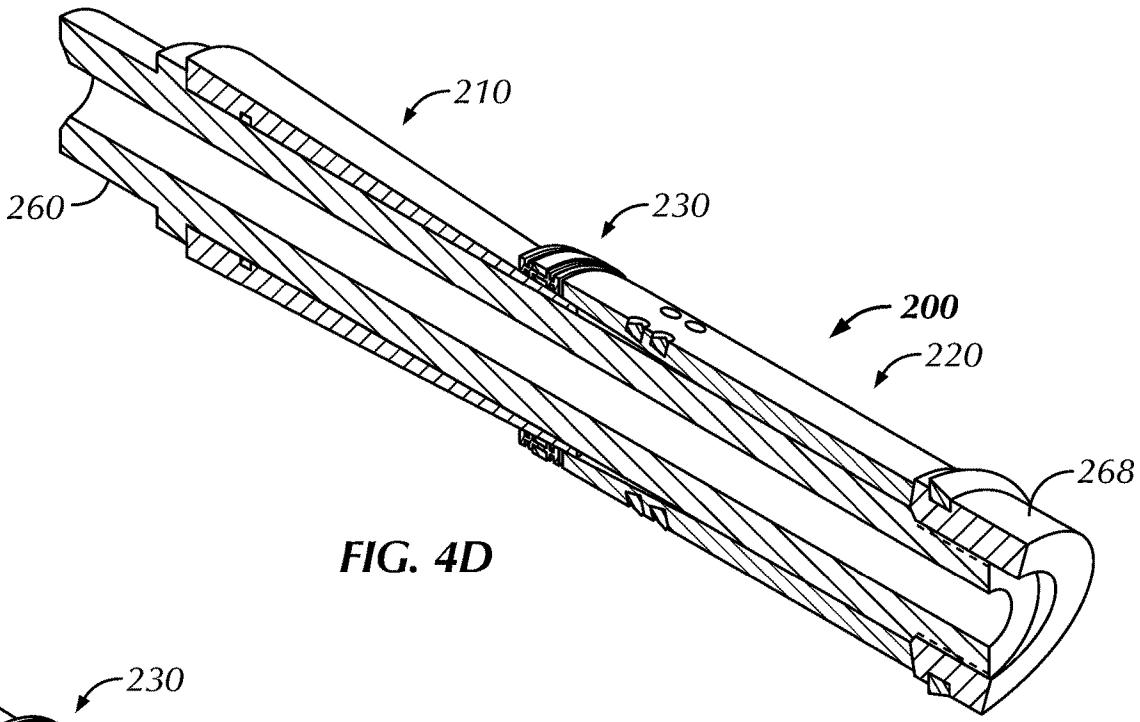
FIGS. 4D-4E illustrate perspective views of the fourth self-removing plug in cross-section and in full.
Figure 4E:
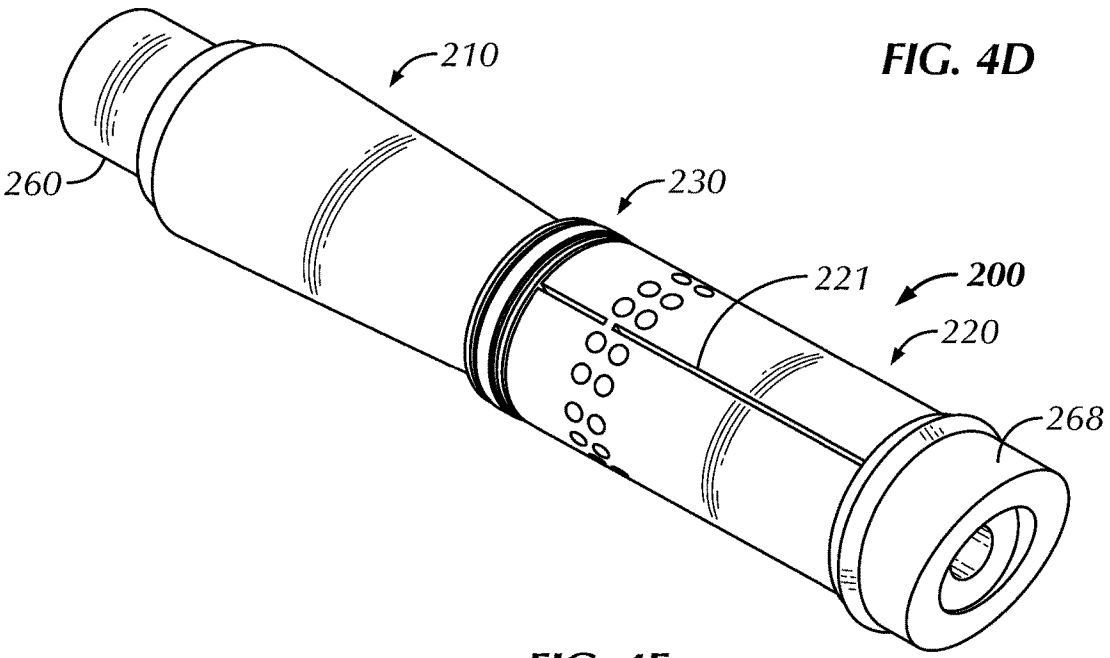

FIGS. 4A-4C illustrate cross-sectional views of a fourth self-removing plug 200 with a mandrel 260 according to the present disclosure during stages of setting in tubing, and FIGS. 4D-4E illustrate perspective views of the fourth self-removing plug 200 in cross-section and in full. This plug 200 is similar to that disclosed above with reference to FIGS. 3A-3E so that like reference numerals are used for similar components. In contrast to the previous embodiment, this plug 200 includes the mandrel 260 that remains with the plug 100 after setting.

With this plug 200, the permanent mandrel 260 is attached to the inner setting tool 24 of the running tool 20 with a temporary connection, such as a shearable or releasable thread 264. With the setting forces, the running tool 20 shears free of the permanent mandrel 260 which remains as part of the plug 200. In other differences, the plug 200 includes one or more seals on the ring components and the mandrel 260 to prevent fluid bypass. For example, the inside of the wedge body 210 can have an O-ring seal 213 on its inner diameter to seal against the mandrel 260.

Figure 5A:
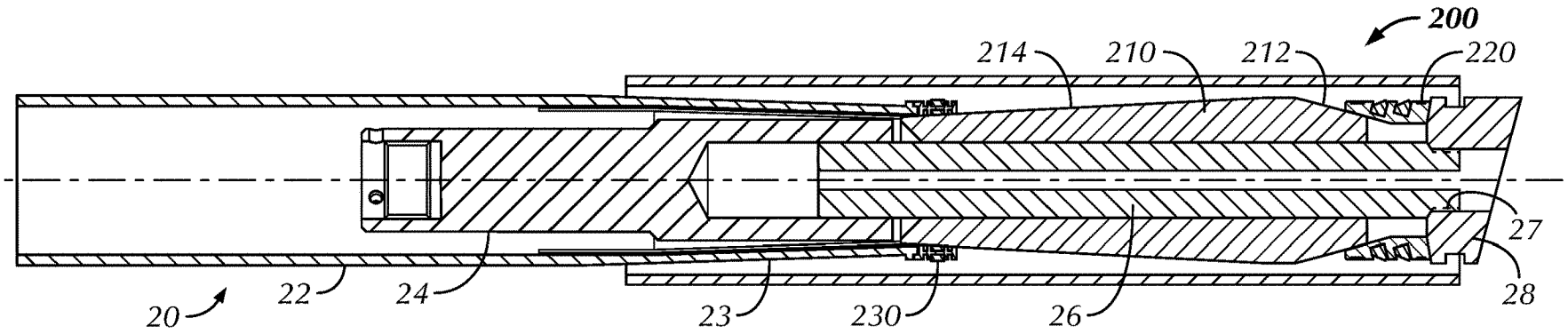
FIGS. 5A-5C illustrate cross-sectional views of a fifth self-removing plug according to the present disclosure during stages of setting in tubing.
Figure 5B:
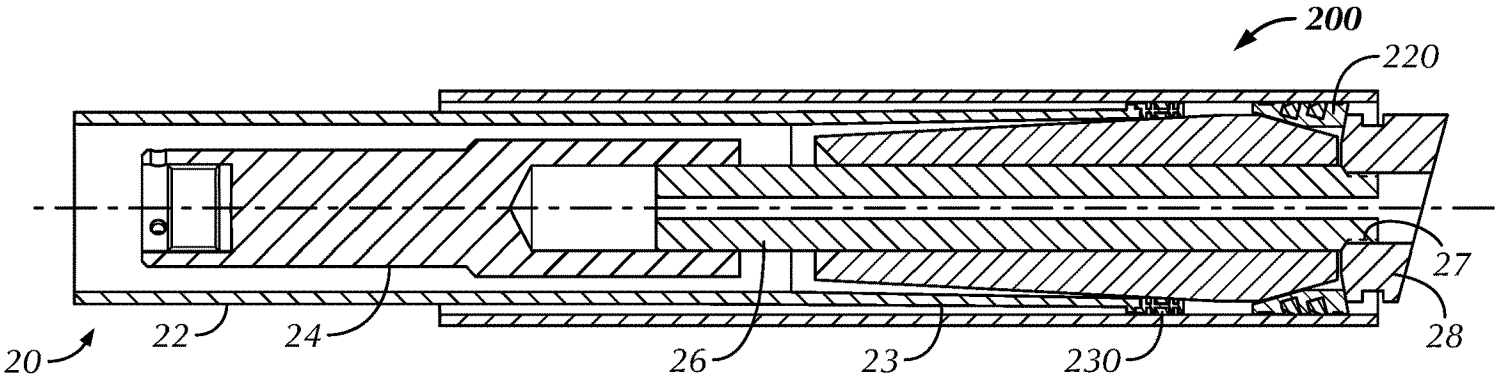
Figure 5C:
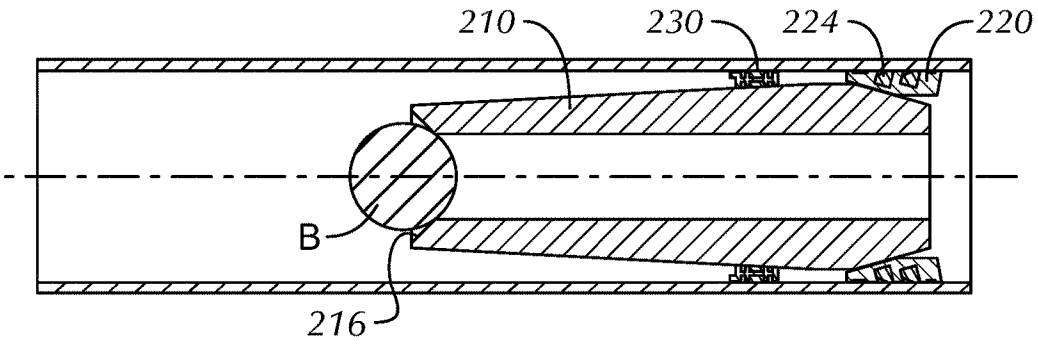
Figure 5D:
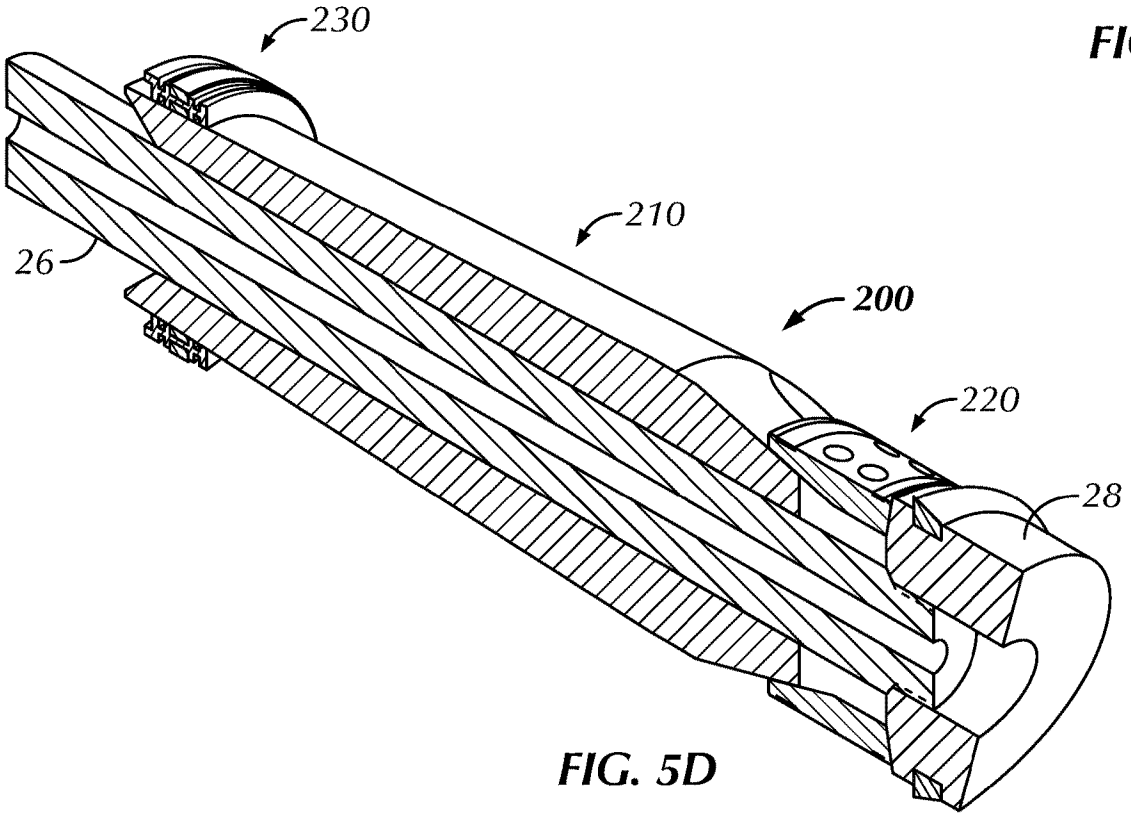
FIGS. 5D-5F illustrate perspective views of the fifth self-removing plug in cross-section and in full.
Figure 5E:
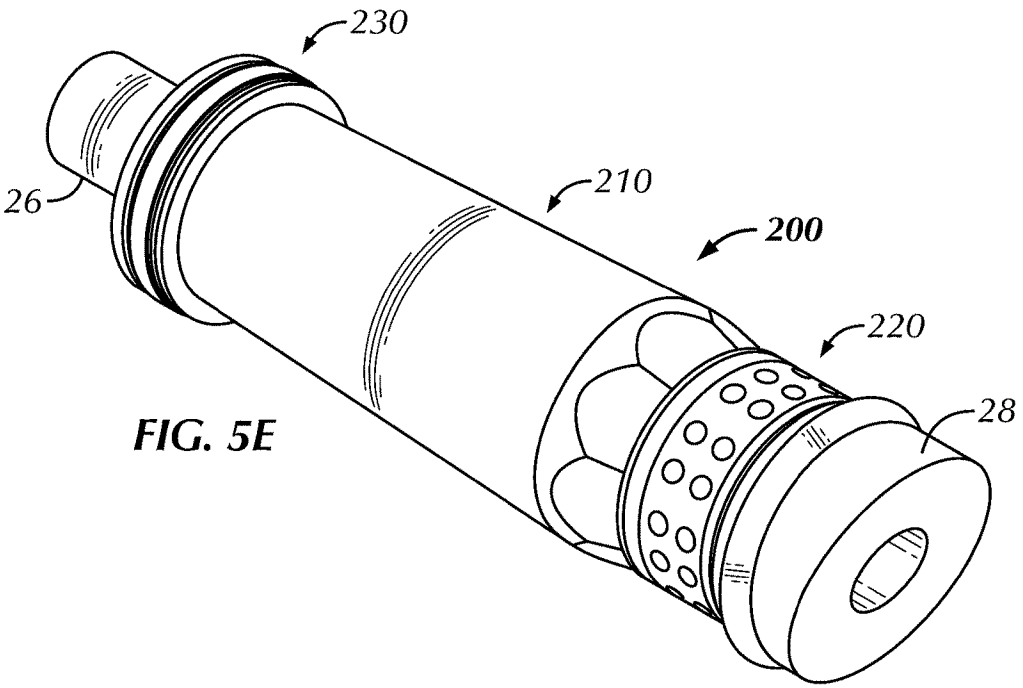
Figure 5F:
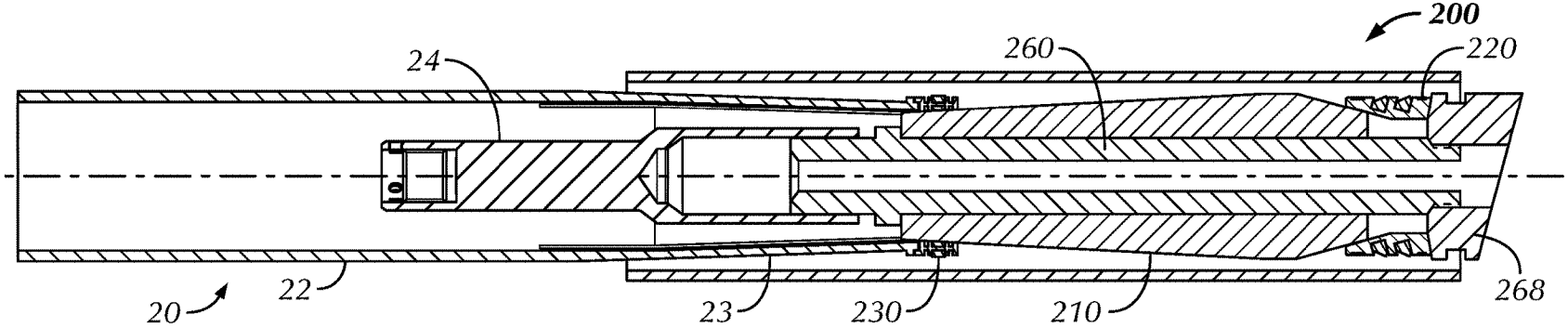

FIGS. 5A-5C illustrate cross-sectional views of a fifth self-removing plug 200 according to the present disclosure during stages of setting in tubing, and FIGS. 5D-5E illustrate perspective views of the fifth self-removing plug 200 in cross-section and in full. This plug 200 is similar to that disclosed above with reference to FIGS. 3A-3E so that like reference numerals are used for similar components. In contrast to the previous embodiment, the seal element or swage seal 230 is placed on an opposing incline 214 than the incline 212 for the slip body 220.

Additionally, setting procedures use a different setting tool 20 because the swage seal 230 is moved separately on the wedge body 210. In particular, the swage seal 230 is initially installed on the proximal end of the wedge body 210 near the connection of the setting tool 20. The setting sleeve 22 of the tool 20 has a collet 23 that engages the swage seal 230 to force the seal 230 along the incline 214 and to expand during this process.

It will be apparent based on the teachings of FIGS. 3A through 5E that yet an additional embodiment of the present disclosure can use the components of the plug 200 in FIGS. 5A-5E with a permanent mandrel 260 as disclosed in the examples of FIGS. 4A-4E. Such an arrangement is briefly shown in FIG. 5F.

Figure 6A:
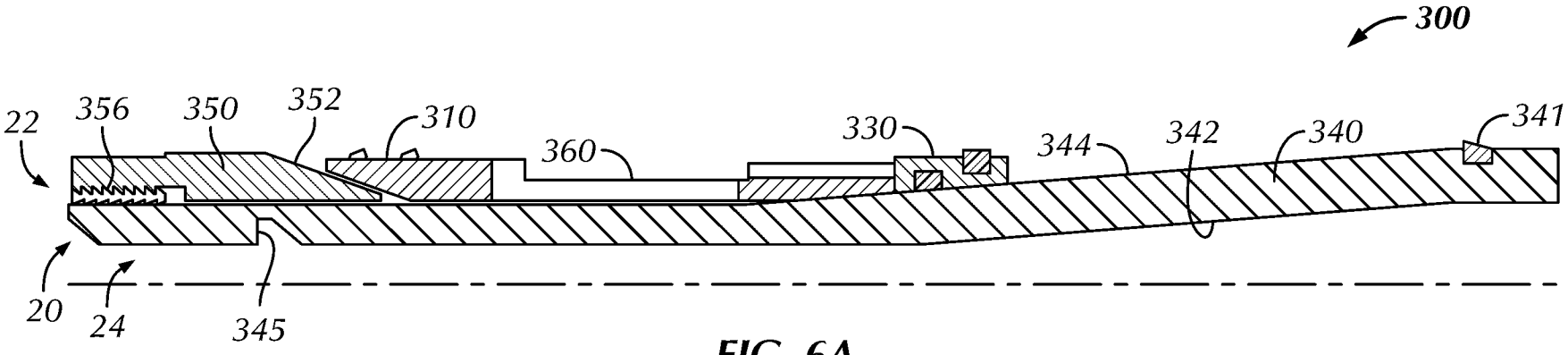
FIGS. 6A-6B illustrate cross-sectional views of a sixth self-removing plug according to the present disclosure during stages of setting in tubing.
Figure 6B:
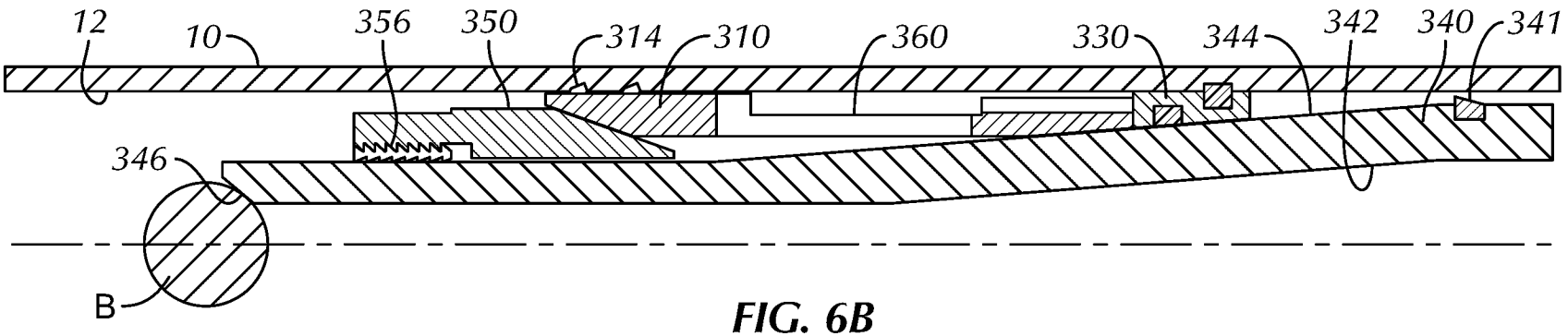

FIGS. 6A-6B illustrate cross-sectional views of a sixth self-removing plug 300 according to the present disclosure during stages of setting in tubing. The plug 300 includes a housing or mandrel 340 that defines a bore 342 therethrough. A distal end of the housing 300 can have a pump-down ring 341. A seal element or swage seal 330 is disposed about the housing 340 near an external incline 344, and a slip 310 disposed about the housing 340 fits against the swage seal 330 with a setting ring 360. The slip 310 can include a continuous ring with separable division or can include several segments (not shown) held about the housing 340 with bands (not shown), although other configurations are possible.

A cone 350 disposed about the housing 340 at its proximal end has an incline 352 for engaging the slip 310. A body lock ring 356 or other ratchet mechanism can control the movement of the cone 350 along the outside of the housing 340 during setting.

A setting tool (20) can run the plug 300 downhole. A lock profile 345 inside the housing's bore 342 may be provided for engagement by a key of an inner tool (24). Meanwhile, the setting tool (20) can have an outer sleeve (22) engaging the cone 350 so that the cone 350 can be pushed further onto the housing 340. In this process, the cone 350 wedges the slip 310 outward to the casing 10 so that the inserts 314 bite into the casing's wall 12.

While the cone 350 is moved, the body lock ring 356 prevents reverse movement along the housing 340. The slip 310 connected by the setting ring 360 pushes the swage seal 330 along the incline 344 so that the swage seal 330 eventually wedges and seals against the casing wall 12. To prevent over wedging of the components, the setting ring 360 may be frangible and configured to break at a predetermined load. Additionally, the lock profile 345 on the housing 340 can be configured to fail at a tensile load for setting so the setting tool (20) can be released from the plug 300. This can leave a seating area 346 for engagement of a dropped ball B during later treatment steps.

Figure 7A:
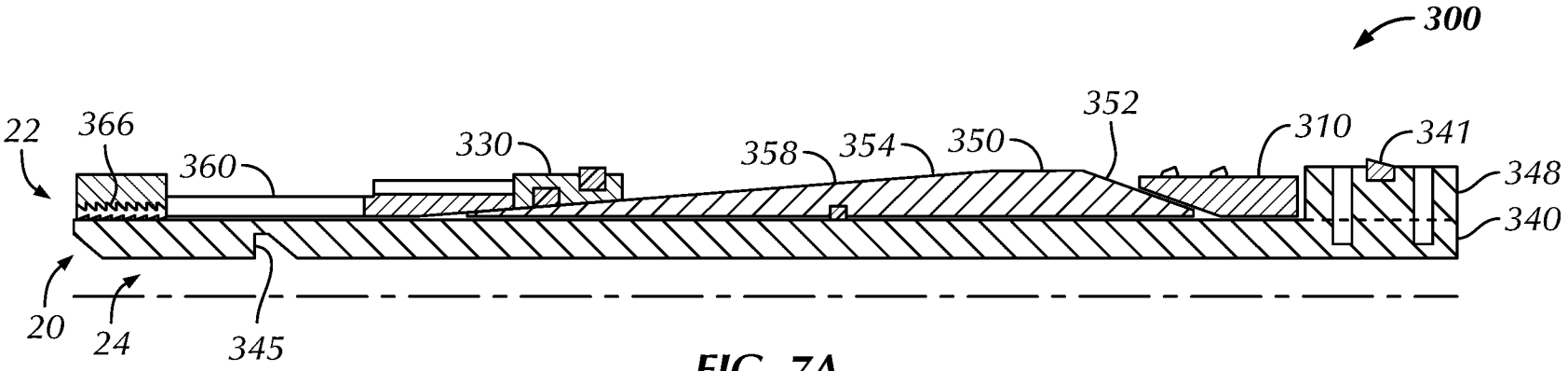
FIGS. 7A-7B illustrate cross-sectional views of a seventh self-removing plug according to the present disclosure during stages of setting in tubing.
Figure 7B:
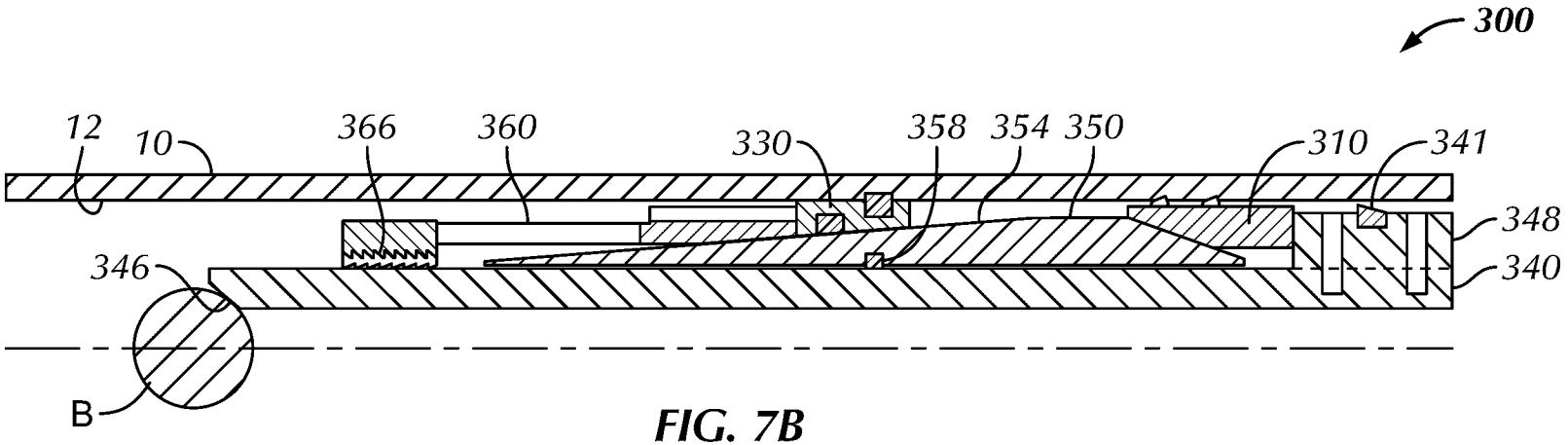

FIGS. 7A-7B illustrate cross-sectional views of a seventh self-removing plug 300 according to the present disclosure during stages of setting in tubing. This plug 300 is similar to that disclosed above with reference to FIGS. 6A-6B so that like reference numerals are used for similar components. In contrast to the previous embodiment, the seal element or swage seal 330 is placed on an opposing incline 354 of the cone 350 than the incline 352 for the slip 310.

As before, the plug 300 includes a housing or mandrel 340 that defines a bore 342 therethrough. A distal end of the housing 300 can have an end ring 348 with a pump-down ring 341 disposed around it. The swage seal 330 is disposed about the cone 350 near the upper incline 354 of the cone 350, while the slip 310 is disposed near the lower incline 352 to fit against the end ring 348.

A setting ring 360 is disposed on the housing 340 and abuts against the swage seal 330. A body lock ring 356 or other ratchet mechanism on the setting ring 360 can control the movement of the ring 360 along the outside of the housing 340 during setting.

A setting tool (20) can run the plug 300 downhole. A lock profile 345 inside the housing's bore 342 may be provided for engagement by a key of an inner tool (24). Meanwhile, the setting tool (20) can have an outer sleeve (22) engaging the setting ring 360 so that the ring 360 can be pushed further onto the housing 340. Abutting the setting ring 360, the swage seal 330 is moved along the incline 354 so that the swage seal 330 eventually wedges and seals against the casing wall 12. To prevent over wedging of the components, the setting ring 360 may be frangible and configured to break at a predetermined load.

During these setting steps, the cone 350 can move along the housing 340 and can wedge the slip 310 with the cone's incline 352 outward to the casing 10 so that the inserts 314 bite into the casing's wall 12. One more seals 358 can be provided between the cone 350 and the housing 340 to seal their interface. Also, the key profile 345 on the housing 340 can be configured to fail at a tensile load for setting to release the setting tool (20) from the plug 300. This can leave a seating area 346 for engagement of a dropped ball B during later treatment steps.

Figure 8A:
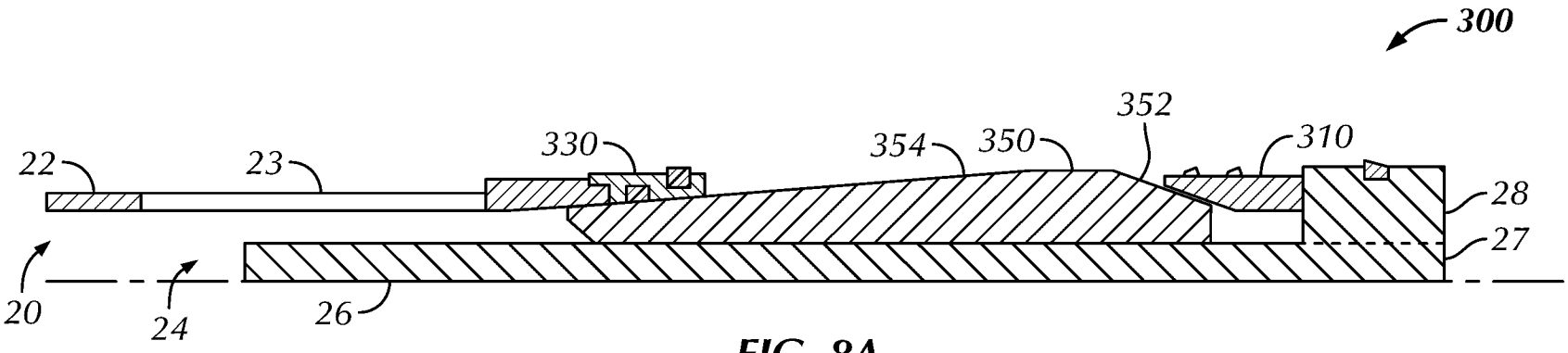
FIGS. 8A-8B illustrate cross-sectional views of an eighth self-removing plug according to the present disclosure during stages of setting in tubing.
Figure 8B:
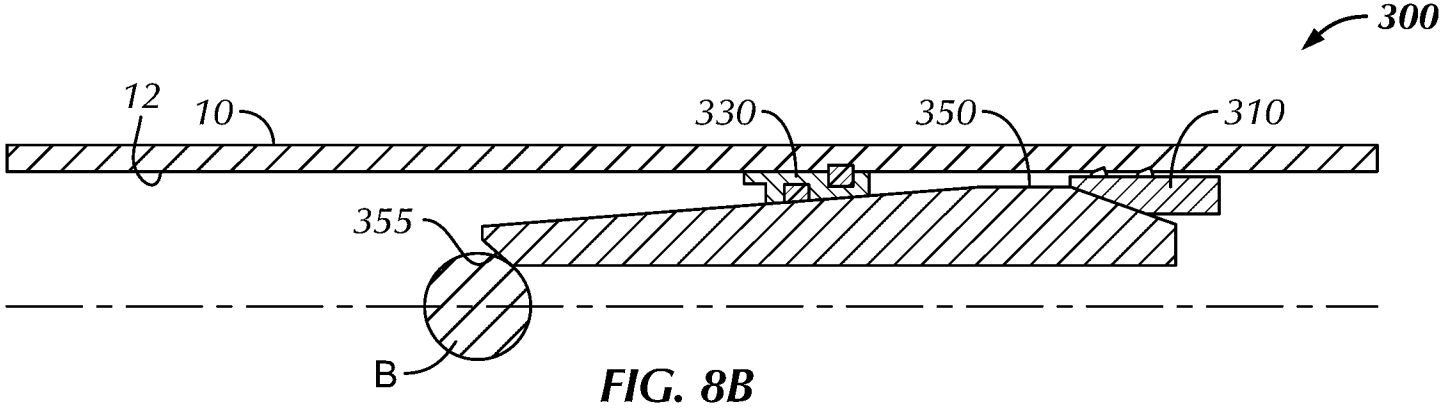

FIGS. 8A-8B illustrate cross-sectional views of an eighth self-removing plug 300 according to the present disclosure during stages of setting in tubing. This plug 300 is similar to that disclosed above with reference to FIGS. 7A-7B so that like reference numerals are used for similar components. In contrast to the previous embodiment, this plug 300 lacks separate housing/mandrel and cone component, and this plug 300 is set using a temporary mandrel 26 and mule shoe 28.

The plug 300 includes a cone 350 (which is a combined mandrel/housing and cone component) disposed on the setting tool's mandrel 26, which can have a pump-down ring 341 on the mule shoe 28. A seal element or swage seal 330 is disposed about the cone 330 near an upper incline 354 of the cone 350, while a slip 310 is disposed near a lower incline 352 to fit against the mule shoe 28.

A setting tool (20) to run the plug 300 downhole has a sleeve 22 with a collet 23 engaging the swage seal 330 so that the swage seal 330 can be pushed further onto the cone's incline 354. During these setting steps, the cone 350 can move along the tool's mandrel 26 and can wedge the slip 310 with the cone's incline 352 outward to the casing 10 so that the inserts 314 bite into the casing's wall 12.

Eventually, a breakable connection, such as shear threading 27 between the mandrel 26 and mule shoe 28, can break free and allow the setting tool 20 and the mandrel 26 to be removed. As shown in FIG. 6B, a ball or other plugging element B can be deployed downhole to the cone 350 to seat in a seating area 355 so that treatment operations can commence.

Figure 9A:
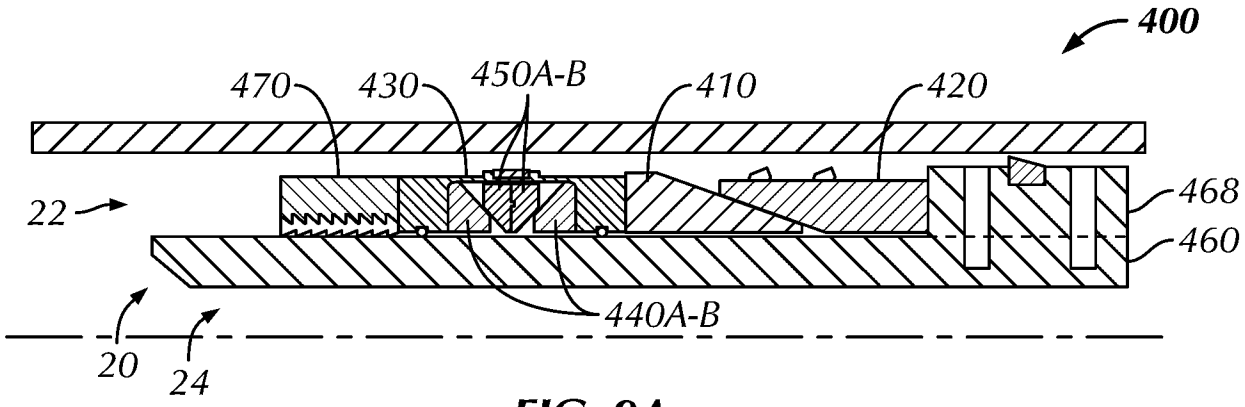
FIGS. 9A-9B illustrate cross-sectional views of a ninth self-removing plug according to the present disclosure during stages of setting in tubing.
Figure 9B:
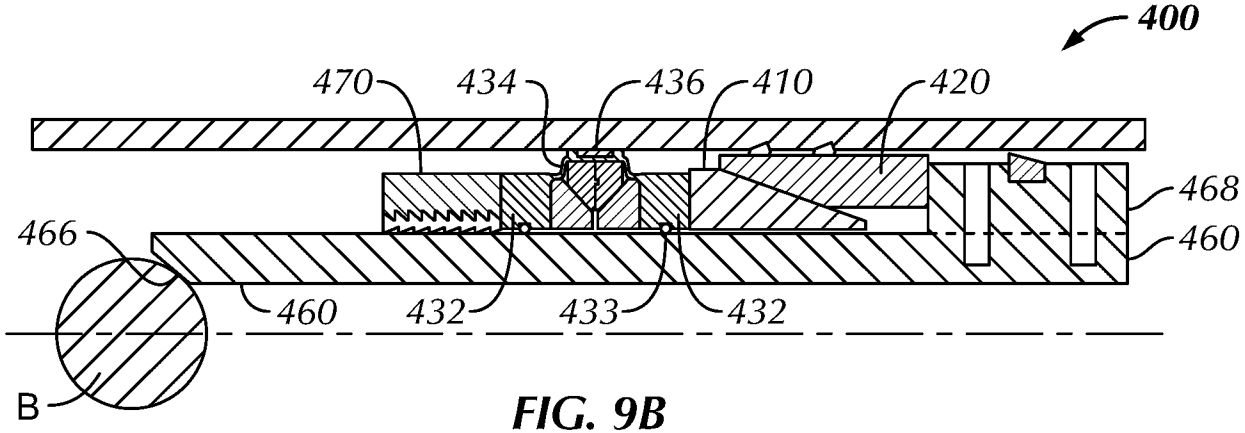

FIGS. 9A-9B illustrate cross-sectional views of a ninth self-removing plug 400 according to the present disclosure during stages of setting in tubing. The plug 400 includes a cone 410, a slip 420, and a seal element (having a sealing sleeve 430, body rings 440A-B, expansion element or rings 450A-B). The plug 400 also includes a mandrel 460, which is intended to remain with the plug 400 once set. Each of these components can be composed of a dissolvable metal, such as disclosed herein, and can have similarities to like components disclosed in previous embodiments.

For run in, a running tool (20) having a setting sleeve (22) and an inner tool (24). The mandrel 460 of the plug 400 connects to the inner tool (24) with a temporary connection, while the setting sleeve (22) abuts against a body lock ring 470 on the mandrel 460.

The cone 410 of the plug 400 has an incline 412 against which the slips 420 can wedge. The other end of the slip 420 abuts against the end ring 468 of the mandrel 460. The sealing sleeve 430 has lips 432 of increased thickness and width that fit around the mandrel 460 like rings, and one of these lips 432 abuts against the cone 410. A thin sheath 434 of the dissolvable material of the setting sleeve 430 extends between these lips 432, which act as anchors for the thin sheath 434 as it runs along the outside of the plug 400. Disposed within this sheath 434 around the mandrel 460, the plug 400 has its body rings 440A-B and expansion rings 450A-B. The body rings 440A-B sandwich the expansion rings 450A-B, and each abutting corner of these rings 440, 450 can have angled edges. As shown, the expansion element 450A-B is preferably two adjacent split C-rings that can slide relative to one another as they expand outward. The splits (not shown) in these rings 450A-C are misaligned so that the two split rings 450A-B together form a complete ring.

During run-in as shown in FIG. 9A, the plug 400 is held on the setting tool (20), and the external components remain uncompressed on the mandrel 460. The running tool (20) is coupled to an actuator (not shown) used for activating the setting tool (20) and setting the plug 400. During activation, the setting sleeve (22) pushes against the body lock ring 470, while the inner setting tool (24) pulls the run-in mandrel (26) in the opposite direction. As a result, the mule shoe 468 on the mandrel 460 can concurrently push the end ring 468 against the components of the plug 400 to compress them.

As shown in FIG. 9B, the body lock ring 470 moves along the mandrel 460. The slip 420 is pushed up the incline 412 and wedged against the inside wall 12 of the casing 10. At the same time, the body rings 440A-B are brought together, and the expansion rings 450A-B are forced outward toward the surrounding casing 10. The sheath 434 bulges outward by being deformed by the expansion ring 450A-B and forms a metal-to-metal seal with the inner casing wall 12.

Eventually, the setting force shears the mandrel 460 free from the inner tool (24) so that the setting tool (20) is released from the plug 400, which is now set in the casing 10. The setting tool (20) can be retracted from the casing 10. The plug 400 is now ready for use. As shown in FIG. 9B, a ball B or the like can be deployed to the plug 400 to seat against the seating surface 466 of the mandrel 460. Pressure for a fracture treatment can be applied against the plug 400 with the seated ball B, which prevents the treatment from passing to zones further downhole.

The sheath 434 can be an annealed ring of thin walled material. A rubber or metallic element 436 can be bonded or attached on the outside of the sheath 434 to enhance sealing. Seals 433 can be provided on the lips 432 to seal against the mandrel 460.

Figures 1, 10A:
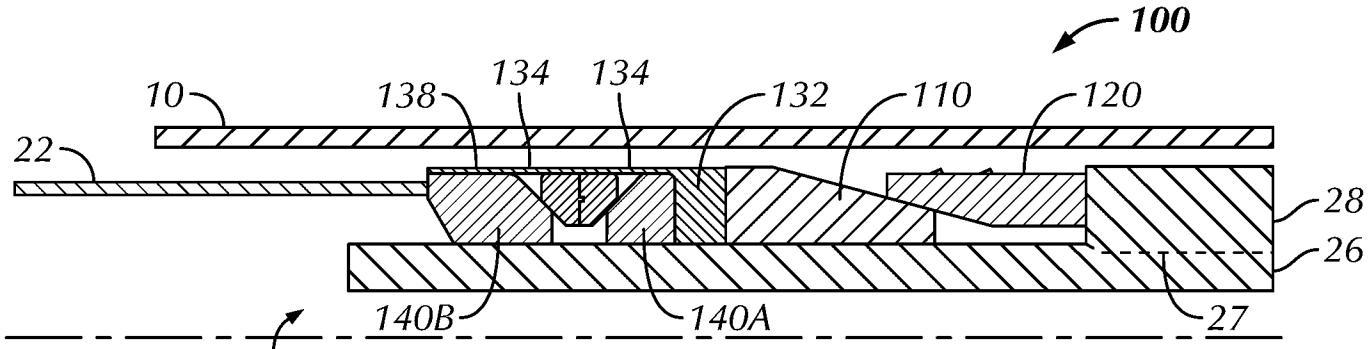
Figures 2, 10A:
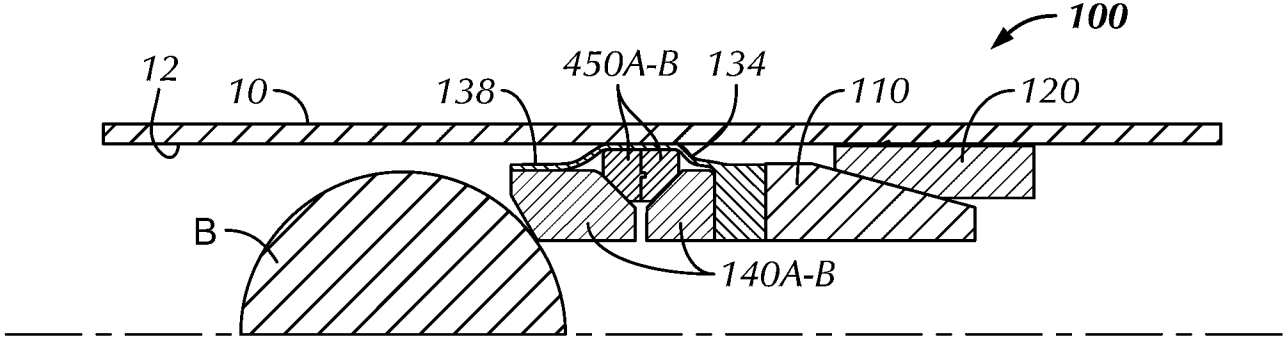
Figure 10B:
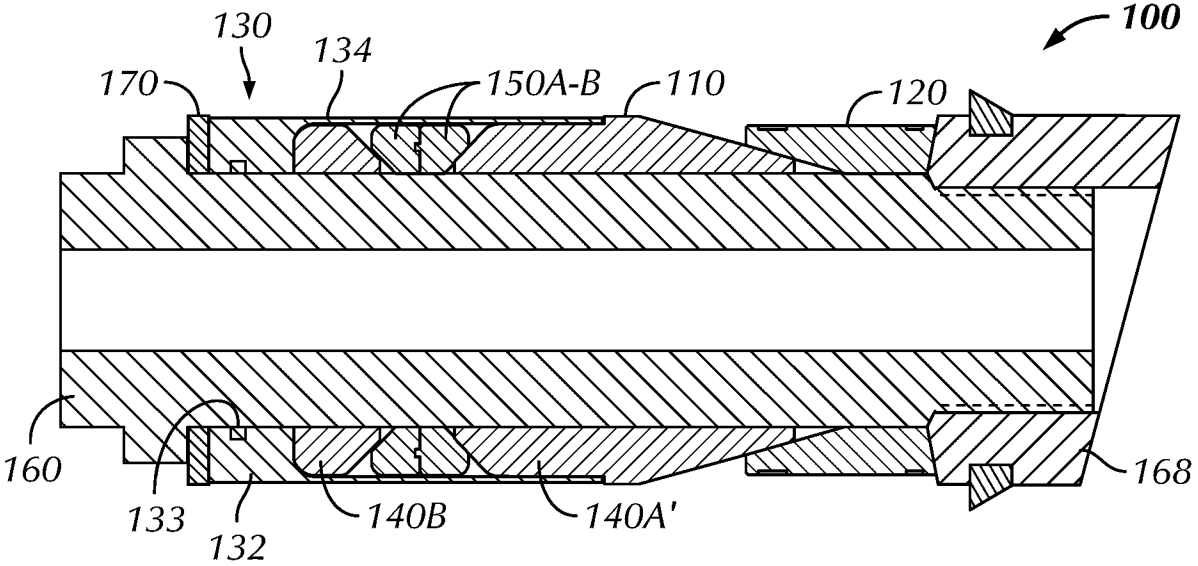

FIGS. 10A-10B illustrate cross-sectional views of a tenth self-removing plug 100 according to the present disclosure during stages of setting in tubing. The plug 100 in FIG. 10A is similar to that disclosed above with reference to FIGS. 1A-1D so that like reference numerals are used for similar components. For the plug 100 of FIG. 10A, the end of the sheath 130 can be attached to one of the body rings 140B with an electron beam or laser weld 138. The plug 100 in FIG. 10B is a reverse configuration of the first self-removing plug 100 of FIGS. 2A-2E. The lip 132 of the sheath 130 rests against a push ring 170 at the proximal end of the plug's housing 160. The cone 110 incorporates at one end 140A' features of a body ring.

Figure 11A:
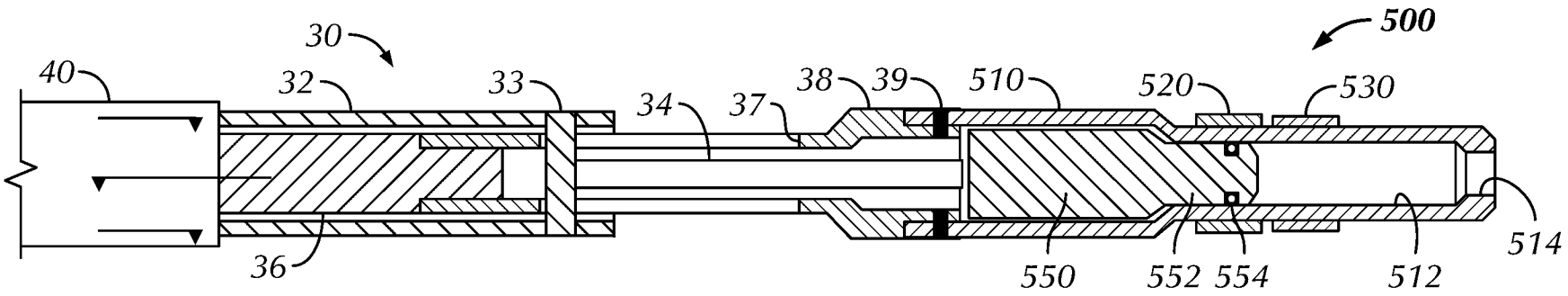
FIGS. 11A-11B illustrate cross-sectional views of an eleventh self-removing plug according to the present disclosure during stages of setting in tubing.
Figure 11B:
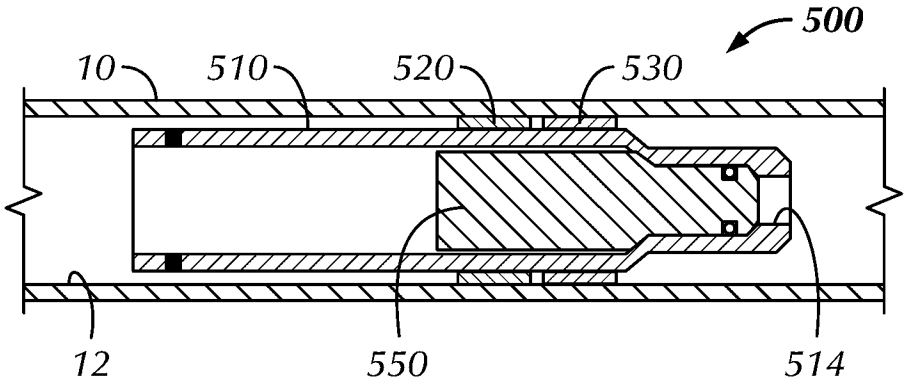

FIGS. 11A-11B illustrate cross-sectional views of an eleventh self-removing plug 500 according to the present disclosure during stages of setting in tubing 10. The plug 500 includes an external body or mandrel 510 and an internal plug element or cone 550. The external body or mandrel 510 is an expandable sleeve, while the plug element or cone 550 is an expansion cone or head to be left inside the external body 510. Both the body 510 and plug element 550 can be composed of a dissolvable material, as disclosed herein, and they can be composed of the same or different material. The exterior of the body 510 has a sealing element 520 and an anchor element or slip 530. The sealing element 520 can be composed of elastomer, metal, or the like that is disposed, bonded, or affixed about the exterior of the body 510. The anchor element or slip 530 can include slip members, carbide inserts, gripping material, etc. attached about the exterior of the body 510. A seal 554 on the nose 552 of the plug element 550 can be composed of elastomer or the like.

A setting tool 30 couples to the plug 500 and is used for running and setting the plug 500 downhole in casing 10. The setting tool 30 includes a push rod 34 with a distal end engaged against the plug element 550. A pull rod 36 connects to a pull sleeve 38, and shearable connections 39 connect the pull sleeve 38 to the plug's body 510. A crosslink 33 connected to the proximal end of the push rod 34 rides in slots 37 of the pull sleeve 38 and connects to a push sleeve 32 of the setting tool 30.

The pull rod 36 and push sleeve 32 connect to an actuator 40 of the setting tool 30, which can pull the rod 36 and push the sleeve 32 relative to one another. During this activation, the plug element 550 is forced through the inner passage 512 of the body 510, causing the body 510 to expand outward toward the surrounding casing 10. The plug element 550 is pushed into the narrower end of the body 510 at least until the sealing element 520 and anchor element 530 engage the surrounding casing wall 12, as shown in FIG. 11B. The nose 552 of the plug element 550 eventually seals inside the narrow tip (or end shoulder) of the body 510, which has an opening 514 through which excess fluid can escape.

The plug element 550 can be fitted with a body lock ring, a snap ring, or other retainer (not shown) to prevent the pushed plug element 510 from being forced out of the body 510 in the opposite direction. This may allow the deployed plug 500 to seal the casing 10 as a bridge plug, preventing fluid flow in both uphole and downhole directions. After setting and use, the components of the plug 500 can dissolve in the manner disclosed herein to remove the fluid isolation.

Figure 12A:
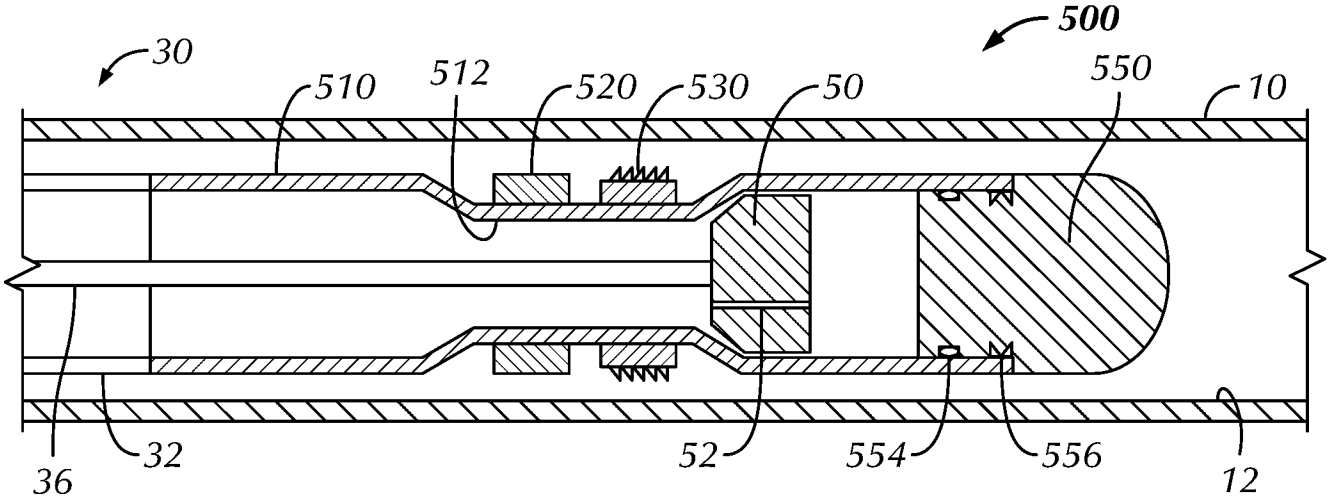
FIGS. 12A-12B illustrate cross-sectional views of a twelfth self-removing plug according to the present disclosure during stages of setting in tubing.
Figure 12B:
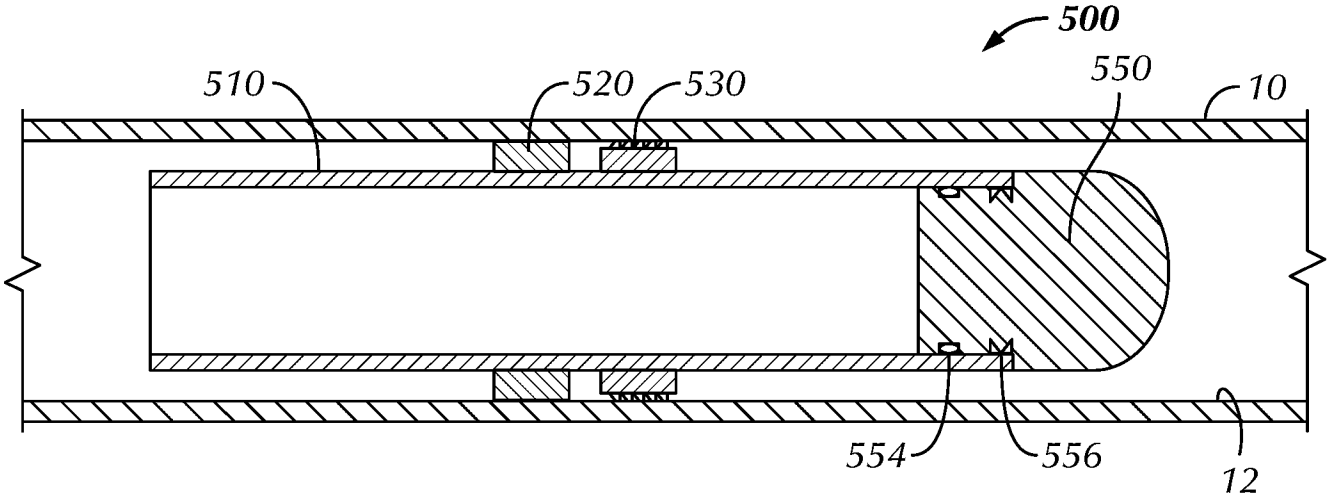

FIGS. 12A-12B illustrate cross-sectional views of a twelfth self-removing plug 500 according to the present disclosure during stages of setting in tubing 10. This plug 500 is similar to that disclosed above in FIGS. 11A-11B so that like reference numerals can be used for similar components. In contrast to the previous embodiment, this plug 500 is expanded through a pulling action.

The plug 500 includes an external body or mandrel 510 and a plug element or end shoulder 550. Both the external body or mandrel 510 and the plug element or end shoulder 550 can be composed of a dissolvable material, as disclosed herein, and they can be composed of the same or different material. The plug element 550 is attached to the body 510 using thread, pins, drive wire, etc. or other fastener 556. A seal 554 on the nose of the plug element 550 can be composed of elastomer or the like.

The exterior of the body 510 has a sealing element 520 and an anchor element or slip 530. The sealing element 520 can be composed of elastomer, metal, or the like that is disposed, bonded, or affixed about the exterior of the body 510. The anchor element or slip 530 can include slip members, carbide inserts, gripping material, etc. attached about the exterior of the body 510.

A setting tool 30 couples to the plug 500 and is used for running and setting the plug 500 downhole in casing 10. Most setting tools use a pull rod and an outer sleeve. The pull rod is attached to the center of the tool that is being set, typically a bridge plug or packer, and the outer sleeve pushes on the outer components, such as slips, cones, and packing element. By using a cross-link device as shown in FIGS. 11A-11B, the push-pull relationship can be reversed in the setting tool 30. Therefore, the pull rod 36 is attached to the outer portions (i.e., body 510) of the plug 500, while the outer sleeve 32 is linked to a push rod 34 that acts on the center (i.e., plug element 550) of the plug 500. This action allows the setting tool 30 to force the plug element 550 made of ordinary dissolvable or non-dissolvable material to expand the body 510 of the plug 500 and actuate the external sealing element 520 and anchor element 530.

As shown, the setting tool 30 includes a pull rod 36 with a distal head or cone 50 engaged inside the body 510. A push sleeve 32 engages the external body 510 and can attach thereto by shearable connection (not shown) or the like. Instead of attaching by a shearable connection, the setting tool 30 can engage the body 510 in another fashion. The push sleeve 32 is normally part of a setting adaptor kit that features a coarse adjustment thread that allows the longitudinal position of the push sleeve 32 to be varied in a way that takes all slack out of the system, and permits the full useful travel of the setting tool 30 to come into play. In this design, the push sleeve 32 is adjusted until the lower portion of inner passage 512 is firmly up against the upward-facing expansion face of the distal head 50. This would effectively secure the plug 500 in place until it was expanded.

The distal head or cone 50 has a clearance fit with the inside dimension of the body 510 above and below the inner passage 512. Once the distal head 50 has passed through the inner passage 512, engaging both the sealing element 520 and the anchor element 530, the distal head or cone 50 will pass into the upper portion of the body 510, where it is free to be retrieved from the well.

The pull rod 36 and push sleeve 32 connect to an actuator (not shown) of the setting tool 30, which can pull the rod 36 and push the sleeve 32 relative to one another. During this activation, the expansion head or cone 50 is forced through the inner passage 512 of the body 510, causing the body 510 to expand outward toward the surrounding casing 10. The head 50 is pulled through the narrower portion of the body 510 so that the sealing element 520 and anchor element 530 engage the surrounding casing wall 12, as shown in FIG. 12B. The head 50 can have a bypass 52 therethrough to facilitate the pulling of the head 50 against any trapped volume behind the head 50.

Meanwhile, the plug element or end shoulder 550 can seal the body's passage 512 in both uphole and downhole directions and allow the plug 500 to act as a bridge plug. As an alternative, the plug element 550 can include a one-way valve (La, ball and seat) so that flow can be allowed from downhole to uphole, but prevented from uphole to downhole. After setting and use, the components of the plug 500 can dissolve in the manner disclosed herein to remove the fluid isolation.

As shown, the plug 500 of FIGS. 12A-12B has a body 510 and plug element 550 that are separate components. This can facilitate assembly, but may not be necessary. Instead, the body 510 and plug element 550 can be formed as one unit of dissolvable material. Because the inner passage 512 of the body 510 has a narrow portion, the head 50 of the setting tool 30 can be an assembleable cone that installs inside the body 510. Such a cone for the head 50 can use interlocking segments, collet with supportive core, or other type of assembly.

Figure 13A:
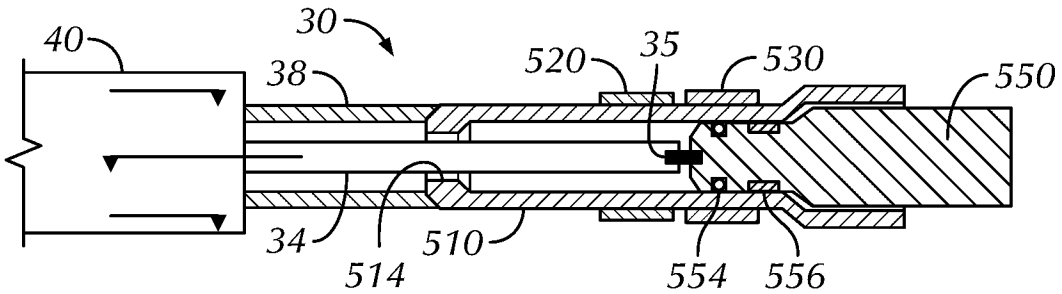
FIGS. 13A-13B illustrate cross-sectional views of a thirteenth self-removing plug according to the present disclosure during stages of setting in tubing.
Figure 13B:
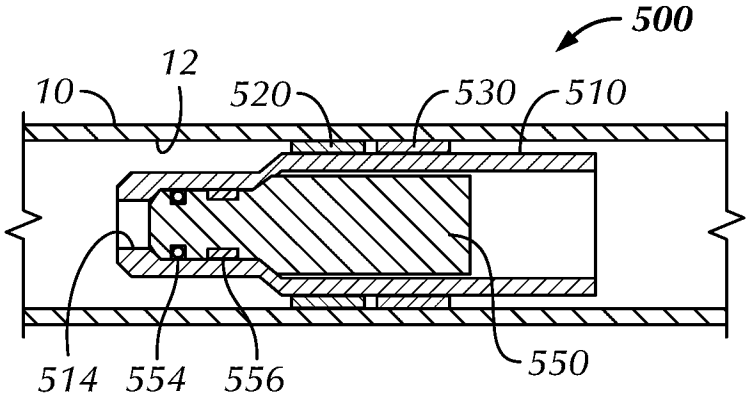

FIGS. 13A-13B illustrate cross-sectional views of a thirteenth self-removing plug 500 according to the present disclosure during stages of setting in tubing 10. The plug 500 is a reverse arrangement of the plug in FIGS. 11A-11B. The plug 500 includes an external body or mandrel 510 and an internal plug element or cone 550. Both the body 510 and plug element 550 can be composed of a dissolvable material, as disclosed herein, and they can be composed of the same or different material. The exterior of the body 510 has a sealing element 520 and an anchor element or slip 530. The sealing element 520 can be composed of elastomer, metal, or the like that is disposed, bonded, or affixed about the exterior of the body 510. The anchor element or slip 530 can include slip members, carbide inserts, gripping material, etc. attached about the exterior of the body 510. A seal 554 on the nose 552 of the plug element or cone 550 can be composed of elastomer or the like.

A setting tool 30 couples to the plug 500 and is used for running and setting the plug 500 downhole in casing 10. The setting tool 30 includes a pull rod 34 with a distal end engaged with the plug element 550 by a shear connection 35. A push sleeve 38 engages the end of the plug's body 510.

The pull rod 34 and push sleeve 38 connect to an actuator 40 of the setting tool 30, which can pull the rod 34 and push the sleeve 38 relative to one another. During this activation, the plug element 550 is forced through the inner passage 512 of the body 510, causing the body 510 to expand outward toward the surrounding casing wall 12. The plug element 550 is pulled into the narrower end of the body 510 at least until the sealing element 520 and anchor element 530 engage the surrounding casing wall 12, as shown in FIG. 13B. The nose 552 of the plug element 550 eventually seals inside the narrow head (or end shoulder) of the body 510, which has an opening 514 through which the pull rod 34 can pass. Eventually, the shear connection 35 of the pull rod 34 to the plug element 550 breaks free so that the setting tool 30 can be removed from the plug 500.

The plug element 550 can be fitted with a body lock ring, a snap ring, or other retainer 556 to prevent the pulled plug element 510 from being forced out of the body 510 in the opposite direction. This allows the deployed plug 500 to seal the casing 10 as a bridge plug, preventing fluid flow in both uphole and downhole directions. After setting and use, the components of the plug 500 can dissolve in the manner disclosed herein to remove the fluid isolation.

The expandable plugs 500 disclosed herein such as in FIGS. 11A through 13B can be set conventionally on either an electric line, a hydraulic setting tool, or the like. The plugs 500 may be either dissolvable or non-dissolvable. As can be seen in the above embodiments of FIGS. 11A-11B and 13A-13B in particular, the core (i.e., the plug element 550) of the plugs 500 remains behind and is firmly underneath the external sealing element 520 and anchor element 530, backing them up in the expanded position. This means that the plug 500 is not expected to be effected by collapse pressure because the plug 500 is solid and the sealing and anchor elements 520 and 530 are solidly backed up. The squeeze on the sealing element 520 will be maintained, and the anchor element 530 will remain solidly engaged. As mentioned, the plug element 550 may be fitted with a lock ring, snap ring, or some other anti-return device that solidly links the body 510 and the plug element 550 together after setting travel has been achieved to allow the plug 500 to hold pressure from both directions.

In each of the above embodiments of FIGS. 11A through 13B, it is possible to vary the outside dimension of the plug element 550 to achieve different expansion ratios, depending on the weight or inside dimension of the casing 10 that the plug 500 is being expanded into. A single body 510 for the plugs 500 could be expanded into any number of weight ranges of the same size of casing, simply by changing the diameter of the plug element 550 or expander 50. In fact, the plug element 550 can be readily machined. Therefore, it could be initially made to a maximum size, corresponding to expansion in the lightest casing weight. The element 550 can then be adjusted as required by machining at the local level in the field according to operational requirements. Because the plug element 550 only has to survive one expansion, it is not necessary to use a more robust metallurgy seen in conventional expansion cones. It should also be noted that the inside dimension of the body 510 could be varied to accomplish the same thing. Finally, although the FIGS. 11A through 13B shows a plug body 510 that appears to be of uniform wall thickness, this is not strictly necessary. It may be advantageous to vary the wall thickness in certain places depending on the implementation.

In the above embodiments of FIGS. 11A-11B and 13A-13B, the shear device 39 that links the plug's body 510 to the setting tool 30 or the shear device 35 that links the plug element 550 to the setting tool 30 is selected to be stronger than the expansion force required to activate the sealing element 520 and anchor element 530. When the plug element 550 reaches an appropriate distance in the inner cavity 512 of the plug's body 510, the shear device 35, 39 will take the full load of the setting tool 30 until it breaks. At that time, the setting tool 30, leaving the plug 500 in the set position as shown in FIGS. 11B & 13B. As mentioned, the shear device 35, 39 may be pins, a shear sleeve, shear wire, or a fracture groove machined into the plug's body 510 or the plug element 550 itself, to eliminate leaving any of these components in the well. In the present case, if both the plug's body 510 and the plug element 550 are made from dissolvable material, not much will be left behind.

Figure 14A:
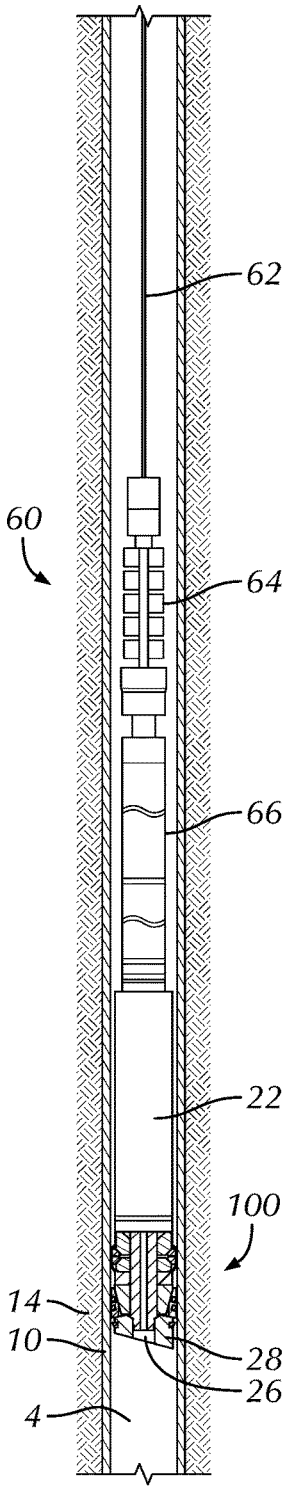
FIGS. 14A-14C illustrate steps of an example plug-and-perf operation with the disclosed self-removing plugs.
Figure 14B:
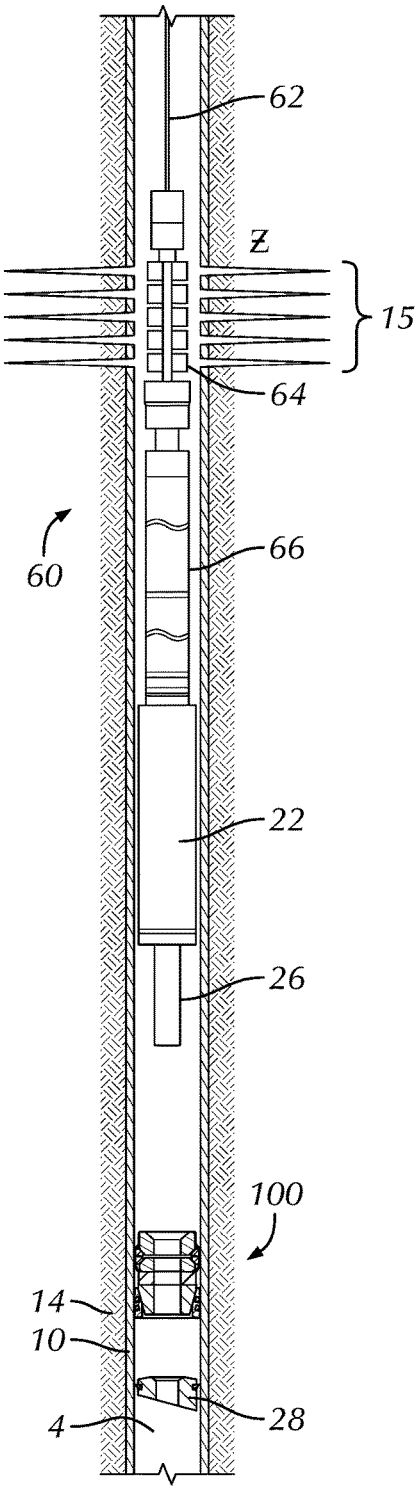
Figure 14C:
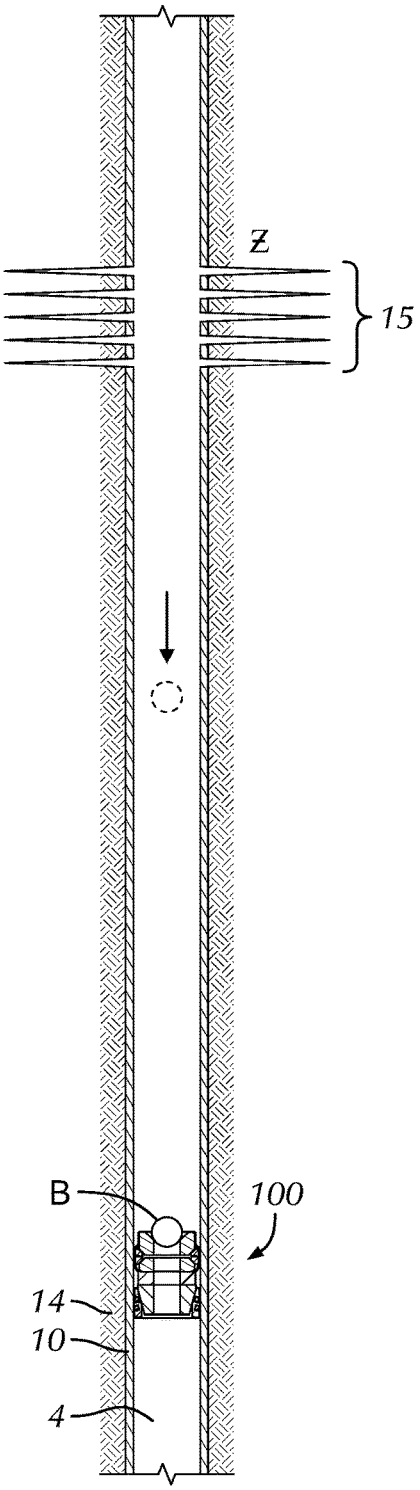

Having an understanding of at least some of the various plugs disclosed herein, discussion turns to one type of operation in which the disclosed plugs can be used. FIGS. 14A-14C illustrate an example of a plug-and-perf operation that can use the disclosed self-removing plugs. Such a plug-and-perf operation can be used for fracturing zones of a formation. An assembly 60 is deployed into the wellbore 4 using a wireline 62. Assistance may be provided from a fracture pump (not shown) that pumps displacement fluid (not shown) just before the assembly 60 has been inserted into the wellbore 4. Pumping of the displacement fluid may increase pressure in the inner casing bore. If this is the first run into the casing 10, pumping of the fluid can also create a differential sufficient to open a toe sleeve (not shown) of the inner casing string 10. Once the toe sleeve has been opened, the assembly 60 may be inserted into the wellbore 4 and continued pumping of the displacement fluid may drive the assembly 60 to a setting depth below a production zone Z. Meanwhile, the displaced fluid may be forced into a lower formation via the open toe sleeve.

Once the assembly 60 has been deployed to the setting depth, the disclosed plug 100 (shown here as that of FIGS. 1A-1D) is set by supplying a signal (e.g., electricity at a first polarity) to the assembly 60 via the wireline 62 to activate a setting tool 66. As discussed above, the setting tool 66 may use a number of different components depending on the type of plug 100 being deployed and whether the plug 100 includes a permanent mandrel or not. In this example, the setting tool 66 drives a sleeve 22 toward a mule shoe 28 while a setting mandrel 26 restrains the plug 100, thereby compressing the elements of the plug 100 into engagement with the casing 10.

As shown in FIG. 14B, a tensile force can then be exerted on the assembly 60 by pulling the wireline 62 from the surface to release the plug 100 from the assembly 60. In the present example, the mule shoe 28 can shear free of the setting mandrel 26. As the mule shoe 28 falls in the wellbore 4, the assembly 60 is then raised using the wireline 62 until the perforation guns 64 are aligned with the production zone Z. A signal (e.g., electricity at a second polarity) can then be resupplied to the assembly 60 via the wireline 62 to fire the perforation guns 64 into the casing 10, thereby forming perforations 15. Once the perforations 15 have been formed, the assembly 60 may be retrieved to a lubricator (not shown) at surface using the wireline 62. A shutoff valve at the lubricator may then be closed.

As shown in FIG. 14C, a ball B or the like may then be released from a launcher (not shown) at the surface, and fracturing fluid may be pumped into the wellbore 4. As is known, the fracturing fluid may be a slurry including: proppant (i.e., sand), water, and chemical additives. Continued pumping of the fracturing fluid may drive the ball B toward the plug 100 until the ball B lands onto the plug 100, thereby closing off fluid flow through the plug 100.

Continued pumping of the fracturing fluid may exert pressure on the seated ball B until pressure in the casing 10 increases to force the fracturing fluid (above the seated ball B) through the perforations 15 and the cement 14 and into the production zone Z to create fractures. As is known, the proppant in the fracturing fluid may be deposited into the fractures. Pumping of the fracturing fluid may continue until a desired quantity has been pumped into the production zone Z.

Once the fracturing operation of the zone Z has been completed, additional stages can be fractured by repeating the above steps further up the wellbore 4.

Figure 15:
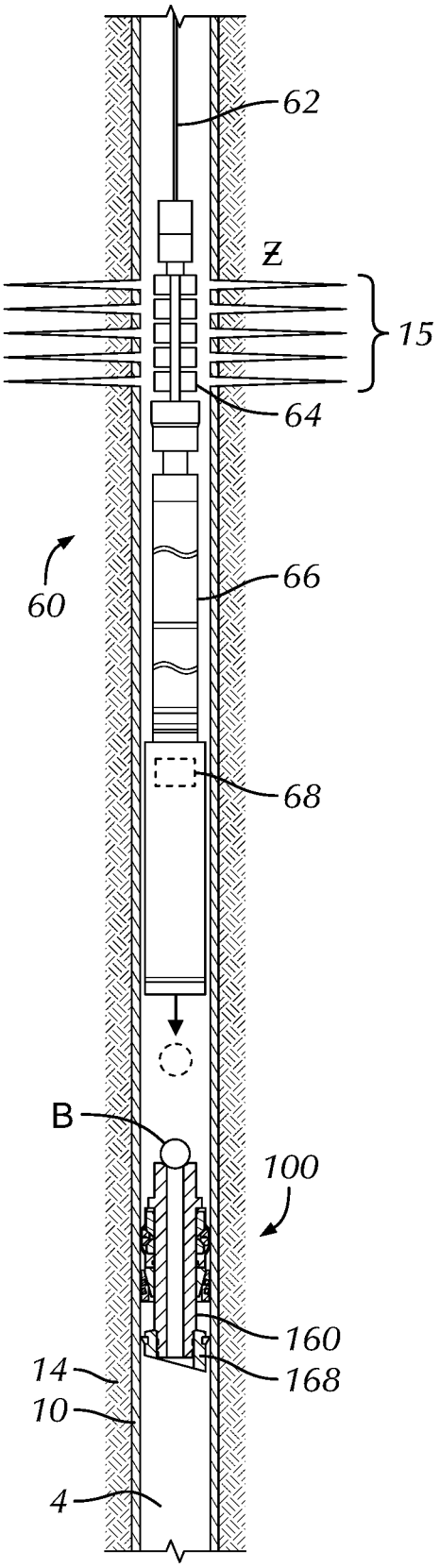
FIG. 15 illustrates a step of another example plug-and-perf operation with the disclosed plugs.

In the above arrangement, the ball B is deployed from a launcher at the surface after the assembly 60 has been removed. Other arrangements are possible. For example, FIG. 15 shows an embodiment of the assembly 60 run in hole and having a launcher 68 as part of the setting tool 66. After the plug 100 (shown here as that of FIGS. 2A-2D with a mandrel 160) is set in the casing 10, the assembly 60 is lifted, and the launcher 68 releases the ball B to land in the plug 100. Release from the launcher 68 can be triggered by a signal through the wireline 62, by release of the setting tool 66 from the plug 100, or other mechanism.

Figure 16:
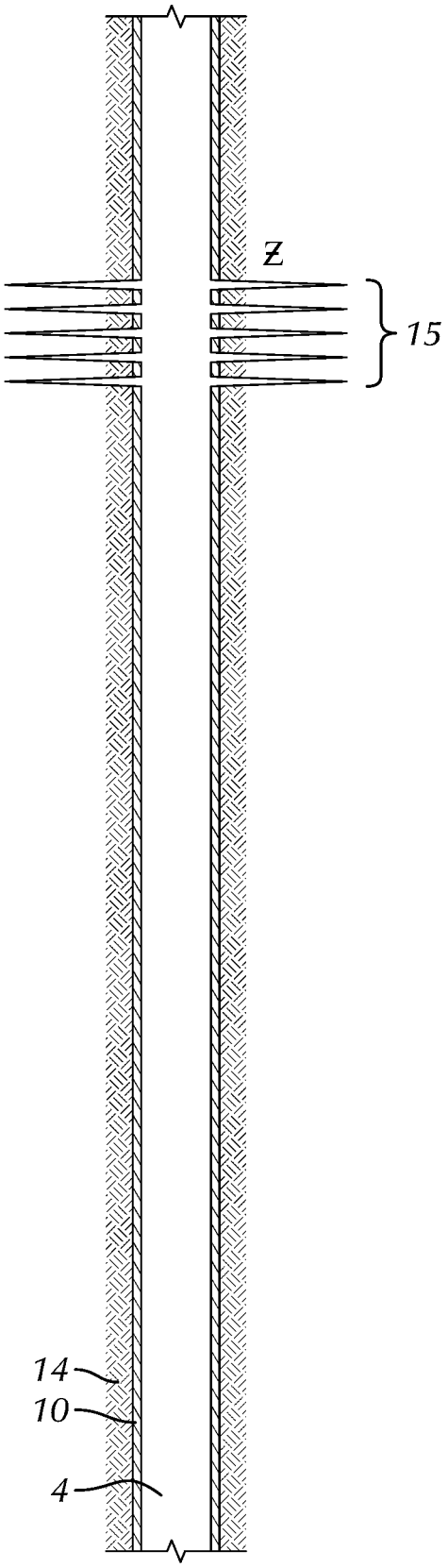
FIG. 16 illustrates the wellbore after dissolution of the disclosed plugs.

Eventually, as shown in FIG. 16, the wellbore 4 may be cleared once the disclosed plugs 100 dissolve, corrode, degrade, etc. in the casing 10 due to wellbore conditions, introduced agents, etc., as described herein.

FIGS. 17A through 19 illustrate cross-sectional views of another self-removing plug 100 according to the present disclosure during stages of setting in tubing 10. This plug 100 is similar to that disclosed above with reference to FIGS. 2A-2E, for example, so that like reference numerals are used for similar components. This plug 100 includes the mandrel 160 that remains with the plug 100 after setting.

On this plug 100, the permanent mandrel 160 is attached to an inner setting tool (e.g., 24: FIG. 2A) of a running tool (e.g., 20: FIG. 2A) with a temporary connection, such as a shearable or releasable thread. With the setting forces applied, the running tool (20) can eventually shear free of the permanent mandrel 160 which remains as part of the plug 100.

Figure 17A:
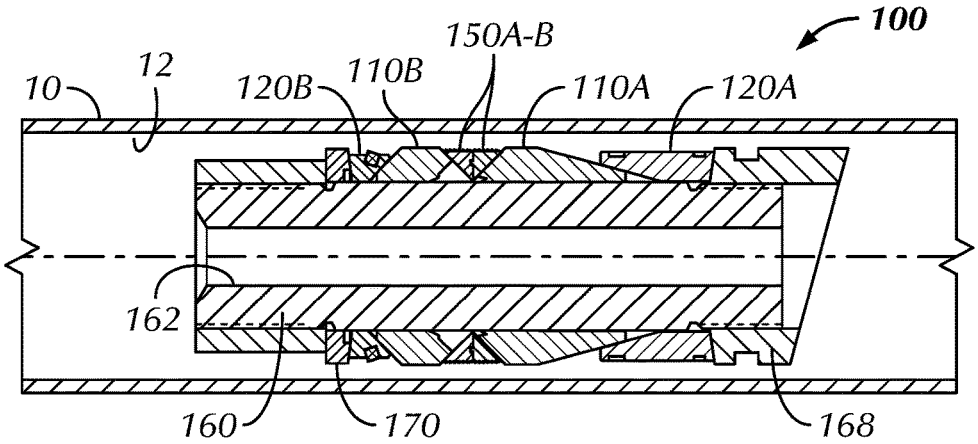
FIGS. 17A, 17B, 18A, and 18B illustrate cross-sectional views of another self-removing plug with a mandrel according to the present disclosure during stages of setting in tubing.
Figure 17B:
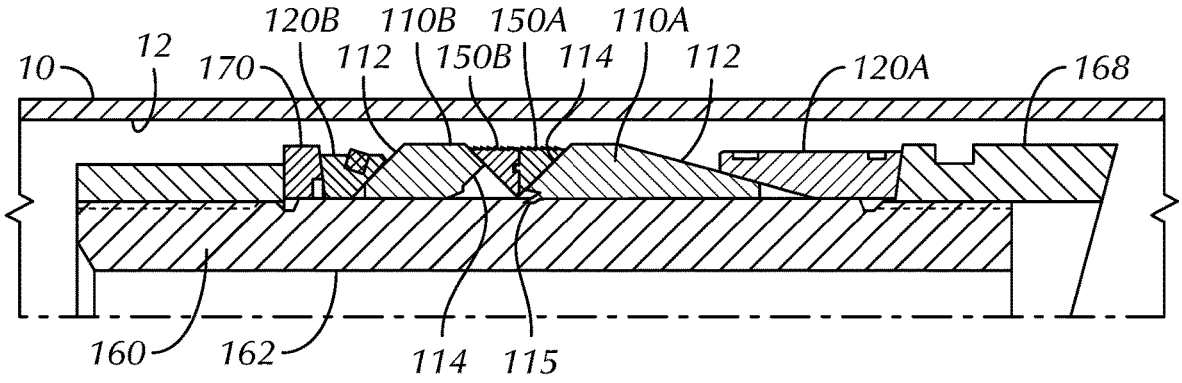

As shown in FIGS. 17A-17B, the plug 100 includes a contact or push ring 170 disposed on the mandrel 160 against which the setting sleeve (22) presses during setting procedures. The plug 100 also includes cones 110A-B, slips 120A-B, and a seal element (i.e., expansion element or rings 150A-B) movably disposed on the mandrel 160 and includes a mule shoe 168 affixed to the mandrel's distal end.

As with other embodiments, this plug 100 is self-removing. For example, the cones 110A-B, slips 120A-B, expansion rings 150A-B, mandrel 160, contact rings 170, mule shoe 168, and the like can be composed of a reactive metal, degradable composite polymer, or other self-removing material. If used on the disclosed plug 100, slip inserts 124 of the slips 120A-B can be composed of ductile iron, while any seals, pump-down rings, etc. can be composed of elastomer.

For run in as shown in FIGS. 17A-17B, the components 110A-B, 120A-B, and 150A-B fit on the mandrel 160 in an uncompressed state between the movable contact ring 170 and the fixed mule shoe 168. As best shown in the detail of FIG. 17B, the cones 110A-B of the plug 100 have inclines 112 against which the opposing slips 120A-B can wedge. The other end of the downhole slip 120A abuts against the mule shoe 168, which is used to push the slip 120A on the incline 112 during setting. In a similar fashion, the uphole slip 120B abuts against the contact ring 170, which is used to push the slip 120B on the incline 112 during setting.

The expansion rings 150A-B are disposed between complementary inclined ends 114 of the opposing cones 110A-B. (As such, the cones 110A-B act in a similar fashion to the body rings discussed previously with respect to FIGS. 1A through 2E, for example.) The outside surfaces of the expansion rings 150A-B can define wicker profiles or angled fins to enhance engagement with a surrounding casing wall 12. As shown, the expansion rings 150A-B preferably includes two adjacent split C-rings that can slide relative to one another as they expand outward. The splits in these rings 150A-C are misaligned so that the two split rings 150A-B together form a complete ring. Although only one set is shown here, multiple sets of such expansion rings 150A-B can be used adjacent one another to increase the overall surface area of their engagement with the surrounding casing wall 12.

During run-in as shown in FIGS. 17A-17B, the components 110A-B, 120A-B, and 150A-B are held on the mandrel 168 uncompressed. The running tool (20) is coupled to an actuator (not shown) used for activating the setting tool (20) and setting the plug 100. During activation, the setting sleeve (22) pushes against the contact ring 170 to compress the components, while the inner setting tool (24) pulls the mandrel 160 in the opposite direction. As a result, the mule shoe 168 concurrently pushes against the slips 120A to compress the components on the mandrel 160.

Figure 18A:
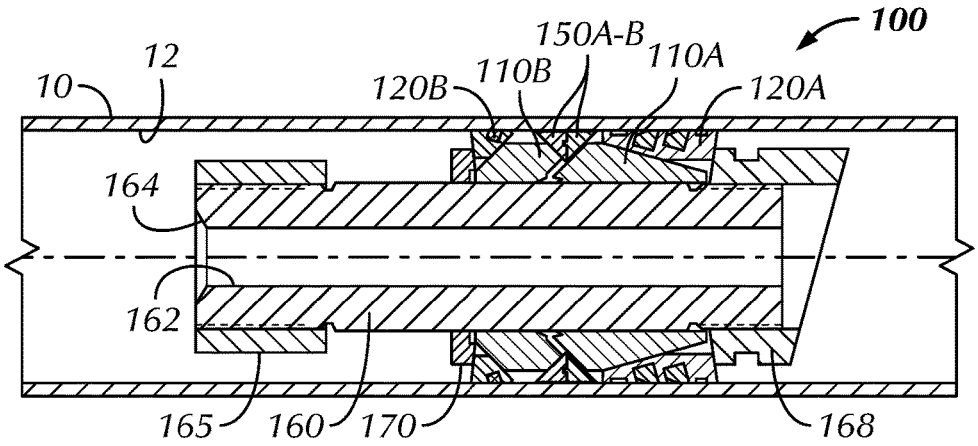
Figure 18B:
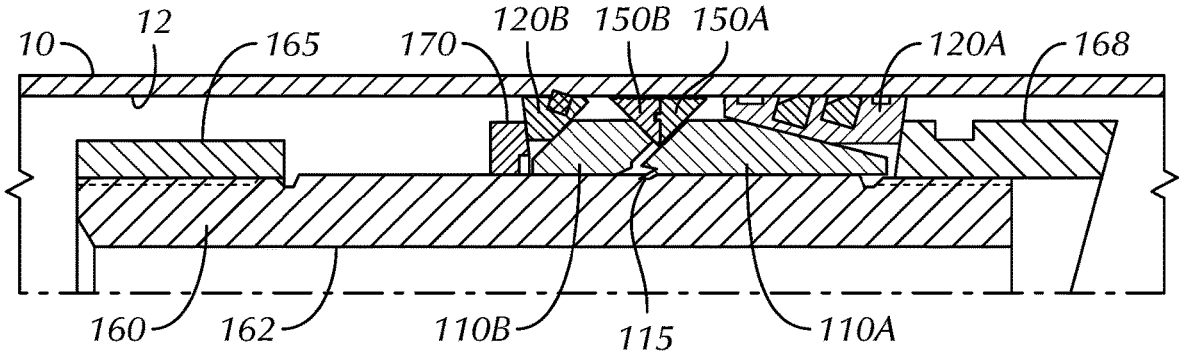

As shown in a set state of FIGS. 18A-18B, the opposing slips 120A-B are pushed up the inclines 112 and wedged against the inside wall 12 of the casing 10. At the same time, the expansion rings 150A-B are forced outward toward the surrounding casing 10 to form a metal-to-metal seal with the inner casing wall 12. During setting, the cones 110A-B sandwich the expansion rings 150A-B.

As best shown in FIG. 18B, the abutting inclined ends 114 of the cones 110A-B tend to come closer in proximity to one another, especially in the larger inner dimension of casing 10 depicted here. One or both of these inclined ends 114 includes a seal 115 in the form of a lip, tab, cup, extension, ring, or the like that can seal off fluid communication between the cone 110A and the outside of the mandrel 160.

In this embodiment, the lip 115 is disposed on the uphole end of the downhole cone 110A and may tend to seal of fluid pressure uphole thereof from passing downhole through the space between the cone 110A and the mandrel 160. A comparable lip (not shown) can be disposed on the uphole end of the uphole cone 110B to prevent fluid communication in the same direction. Moreover, the downhole ends of one or both cones 110A-B can have such a seal feature to prevent fluid downhole of the plug from communicating uphole in the space between the cones 110A-B and mandrel 160. As an additional alternative, the mandrel 160 may include one or more external seals (not shown) disposed thereabout for sealing against the inside of the cones, such as the downhole cone 110A. These and other forms of sealing features can be used.

Eventually during setting, the setting force shears the setting tool (20) free of the mandrel 160. At this point, a ball (not shown) or other plugging element can be deployed to the plug 100 to seat against the seating surface 164 of the mandrel 160. Pressure for a fracture treatment can be applied against the plug 100 with the seated ball, which prevents the treatment from passing to zones further downhole.

Figure 19:
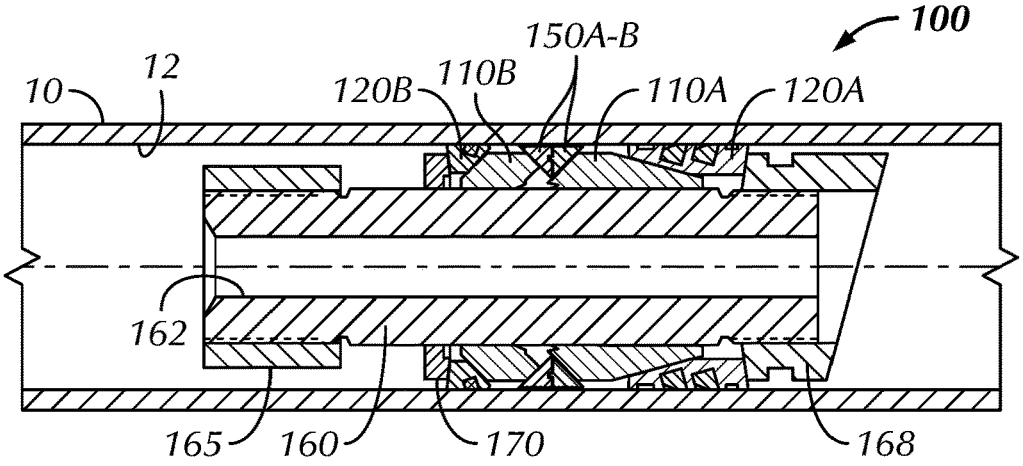
FIG. 19 illustrates the self-removing plug used in casing of a different weight.

For illustrative purposes, FIG. 19 shows setting of the plug 100 within a heavier weight of the same size casing 10 than shown in FIGS. 18A-18B such that the inner dimensions are different. The heavier casing 10 has a smaller inner dimension than in FIGS. 18A-18B. Still, the slips 120A-B and expansion rings 150A-B are compressed out from the mandrel 160 to seal against the casing 10 in a comparable manner as before.

Although not explicitly shown in FIGS. 17A through 19, a locking or retention feature can be used on the plug 100 to hold the set components (La, 110A-B, 120A-B, 150A-B) in their compressed state in a fixed position on the mandrel 160. For example, a body lock ring, serrations, ratchet mechanism, or the like can be used between the contact ring 170 and the mandrel's outer surface to hold the ring 170 in place.

Alternatively, the mandrel 170 may be free to slid relative to the set components (i.e., 110A-B, 120A-B, 150A-B), as with other embodiments disclosed herein. In such a case, pressure for a fracture treatment applied against the plug 100 with a ball seated in the mandrel's seating surface 164 will shift the mandrel 160 downhole through the set components (La, 110A-B, 120A-B, 150A-B). A shoulder 165 on the mandrel 160 can engage the contact ring 170 and tend to compress the set components. Meanwhile, the downhole slip 120A (with its inserts 124 if present) and the expanded expansion rings 150A-B would tend to prevent movement of the plug 100 downward in the casing 10. In general, the downhole slip 120A may be larger than the uphole slip 120B based on the purpose of the plug 100 to isolate fluid pressure primarily from a zone above the plug 100 to a zone below. Other arrangements, however, could be used.

Finally, the plug 100 of FIGS. 17A through 19 can be readily modified to include the mandrel 160 as removable in a manner similar to other embodiments disclosed herein. In such an instance, the mule shoe 168 may become unfixed from the temporary mandrel 160 during setting. The set components (i.e., 110A-B, 120A-B, 150A-B) can remain in their compressed state in a fixed position in the casing, and a ball can be landed on a seating area associated with the contact ring 170. These and other such modifications could be made to the disclosed plug 100.

As noted above, the plug 100 disclosed above can have expansion rings 150A-B to create a seal with the surrounding tubular. Because the rings 150A-B are preferably composed of metal as disclosed herein, the seal can be a metal-to-metal seal according to the present disclosure.

Figure 20A:
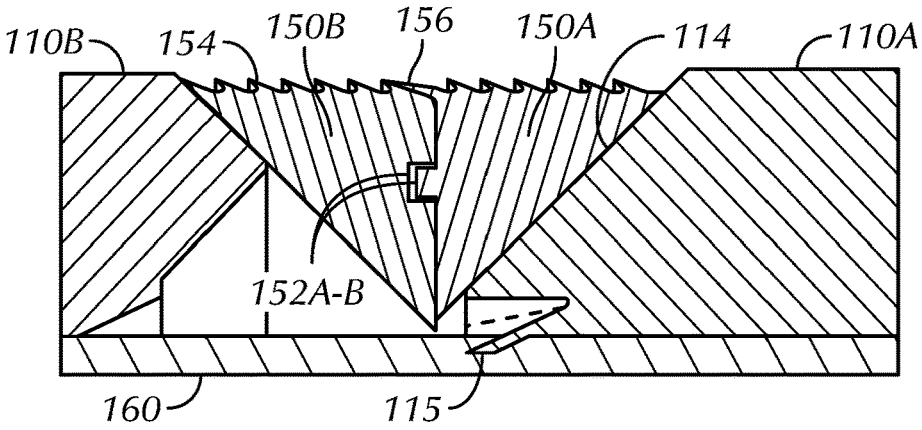
FIGS. 20A-20B illustrate details of expansion rings disposed between cones on the mandrel for the disclosed plug.
Figure 20B:
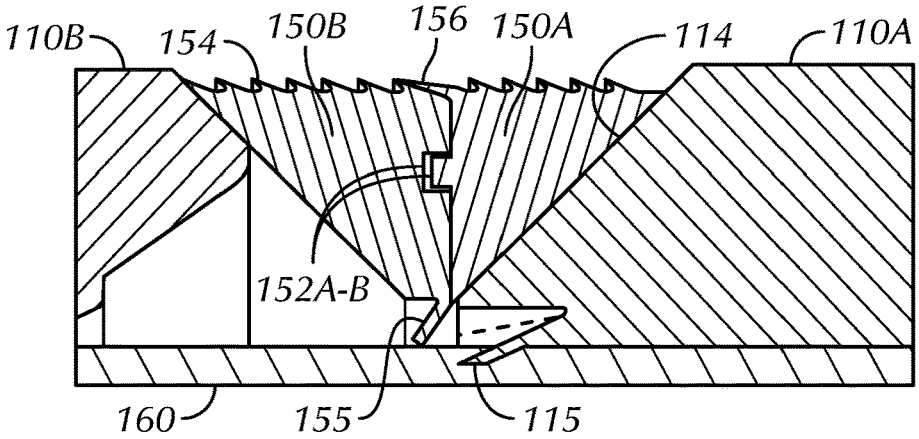

FIGS. 20A-20C illustrate further details of expansion rings 150A-B disposed between the cones 110A-B on the mandrel 160 for the disclosed plug 100. As shown in FIG. 20A, the expansion rings 150A-B include tongue and groove features 152A-B so they can be held adjacent one another as they are expanded outward when the cones 110A-B are brought together. As noted above, the external surface of the rings 150A-B can include wickers 154 or the like to facilitate sealing with the surrounding tubular (not shown). As depicted here, the wickers 154 may be slanted or laid down in the form of radial fins to make a number of collapsible cup seals with the surrounding tubular when pressed thereagainst. Furthermore, the downhole ring 150A may have an edge fin 156 that overlaps portion of the uphole ring 150B to close off fluid communication in the space between the rings 150A-B when the edge fin 156 is pressed against the surrounding tubular.

Again, the downhole cone 110A includes the lip seal 115. For illustrative purposes, the lip seal 115 is depicted in a relaxed state to show how it expands inward from the inner diameter of the cone 110A. When actually placed against the mandrel 160, the lip seal 115 will naturally be bent inward against the mandrel's outer surface and would have an outline better depicted by the dashed line in FIG. 20A. In this way, the downhole cone 110A can form a metal-to-metal seal with the mandrel 160. The cone face 114 of the downhole cone 110A may include a coating, such as a flexible non-metallic or metallic material, to help form a seal between the cone face 114 and the expansion ring 150A.

FIG. 20B illustrates a similar depiction of the details of the expansion rings 150A-B disposed between the cones 110A-B on the mandrel 160 for the disclosed plug 100. As shown in FIG. 20B, the expansion rings 150A-B include the tongue and groove features 152A-B and the slanted wickers 154. Also, the downhole ring 150A has the edge fin 156 that overlaps portion of the uphole ring 150B, and the cone face 114 can include a coating.

The uphole ring 150B in FIG. 20B includes a lip seal 155 on its inner diameter in a similar manner to the lip seal 115 of the downhole cone 110A. Rather than sealing with the mandrel 160, however, this lip seal 155 on the ring 150B can help seal the gap between the expansion ring 150B and cone face 114 of the downhole cone 110A when the rings 150A-B are wedged and expanded outward.

Figure 21A:
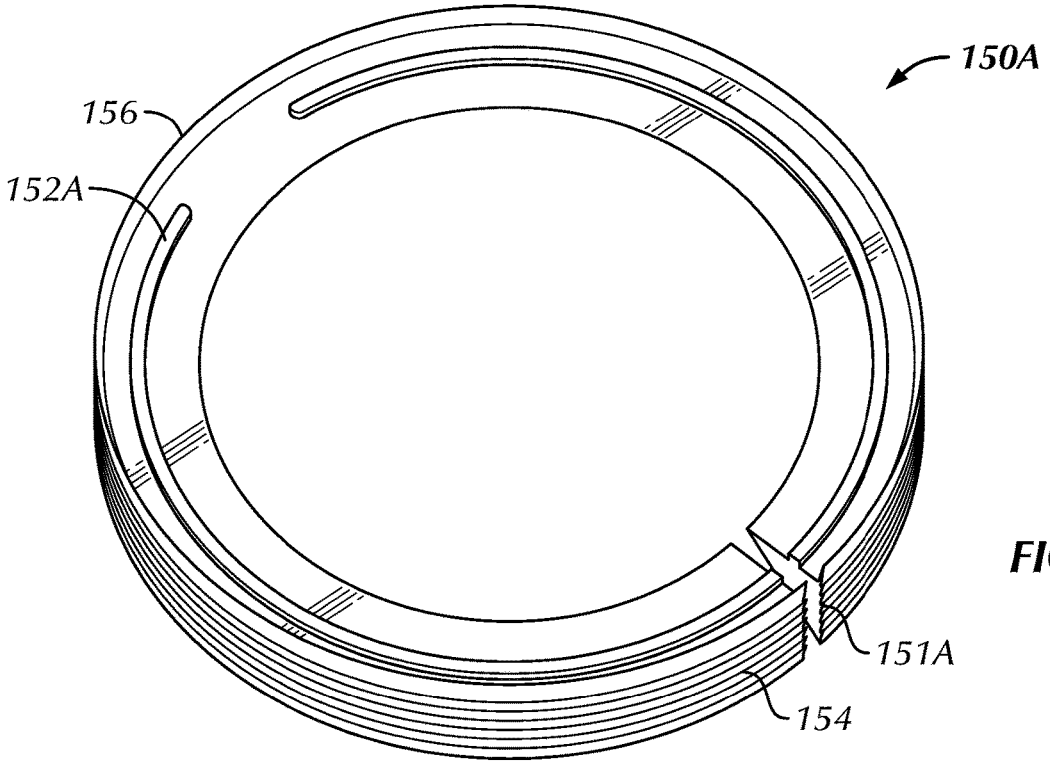
FIGS. 21A-21B illustrate isolated perspective views of expansions rings for the disclosed plug.
Figure 21B:
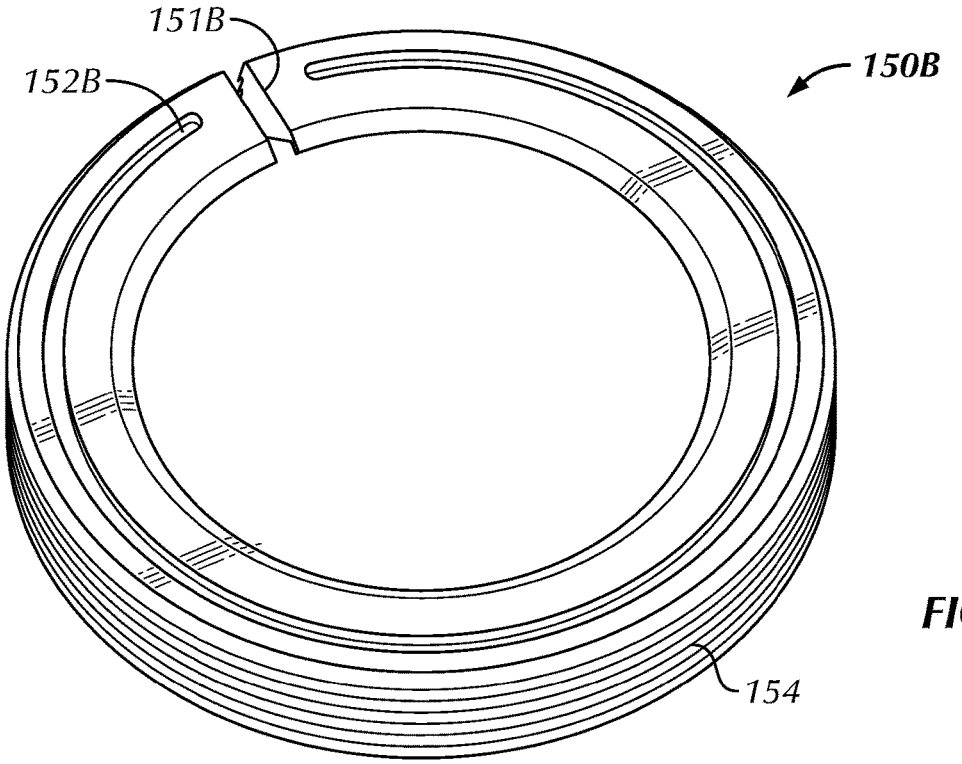

FIGS. 21A-21B illustrate isolated perspective views of the expansions rings 150A-B for the disclosed plug. To allow for expansion, each of the rings 150A-B includes a split 151A-B. When the rings 150A-B are placed next to one another, the splits 151A-B are offset from one another to close of a leak path. The downhole expansion ring 150A in FIG. 21A includes the tongue feature 152A partially thereabout. This feature 152A slideably fits in the groove feature 152B in the uphole expansion ring 150B of FIG. 21B. The tongue and groove features 152A-B not only help hold the rings 150A-B together, but can also create a seal between the rings 150A-B to close of a leak path for fluid.

Figure 22:
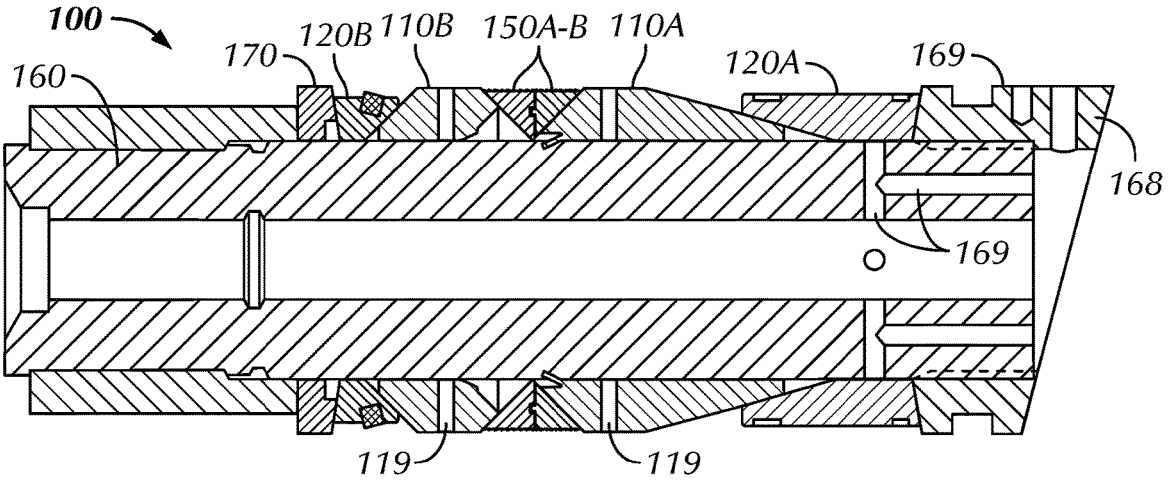
FIG. 22 illustrates an embodiment of a plug having features to help accelerate the corrosion rate.

As discussed herein, the disclosed plug 100 is preferably self-removing so that it corrodes or otherwise disintegrates downhole. To help accelerate the corrosion rate, the plug 100 can have a number of apertures, holes, and the like to allow fluid to access more surface area of some of the components while the plug 100 can maintain it sealing purpose. As shown in FIG. 22, for example, components such as the cones 110A-B, mandrel 160, and mule shoe 168 can have holes 119 and 169 in various places to allow fluid to access more surface area of these components and advance corrosion. Those components, such as the expansion rings 150A-B and cone faces, intended for sealing will lack such holes. Additionally, those components, such as the slips 120A-B, intended for structural support may lack such holes so as to not jeopardize their function.

In previous embodiments, metal-to-metal sealing has been presented as a primary means for sealing with the disclosed plugs. Such metal-to-metal sealing can be enhanced by using a degradable sealing material in the form of a coating, skin, wrap, etc. applied on, around, over, etc. one or more of the components of the disclosed plugs 100. In one particular arrangement disclosed below, the expansion rings 150 have a degradable, flexible skin, coating, wrap or the like to bridge off micro-leak paths between the casing 10, cone 110, expansion rings 150, and the like in the metal-to-metal sealing of the disclosed plugs 100. The skin can be a sprayed-on or a painted-on coating or can be molded on surfaces of the plug's components. For example, the skin can be applied to both expansion rings and may applied to the cone face.

In one arrangement, the flexible sealing skin is molded to shape and then installed over (and between) the expansion rings 150 and/or other components (e.g., cone 110) to contain any leakage. In another arrangement, the expansion rings 150 and/or other components (e.g., 110) are overmolded with the skin, such as with a degradable elastomer.

Figure 23:
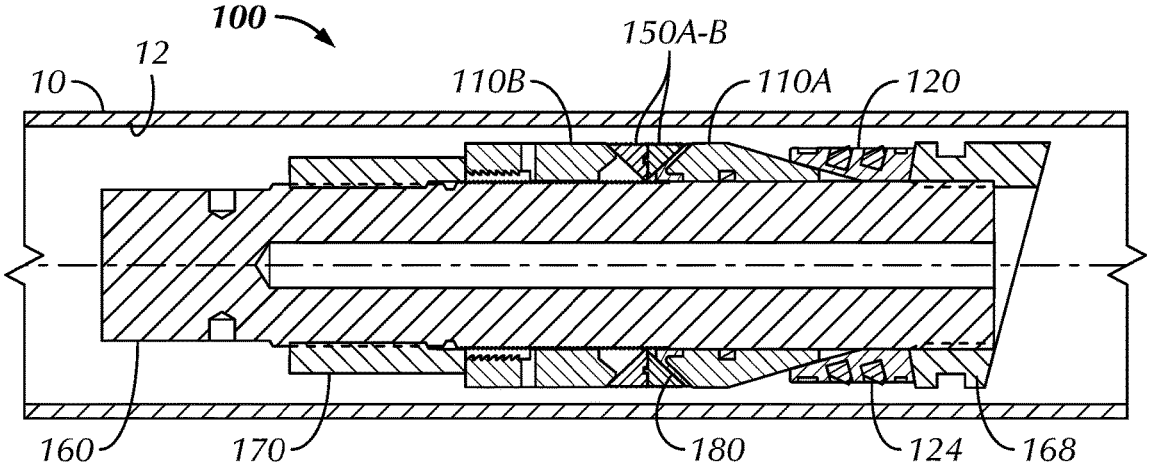
FIG. 23 illustrate a cross-sectional view of a self-removing plug with additional sealing for the expansion rings according to the present disclosure.

FIG. 23 illustrate a cross-sectional view of a self-removing plug 100 with additional sealing for the expansion rings 150A-B according to the present disclosure. This plug 100 is similar to those disclosed above, for example, with reference to FIG. 17A so that like reference numerals are used for similar components.

As shown in FIG. 23, the plug 100 includes a contact ring 170 disposed on a mandrel 160 against which a setting sleeve (22) presses during setting procedures. The plug 100 also includes cones 110A-B, slips 120, and expansion rings 150A-B movably disposed on the mandrel 160 and includes a mule shoe 168 affixed to the mandrel's distal end.

As with other embodiments, this plug 100 is self-removing. For example, the cones 110A-B, slips 120, expansion rings 150A-B, mandrel 160, contact ring 170, mule shoe 168, and the like can be composed of a reactive metal, degradable composite polymer, or other self-removing material. If used on the disclosed plug 100, slip inserts 124 of the slips 120 can be composed of ductile iron, while any seals, pump-down rings, etc. can be composed of elastomer.

The expansion rings 150A-B on the plug 100 include a sealing skin or coating 180 disposed/coated at least partially thereabout to bridge off micro-leak paths between the casing 10, cone 110, expansion rings 150A-B, and the like in the metal-to-metal sealing of the disclosed plug 100. The sealing skin or coating 180 can include elastomer, rubber, degradable rubber, dissolvable rubber, and epoxy and can be applied using techniques discussed below.

Figure 24A:
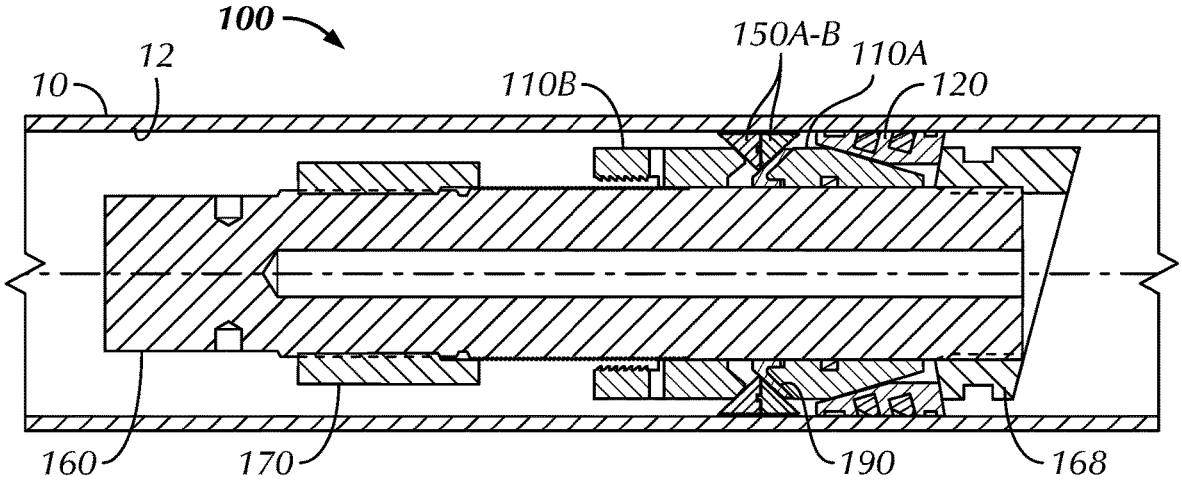
FIGS. 24A-24C illustrate cross-sectional views of a self-removing plug with additional sealing for the expansion rings according to the present disclosure during stages of setting in tubing.
Figure 24B:
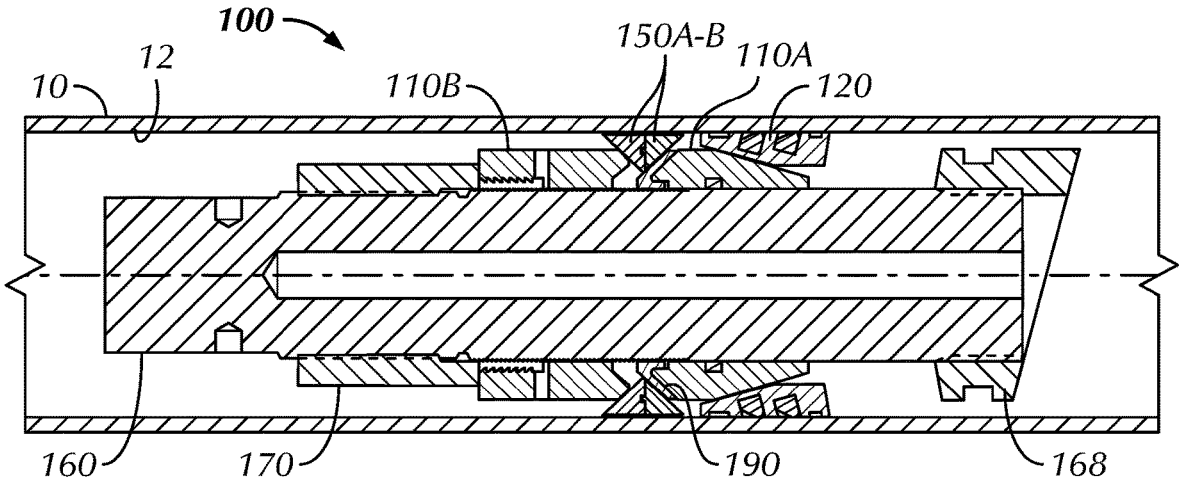

In contrast, FIGS. 24A-24B illustrate cross-sectional views of a self-removing plug 100 with other sealing for the expansion 150A-B rings according to the present disclosure during stages of setting in tubing. In this arrangement, portion of the cone 110A has a sealing skin 190 disposed at least partially on its surface against which the expansion rings 150A-B ride to bridge off micro-leak paths between the cone 110A and expansion rings 150A-B in the metal-to-metal sealing of the disclosed plug 100.

Figure 24C:
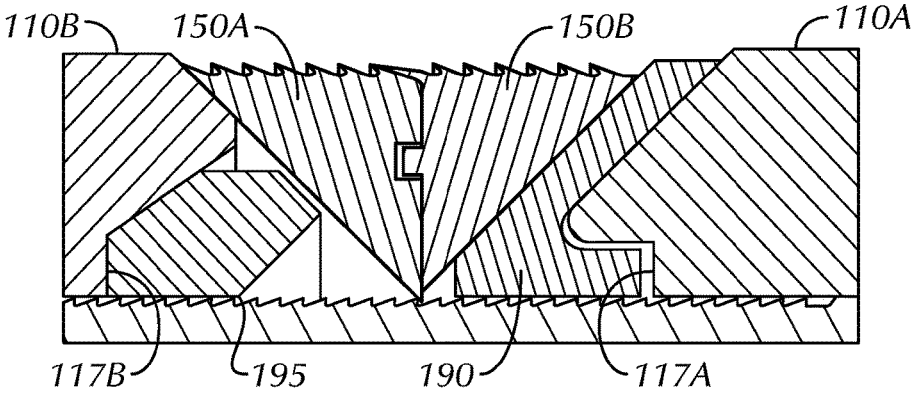

FIG. 24C illustrates a similar depiction of the details of the expansion rings 150A-B disposed between the cones 110A-B on the mandrel 160 for the disclosed plug 100. Here, the sealing skin 190 is disposed adjacent the cone 110A and may have a lip or leg that extends into an open edge 117A of the cone 110A. An additional crush ring 195 is also provided to enhance the seal and can be disposed in a cutaway or space 117B of the cone 110B. Like the sealing skin 190, the crush ring 195 can be made of a degradable rubber or polymer. When the cones 110A-B are brought together and the expansion rings 150A-B expand outward, the crush ring 195 and the sealing skin 190 can engage one another and seal the annular area between the expansion rings 150A-B and the mandrel 160. As will be appreciated by these arrangements, various skins, rings, gaskets, and the like can be disposed between one or both of the sides of the expansion rings 150A-B and the inclines of the cones 110A-B to enhance sealing.

In one arrangement, the flexible sealing skins or coatings 180 and 190 of FIGS. 23 and 24A-B are molded to shape and then installed over (and between) the components (e.g., the expansion rings 150A-B, cone 110A, etc.) to contain any leakage. In another arrangement, the components (e.g., expansion rings 150A-B, cone 110A, etc.) are over-molded with the skin or coating, such as with a degradable elastomer in an injection molding process.

Figure 25:
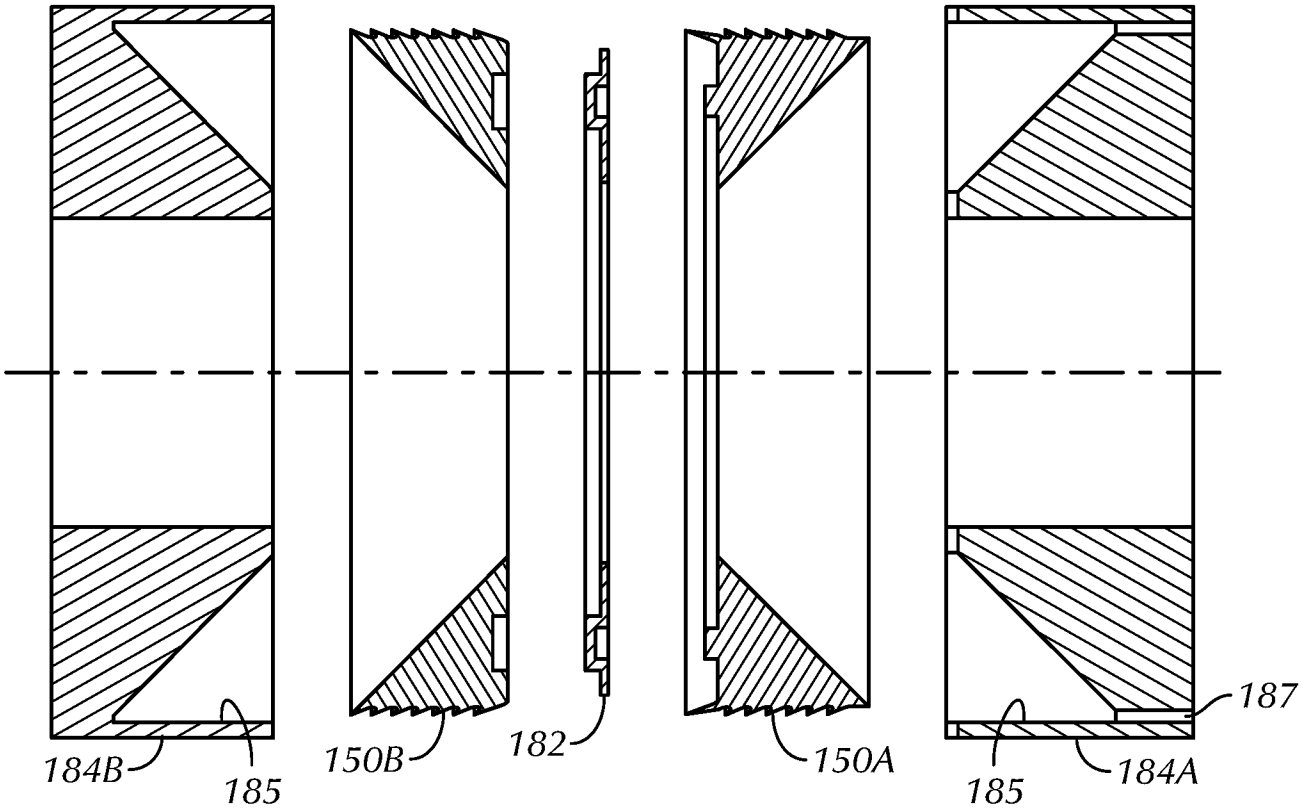
FIG. 25 illustrates a cross-sectional view of components for molding the additional sealing for the expansion rings.

As on example, FIG. 25 illustrates a cross-sectional view of components for molding the additional sealing for the expansion rings 150A-B. The upper and lower expansion rings 150A-B have a dissolvable sealing insert 182 disposed between them, which can be composed of a dissolvable elastomer, rubber, or the like. The joined rings 150A-B fit in reliefs 185 of bottom and top molds 184A-B. The top mold 184A has ports 187 for injection and weeping of injected material for the skin 180 to be formed on the expansion rings 150A-B.

Figures 26A, 26B, 26C:
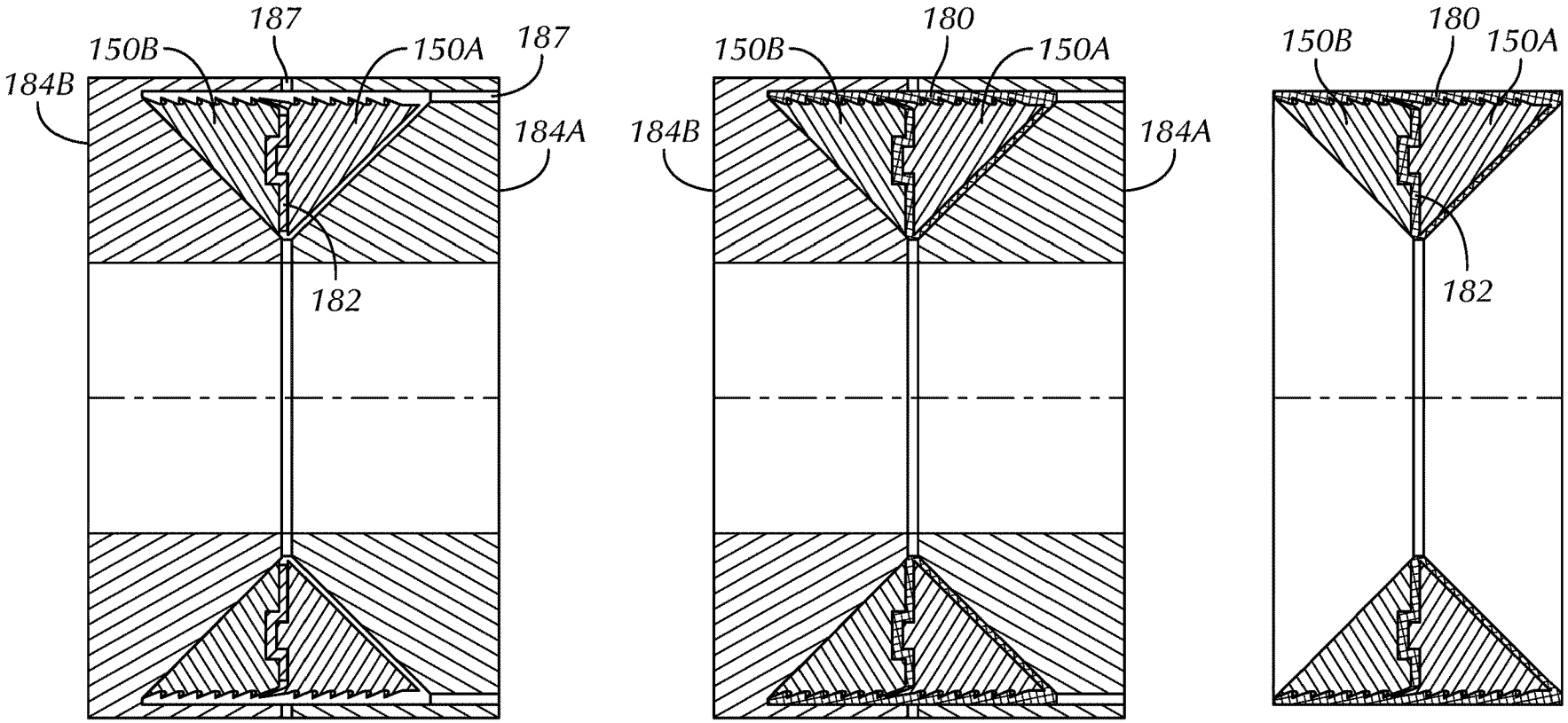

In particular, FIGS. 26A-26C illustrate steps of the molding process of the additional sealing for the expansion rings 150A-B. The components to be molded are prepped by cleaning/degreasing, and the dissolvable insert 182 is placed between upper and lower expansion rings 150A-B. Then, the rings 150A-B and insert 182 are placed in the relief 185 of the bottom mold 184B, and the top mold 184A is placed with its relief 185 on the rings 150A-B, as shown in FIG. 26A. As arranged, the expansion rings 150A-B in the bottom and top molds 184A-B have the insert 182 disposed between them and have exposed spaces communicating with the injection ports 187 in the molds 184A-B.

The molds 184A-B may be preheated and may have mold releasing agents. The coating material for the skin 180 is injection molded as shown in FIG. 26B. For example, dissolvable rubber may be injected into the molds 184A-B or it can be compression molded by placing raw material around expansion rings and then compressing together. The molds 184A-B are heated and/or compressed together for period of time.

Eventually, when the skin or coating 180 has been cured and set, the expansion rings 150A-B are removed from the molds 184A-B as shown in FIG. 26C and have the dissolvable skin 180 molded thereover and between. Any excess material can be trimmed off to complete the molding process.

Figures 3, 26D:
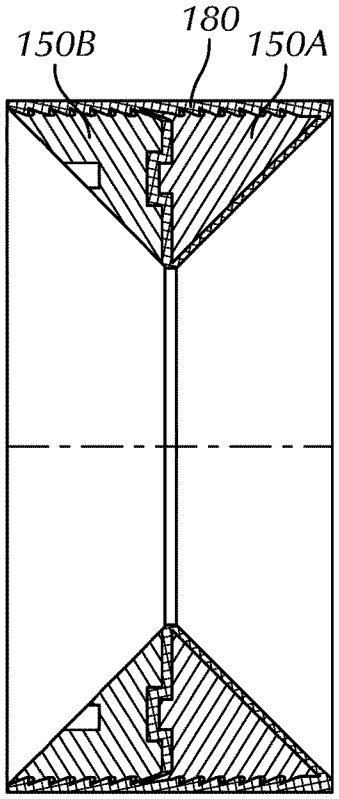
Figures 2, 26D:
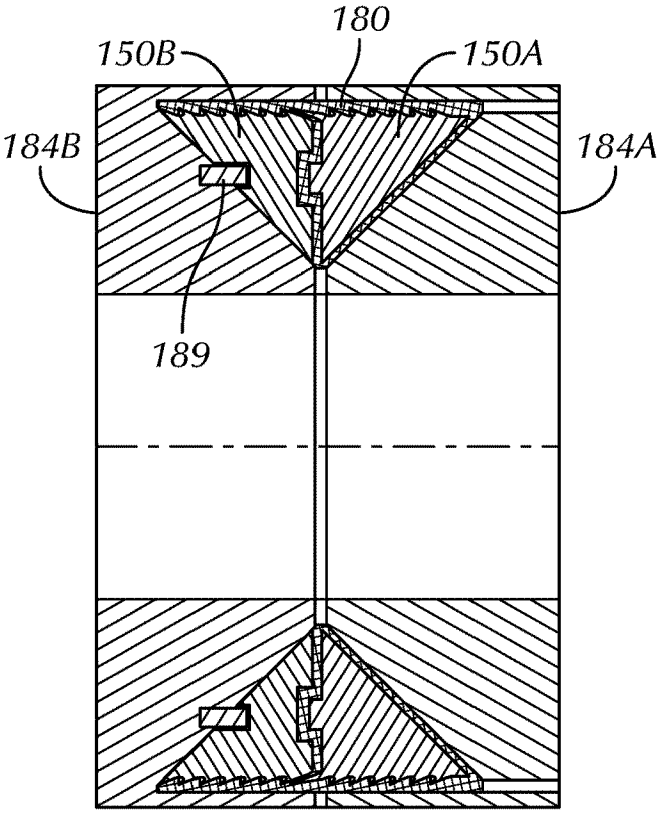
Figures 1, 26D:
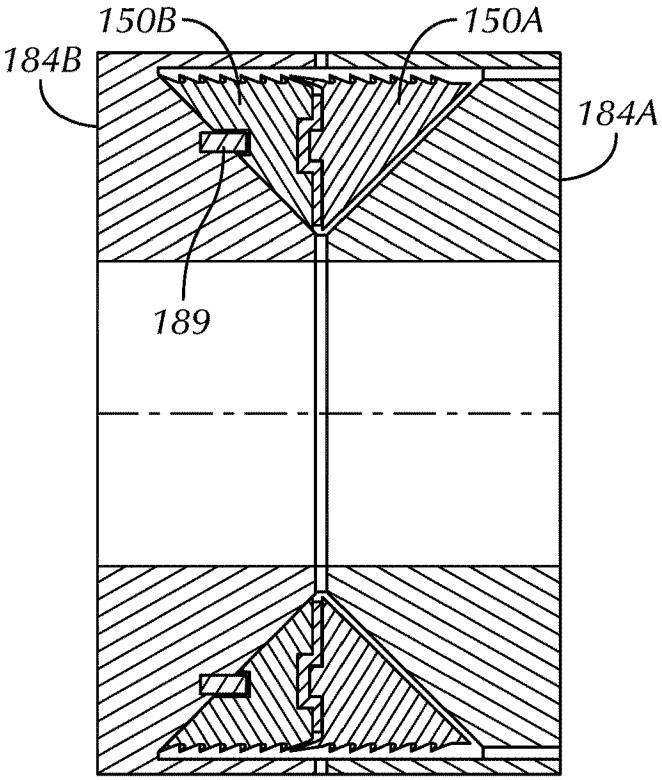

Referring to FIG. 26D, temporary pins 189 or other features may be added to the mold (e.g., bottom mold 184B) for containing the expansion rings (e.g., 150B) during the over-molding operation. These pins 189 may prevent radial movement of the rings 150A-B due to rubber compression when molding.

Figure 27A:
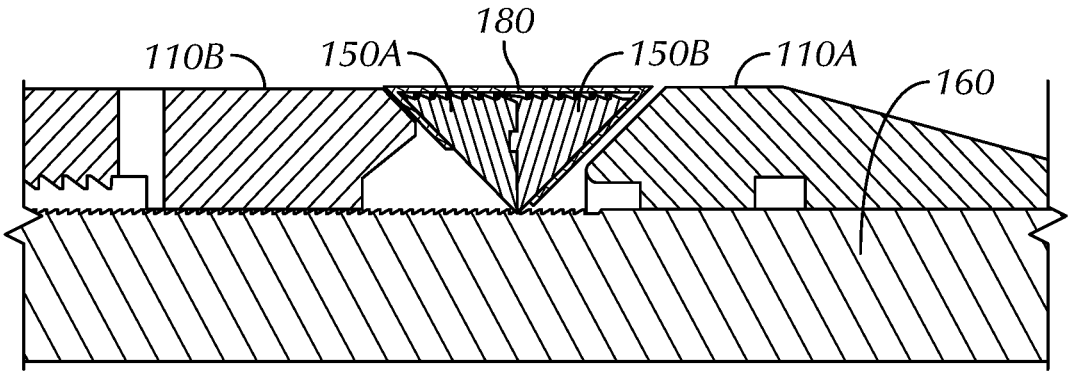
FIGS. 27A-27C illustrate cross-sectional views of alternative self-removing plugs with additional sealing for the expansion rings according to the present disclosure.

Although the inner surfaces of the expansion rings 150A-B in FIG. 26A-26D have the molded insert 182 between them, other arrangements may lack this portion. For example, FIG. 27A illustrates the expansion rings 150A-B having the skin 180 primarily on outer surfaces, while the rings 150A-B fit together with a metal-to-metal interface.

Figure 27B:
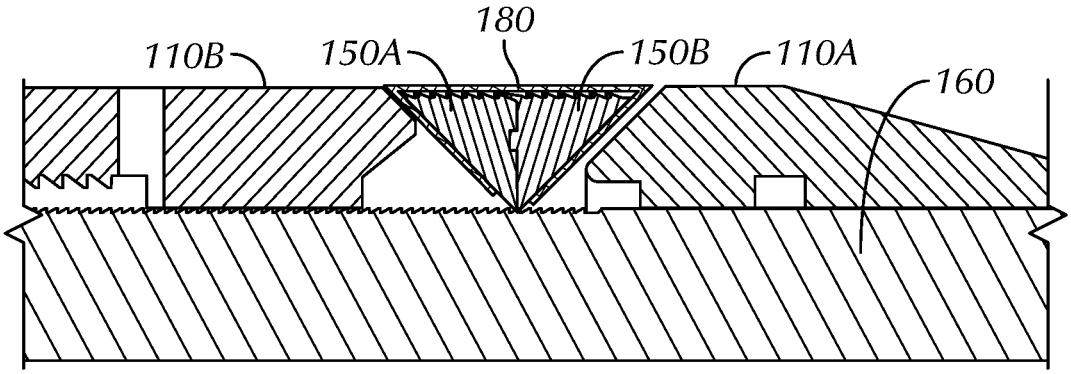

Additionally, although the wedged surface of only one of the expansion rings 150A-B and the outer contact surfaces of both rings 150A-B are shown having the skin or coating 180 in FIG. 26C, it will be appreciated that more or less of the rings 150A-B can be molded with the skin 180. For example, FIGS. 27A-27B show how more or most of both wedged surfaces on the two rings 150A-B can have portion of the molded skin or coating 180.

Figure 27C:
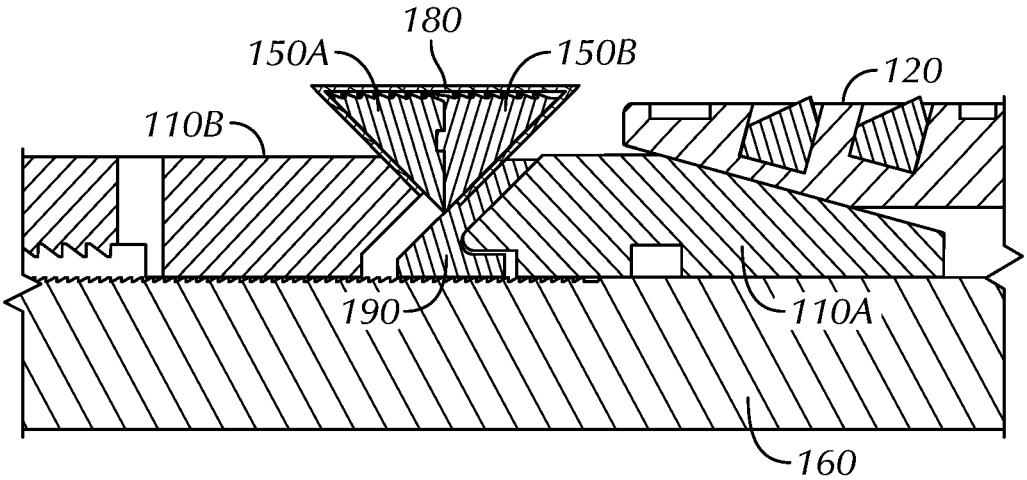

Finally, although previous arrangements may have shown either the expansion rings 150A-B having the skin 180 (FIG. 23) or have shown another component (e.g., cone (e.g., cone 110A) having the skin 190 (FIGS. 24A-B), it will be appreciated that the various arrangements can be combined. For example, FIG. 27C shows a combination of the expansion rings 150A-B having the disclosed skin 180 along with a skin insert 190 disposed on the cone 110A, primarily at the cone's inner wedged surface against which the expansion rings 150A-B ride. These and other combinations disclosed herein can be used for a particular implementation.

Figure 28A:
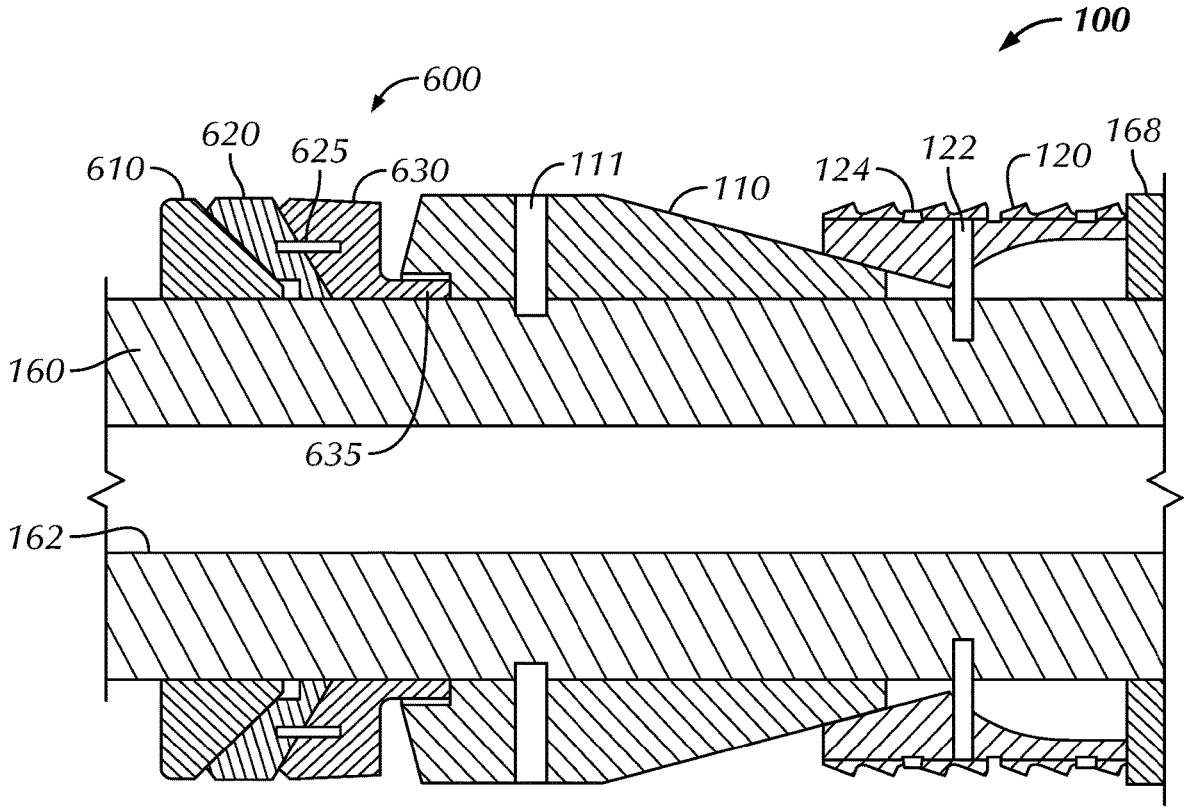
FIGS. 28A-28B illustrate views of a self-removing plug with alternative sealing system according to the present disclosure.
Figure 28B:
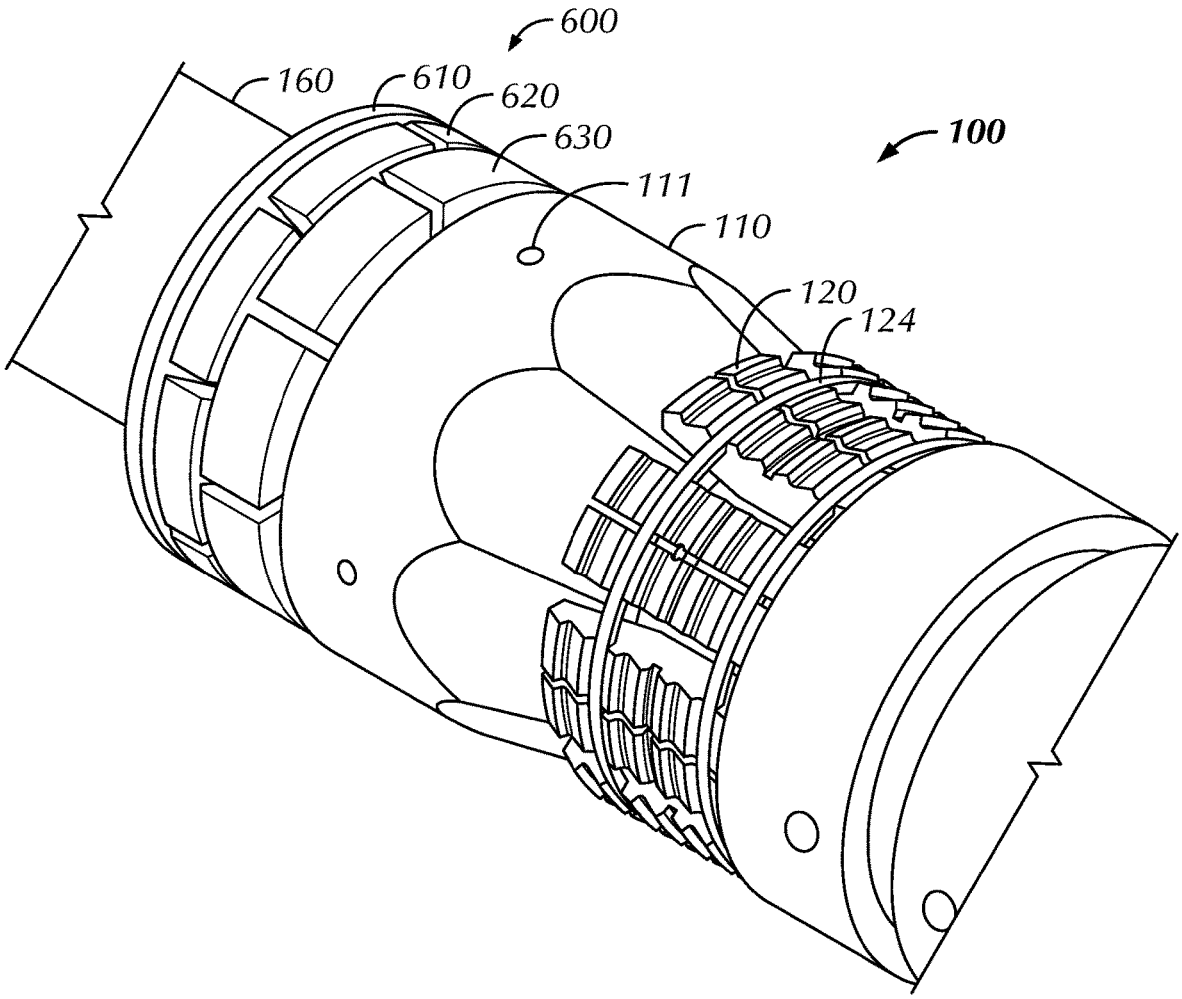

FIGS. 28A and 28B illustrate views of a self-removing plug 100 with an alternative seal element 600 according to the present disclosure. The plug 100 includes a mandrel 160 having a mule shoe 168, slips 120, a slip cone 110, and the seal element 600 disposed thereon. As before, one or more and preferably most of the components are composed of a dissolvable material. The slips 120 may be retained circumferentially by one or more bands 124 and may be held longitudinally on the mandrel 160 with pins 122. The cone 110 may also be held longitudinally on the mandrel 160 with pins 111. These retaining pins 122, 111 and bands 124 may prevent premature setting.

The seal element 600 includes a push cone 610 moveable on the end of the mandrel 160 and includes expansive petal rings 620, 630 sandwiched between the push cone 610 and the slip cone 110. For reference, FIG. 29 illustrates an isolated view of the push cone 610 and the expansive petal rings 620, 630 of the alternative sealing system 600.

The expansive petal rings 620, 630 respectively have petals 622, 632 that arrange offset from one another to seal off potential leak paths between them. To keep the offset orientation, pins 625 either integral or added to one of rings 620 affix between the rings 620, 630. The inner expansion ring 630 adjacent the slip cone 110 may have an inner lip 635 extending partially under the slip cone 110 to seal off internal leak paths.

As expected, setting of the plug 600 involves forcing the push cone 610 along the mandrel 160 against the expansion rings 620, 630, the slip cone 110, and slips 120, which are ultimately held against the lower shoulder of the mule shoe 168 or other part of the mandrel 160. Additional components as disclosed herein may be provided on the plug 100, such as body lock rings and other components above the push ring 610.

Figure 29:
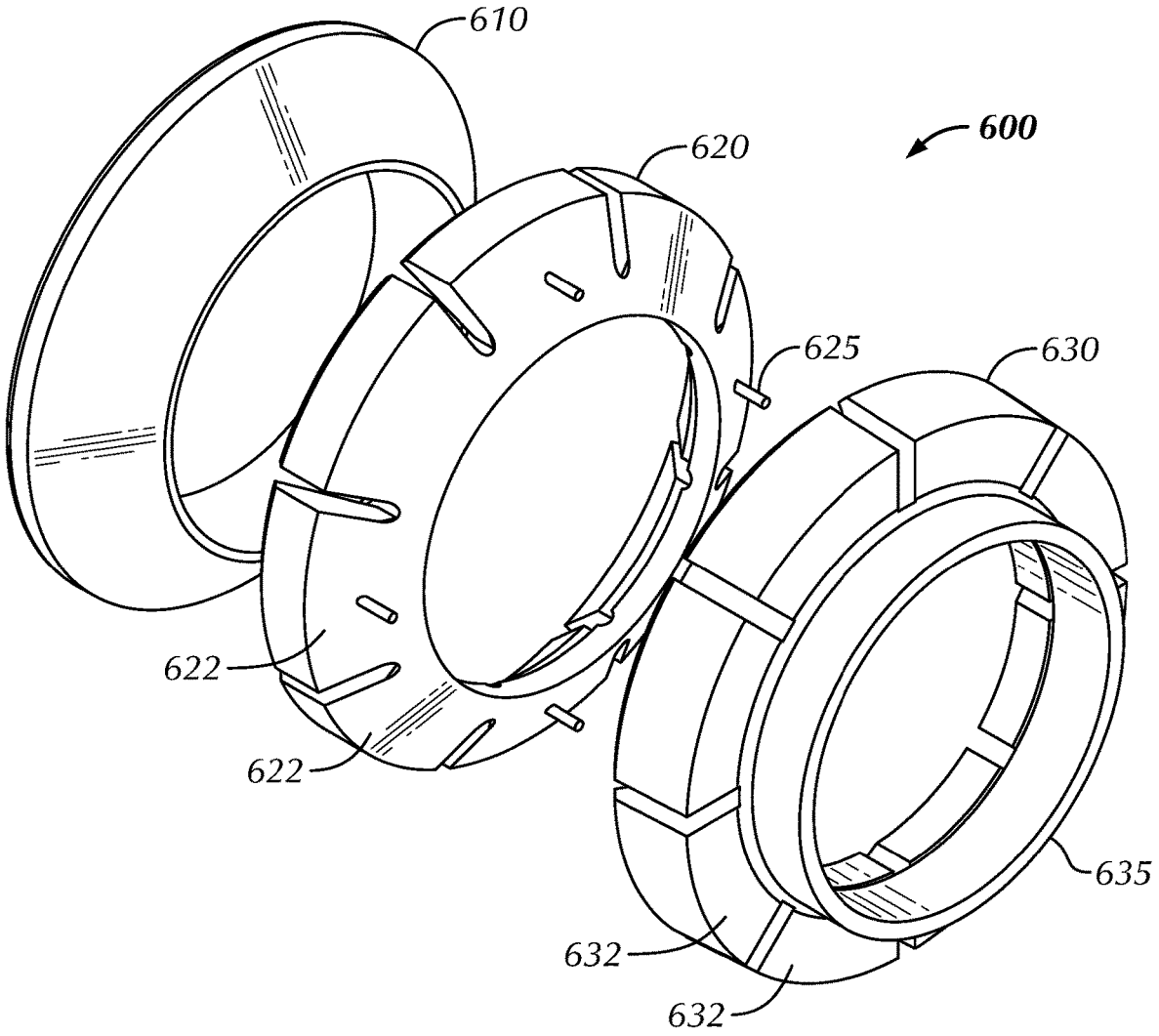
FIG. 29 illustrates an isolated view of the components of the alternative sealing system.

As depicted in FIG. 29, sealing can be enhanced by coating the cone face of the push cone 610 with a flexible material. Alternatively, the push cone 610 can be composed of a flexible, dissolvable material. The pedals 622, 632 of the expansion rings 620, 630 can also be coated with flexible material to help seal.

Figure 30A:
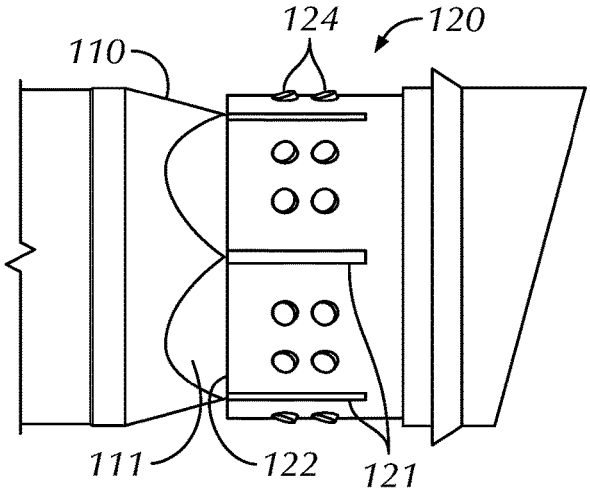
FIGS. 30A-30C illustrate various embodiments of slips for the disclosed plugs.

As disclosed herein, various types of slips can be used for the disclosed plugs. As shown in previous examples of FIGS. 1D, 2D-2E, etc., the slip 120 can be a solid ring. As shown in previous examples of FIGS. 3E, 4E, etc., the slip 220 can be a ring with separations 221, divisions, or the like to facilitate separation at various points. As shown in FIG. 30A, the slip 120 can include a ring having inserts 124 disposed about its face. The ringed slip 120 can have various slits or divisions 121 making partial segments 122. The cone 110 can have flats 111 to engage the segments 122.

Figure 30B:
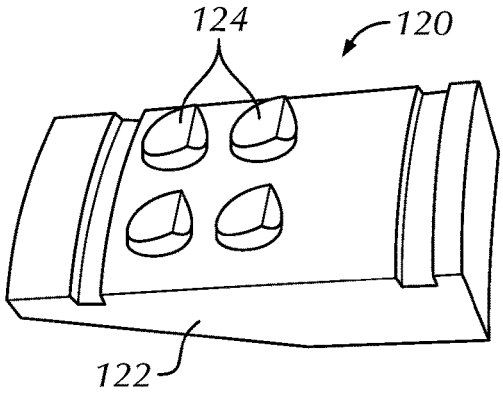

In other variations, the slip can be an assembly of several bodies, elements, or segments. As shown in FIG. 30B, the segment 122 of the slip 120 can have inserts or buttons 124 disposed in the face to engage casing. The individual segments 122 such as this can be held in a ring around a mandrel of the plug using retention bands or the like (not shown). As an alternative shown in FIG. 30C, the segment 122 of the slip 120 can have a wicker surface 126 for engaging casing. These and other arrangements can be used.

Figure 30C:
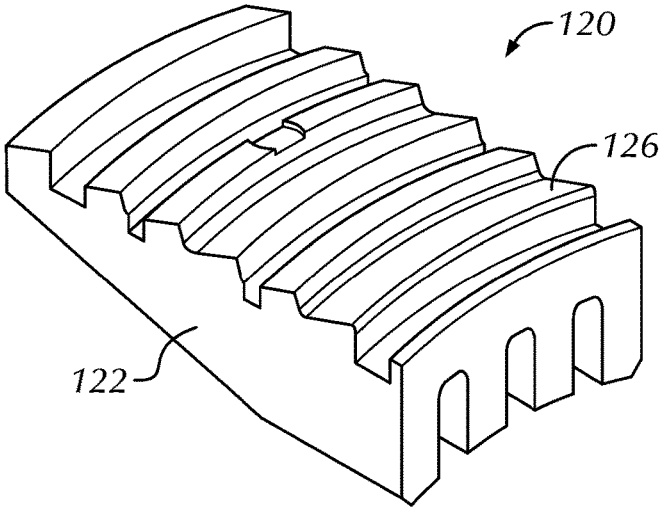

The surface of the slip, such as the wicker surface 126 of the segment 122 in FIG. 30C, can have a thermal spray coating on the dissolvable material of the slip 120. The coating can help the wicker surface 126 engage the casing wall. In general, the coating can be a nickel (Ni) based tungsten carbide (WC) material applied by a thermal spray process, such as high velocity oxygen fuel spraying (HVOF). Alternatively, the coating can be a ceramic-based coating. Details related to particular types of coatings can be found in U.S. Pub. Nos. 2014/0216722 and 2014/0216723, which are incorporated herein by reference. Use of the coating can eliminate the need for inserts or buttons and can minimize the amount of non-dissolvable material to be left behind.

In the various embodiments disclosed herein, various components are described as dissolving. How this is achieved depends on the type of materials involved and what conditions or the like the material are subjected to. In general, the dissolvable materials disclosed herein can be a reactive metal that "dissolves" in the well conditions. Dissolving as disclosed herein can, therefore, refer to corrosion of a reactive metal in the well conditions. Other forms of dissolving can be used for the various materials of the disclosed plugs. For example, an acid or other chemical may "dissolve" the plugs by breaking down the materials of the plugs and thereby "dissolve" the plug. The materials of the plug can "dissolve" by eroding or breaking apart in the well conditions. The materials of the disclosed plugs can "dissolve" by melting, degrading, eroding, etc. in the well conditions. Dissolving rates can be adjusted from hours to days by modifying the composition, thickness, and the like of the components for the plugs, by adding coatings to the components, altering well conditions, applying a trigger chemical, etc.

As noted above with reference to FIGS. 1A-1D, the slip 120, the sealing sleeve 130, and the expansion rings 150A-B in one configuration are manufactured from a ductile/high elongation dissolvable material, and the material's elongation properties can be in the range of 18-28%, but can be slightly more or less. Accordingly, a number of components in the various embodiments may be similarly configured. For example, components 120, 130, 150, 220, 230, 330, 360, 366, 420, 434, 436, 510, 620, 630, etc. in the various arrangements disclosed herein can be manufactured from a ductile/high elongation dissolvable material. Moreover, the material's elongation properties can be in the range of 18-28%, but can be slightly more or less.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus for use in a tubular, the apparatus comprising:

a mandrel having a first end shoulder;

a first slip disposed on the mandrel adjacent the first end shoulder;

a first incline disposed on the mandrel and having a first end adjacent the first slip, the first incline inclining outward of the mandrel from the first end and being movable relative to the first end shoulder to engage the first slip toward the tubular;

a second incline disposed on the mandrel adjacent the first incline and having a second end opposing the first end of the first incline, the second incline inclining outward of the mandrel from the second end; and a seal element disposed on the mandrel adjacent the second incline, the seal element comprising:

a first cone disposed on the mandrel and being movable longitudinally thereon, the first cone having a first inclined face opposing the second incline, the first inclined face defining a cutaway disposed adjacent the mandrel and being configured to fit a portion of the second incline between the first cone and the mandrel;

a crush ring disposed about the mandrel at the cutaway and comprising a sealing material; and at least one expansion ring disposed on the mandrel between the second incline and the first inclined face and having first and second inclined sides, the at least one expansion ring being expandable radially outward with the longitudinal movement of the first cone toward the second incline, at least a portion of the seal element at least one expansion ring comprising a dissolvable metallic material and being expandable outward of the mandrel on the second incline, the expanded portion of the seal element at least one expansion ring forming a metal seal between the second incline and the tubular and sealing off fluid communication in an annular space between the seal element and the tubular.

2. The apparatus of claim 1, wherein the first end shoulder is disposed toward a distal end of the mandrel; wherein the mandrel defines a through-bore from the distal end to a proximal end of the mandrel; and wherein the proximal end defines a seating area about the through-bore, the seating area being engageable by a plug deployed down the tubular to the apparatus.

3. The apparatus of claim 2, wherein the mandrel has a second end shoulder disposed at the proximal end adjacent the seal element; or wherein the seal element comprises a body lock ring being movable longitudinally on the mandrel to expand the seal element along the second incline, the body lock ring being locked from moving in a direction away from the second incline.

4. The apparatus of claim 1, further comprising a running tool having an outer setting sleeve disposed about an inner setting tool, the inner setting tool engaging the mandrel, the outer setting sleeve engaging adjacent the seal element, the inner setting tool and the outer setting sleeve being movable relative to one another.

5. The apparatus of claim 1, wherein a second cone disposed on the mandrel comprises the first and second inclines on the first and second opposing ends thereof, the first and second inclines each inclining outward of the mandrel toward an intermediate portion of the second cone between the first and second ends; or wherein a second cone disposed on the mandrel comprises the first incline, and wherein a ring disposed on the mandrel adjacent the second cone comprises the second incline.

6. The apparatus of claim 1, further comprising a sealing skin disposed between the at least one expansion ring and the second incline and comprising a sealing material.

7. The apparatus of claim 1, wherein the at least one expansion ring comprises split rings disposed adjacent one another and each having one of the first and second inclined sides.

8. The apparatus of claim 7, wherein the sealing element comprises a sealing insert interposed between the split rings; and/or wherein the split rings are interlocked with one another.

9. The apparatus of claim 1, wherein the first cone defines a second inclined face opposite the first inclined face; and wherein the apparatus further comprises a second slip disposed on the mandrel adjacent the second inclined face of the first cone.

10. The apparatus of claim 1, comprising a body lock ring disposed adjacent the first cone and being movable longitudinally on the mandrel toward the second incline, the body lock ring being locked from moving in a direction away from the second incline.

11. The apparatus of claim 1, further comprising:

a perforating gun running into the tubular and operable to perforate the tubular; and a running tool extending from the perforating gun and temporarily affixable to the apparatus, the running tool being operable to set the apparatus in the tubular.

12. The apparatus of claim 1, wherein at least one of:

the dissolvable metallic material is selected from the group consisting of a reactive metal; a magnesium alloy; and calcium, magnesium, and aluminum including alloying elements of calcium, magnesium, aluminum, lithium, gallium, indium, zinc, and bismuth;

one or more components of the apparatus other than the seal element are composed of one or more of a reactive metal, a degradable composite polymer, a self-removing material, and an elastomeric material; and at least a portion of the seal element is at least partially coated with a coating material selected from the group consisting of elastomer, rubber, degradable material, dissolvable material, and epoxy.

13. A downhole apparatus for use in a tubular, the apparatus comprising:

a mandrel having a first end shoulder;

a first slip disposed on the mandrel adjacent the first end shoulder;

a first incline disposed on the mandrel and having a first end adjacent the first slip, the first incline inclining outward of the mandrel from the first end and being movable relative to the first end shoulder to engage the first slip toward the tubular;

a second incline disposed on the mandrel adjacent the first incline and having a second end opposing the first end of the first incline, the second incline inclining outward of the mandrel from the second end; and a seal element disposed on the mandrel adjacent the second incline, the seal element comprising:

a first cone disposed on the mandrel and being movable longitudinally thereon, the first cone having a first inclined face opposing the second incline, the first inclined face defining a cutaway disposed adjacent the mandrel and being configured to fit a portion of the second incline between the first cone and the mandrel; and at least one expansion ring disposed on the mandrel between the second incline and the first inclined face and having first and second inclined sides, the at least one expansion ring being expandable radially outward with the longitudinal movement of the first cone toward the second incline, at least a portion of the at least one expansion ring comprising a dissolvable metallic material and being expandable outward of the mandrel on the second incline, the expanded portion of the at least one expansion ring forming a metal seal between the second incline and the tubular and sealing off fluid communication in an annular space between the seal element and the tubular, and wherein the at least one expansion ring comprises: split rings disposed adjacent one another and each having one of the first and second inclined sides; and a sealing insert interposed between the split rings.

14. The apparatus of claim 13, wherein the first cone defines a second inclined face opposite the first inclined face; and wherein the apparatus further comprises a second slip disposed on the mandrel adjacent the second inclined face of the first cone.

15. The apparatus of claim 13, comprising a body lock ring disposed adjacent the first cone and being movable longitudinally on the mandrel toward the second incline, the body lock ring being locked from moving in a direction away from the second incline.

16. The apparatus of claim 13, further comprising a crush ring disposed about the mandrel at the cutaway and comprising a sealing material.

17. A downhole apparatus for use in a tubular, the apparatus comprising:

a mandrel having a first end shoulder;

a first slip disposed on the mandrel adjacent the first end shoulder;

a first incline disposed on the mandrel and having a first end adjacent the first slip, the first incline inclining outward of the mandrel from the first end and being movable relative to the first end shoulder to engage the first slip toward the tubular;

a second incline disposed on the mandrel adjacent the first incline and having a second end opposing the first end of the first incline, the second incline inclining outward of the mandrel from the second end;

a first crush ring disposed about a portion of the mandrel and the second incline and comprising a sealing material; and a seal element disposed on the mandrel adjacent the second incline, the seal element comprising:

a first cone disposed on the mandrel and being movable longitudinally thereon, the first cone having a first inclined face opposing the second incline; and at least one expansion ring disposed on the mandrel between the second incline and the first inclined face and having first and second inclined sides, the at least one expansion ring being expandable radially outward with the longitudinal movement of the first cone toward the second incline, at least a portion of the at least one expansion ring comprising a dissolvable metallic material and being expandable outward of the mandrel on the second incline, the expanded portion of the at least one expansion ring forming a metal seal between the second incline and the tubular and sealing off fluid communication in an annular space between the seal element and the tubular, wherein the at least one expansion ring comprises: split rings disposed adjacent one another and each having one of the first and second inclined sides; and a sealing insert interposed between the split rings.

18. The apparatus of claim 17, wherein the first cone defines a second inclined face opposite the first inclined face; and wherein the apparatus further comprises a second slip disposed on the mandrel adjacent the second inclined face of the first cone.

19. The apparatus of claim 17, comprising a body lock ring disposed adjacent the first cone and being movable longitudinally on the mandrel toward the second incline, the body lock ring being locked from moving in a direction away from the second incline.

20. The apparatus of claim 17, wherein the first cone defines a cutaway in the first inclined face, the cutaway being disposed adjacent the mandrel and being complementary to the second incline.

21. The apparatus of claim 20, further comprising a second crush ring disposed about the mandrel at the cutaway and comprising a sealing material.

* * * * *